US008767595B2

(12) United States Patent
Haverty

(10) Patent No.: US 8,767,595 B2
(45) Date of Patent: Jul. 1, 2014

(54) ENHANCED METHODS OF CELLULAR ENVIRONMENT DETECTION WHEN INTEROPERATING WITH TIMED INTERFERS

(75) Inventor: James D Haverty, Boxborough, MA (US)

(73) Assignee: L-3 Communications Corporation, New York, NY (US)

( * ) Notice: Subject to any disclaimer, the term of this patent is extended or adjusted under 35 U.S.C. 154(b) by 1084 days.

(21) Appl. No.: 12/538,604

(22) Filed: Aug. 10, 2009

(65) Prior Publication Data

US 2010/0302956 A1 Dec. 2, 2010

Related U.S. Application Data

(63) Continuation-in-part of application No. PCT/US2006/030159, filed on Aug. 1, 2006, and a continuation-in-part of application No. PCT/US2006/033738, filed on Aug. 29, 2006, and a continuation-in-part of application No. PCT/US2007/063493, filed on Mar. 7, 2007.

(60) Provisional application No. 61/087,642, filed on Aug. 9, 2008, provisional application No. 61/088,531, filed on Aug. 13, 2008.

(51) Int. Cl.
*H04B 3/20* (2006.01)

(52) U.S. Cl.
USPC ..... 370/287; 370/331; 370/285; 370/286; 370/328; 370/335

(58) Field of Classification Search
USPC ..... 370/324, 331, 328, 335, 285–287; 342/357, 386, 408; 701/200; 702/107, 702/122
See application file for complete search history.

(56) References Cited

U.S. PATENT DOCUMENTS 3,805,242 A 4/1974 Matsumoto et al.
4,498,193 A 2/1985 Richardson (Continued)

FOREIGN PATENT DOCUMENTS

WO 2007016641 2/2007
WO 2007027699 3/2007

(Continued)

OTHER PUBLICATIONS

International Search Report dated Apr. 30, 2007, issued in corresponding International Application No. PCT/US06/33738.

(Continued)

*Primary Examiner* — Ricky Ngo
*Assistant Examiner* — Dewanda Samuel
(74) *Attorney, Agent, or Firm* — Onello & Mello LLP

(57) ABSTRACT

Techniques for performing analysis of a cellular telephone signaling environment in the presence of interferers. The techniques do the analysis by employing a receiver to listen to the cellular environment during holes in the interference. The holes have a timing which differs from that used by the cellular telephone signaling environment and will thus over time overlap with structures of interest in the cellular telephone environment. The holes may be smaller than the structure of interest. The signals which the receiver hears in the holes are analyzed and combined to reproduce the structure. The combination may involve statistical methods and weighted decoding. The analysis obtains information which permits surgical attacks on individual wireless devices which are in the traffic state. Example applications of the techniques are given for the GSM and CDMA cellular telephone standards.

15 Claims, 48 Drawing Sheets

(56) References Cited

U.S. PATENT DOCUMENTS

| | | | | |
|---|---|---|---|---|
| 5,001,771 | A | 3/1991 | New | |
| 5,142,574 | A | 8/1992 | West, Jr. et al. | |
| 5,239,557 | A | 8/1993 | Dent | |
| 5,278,908 | A | 1/1994 | Parikh et al. | |
| 5,293,375 | A | 3/1994 | Moorwood et al. | |
| 5,517,675 | A | 5/1996 | O'Connor et al. | |
| 5,706,333 | A | 1/1998 | Grenning et al. | |
| 5,892,477 | A | 4/1999 | Wehling | |
| 6,052,577 | A | 4/2000 | Taguchi | |
| 6,087,506 | A | 7/2000 | Knell et al. | |
| 6,195,529 | B1 * | 2/2001 | Linz et al. | 455/1 |
| 6,266,347 | B1 * | 7/2001 | Amrany et al. | 370/478 |
| 6,476,755 | B1 * | 11/2002 | Senio et al. | 342/15 |
| 6,496,703 | B1 * | 12/2002 | da Silva | 455/456.4 |
| 6,654,589 | B1 | 11/2003 | Haumont | |
| 6,928,289 | B1 | 8/2005 | Cho et al. | |
| 6,937,610 | B1 | 8/2005 | Grabelsky et al. | |
| 7,047,050 | B1 | 5/2006 | Khawand et al. | |
| 7,068,631 | B2 * | 6/2006 | Eriksson et al. | 370/337 |
| 7,069,025 | B2 | 6/2006 | Goren et al. | |
| 7,099,476 | B2 | 8/2006 | Chen et al. | |
| 7,126,979 | B2 * | 10/2006 | Karlsson | 375/130 |
| 7,142,108 | B2 | 11/2006 | Diener et al. | |
| 7,313,358 | B1 | 12/2007 | Ricci | |
| 7,352,770 | B1 | 4/2008 | Yonge, III et al. | |
| 7,363,008 | B2 | 4/2008 | Hassan et al. | |
| 7,437,128 | B1 * | 10/2008 | Fessler et al. | 455/67.13 |
| 7,606,524 | B1 | 10/2009 | Frank | |
| 7,742,265 | B2 * | 6/2010 | Rice | 361/56 |
| 7,920,696 | B2 | 4/2011 | Chew | |
| 8,140,001 | B2 | 3/2012 | Haverty | |
| 2001/0036821 | A1 | 11/2001 | Gainsboro et al. | |
| 2001/0039580 | A1 | 11/2001 | Walker et al. | |
| 2002/0102968 | A1 | 8/2002 | Arend et al. | |
| 2003/0021418 | A1 | 1/2003 | Arakawa et al. | |
| 2003/0086412 | A1 | 5/2003 | Jeong et al. | |
| 2003/0143943 | A1 * | 7/2003 | Kline | 455/1 |
| 2004/0063427 | A1 | 4/2004 | Narasimha et al. | |
| 2004/0077339 | A1 | 4/2004 | Martens | |
| 2004/0179488 | A1 | 9/2004 | Kim et al. | |
| 2004/0203911 | A1 | 10/2004 | Masuda et al. | |
| 2004/0213231 | A1 | 10/2004 | Cho et al. | |
| 2004/0242149 | A1 * | 12/2004 | Luneau | 455/1 |
| 2005/0052995 | A1 | 3/2005 | Gu et al. | |
| 2005/0058117 | A1 | 3/2005 | Morioka et al. | |
| 2005/0089001 | A1 | 4/2005 | Nishikawa | |
| 2005/0138433 | A1 | 6/2005 | Linetsky | |
| 2005/0149949 | A1 | 7/2005 | Tipton et al. | |
| 2005/0190784 | A1 | 9/2005 | Stine | |
| 2005/0249149 | A1 | 11/2005 | Kasturi et al. | |
| 2006/0018446 | A1 | 1/2006 | Schmandt et al. | |
| 2006/0036859 | A1 | 2/2006 | Adams et al. | |
| 2006/0109811 | A1 | 5/2006 | Schotten et al. | |
| 2006/0165073 | A1 | 7/2006 | Gopinath et al. | |
| 2006/0193274 | A1 | 8/2006 | Yamagata | |
| 2006/0264168 | A1 | 11/2006 | Corbett et al. | |
| 2007/0025386 | A1 | 2/2007 | Riedel et al. | |
| 2007/0087767 | A1 | 4/2007 | Pareek et al. | |
| 2007/0127421 | A1 | 6/2007 | D'Amico et al. | |
| 2007/0230389 | A1 | 10/2007 | Amann et al. | |
| 2007/0263672 | A1 | 11/2007 | Ojala et al. | |
| 2007/0270127 | A1 | 11/2007 | Santoro et al. | |
| 2008/0004045 | A1 | 1/2008 | Srey et al. | |
| 2008/0020749 | A1 | 1/2008 | Delaveau et al. | |
| 2008/0119130 | A1 | 5/2008 | Sinha | |
| 2008/0160995 | A1 | 7/2008 | Thiebaut et al. | |
| 2009/0209196 | A1 | 8/2009 | Haverty | |
| 2009/0311963 | A1 | 12/2009 | Haverty | |
| 2010/0068988 | A1 | 3/2010 | Valentine et al. | |
| 2010/0226308 | A1 | 9/2010 | Haverty | |
| 2010/0302956 | A1 | 12/2010 | Haverty | |
| 2010/0304706 | A1 | 12/2010 | Haverty | |
| 2010/0309884 | A1 | 12/2010 | Haverty | |
| 2011/0059689 | A1 | 3/2011 | Haverty | |

FOREIGN PATENT DOCUMENTS

| | | |
|---|---|---|
| WO | 2007106694 | 9/2007 |
| WO | 2008022175 | 2/2008 |

OTHER PUBLICATIONS

International Search Report dated Apr. 11, 2008, issued in corresponding International Application No. PCT/US07/75972.

Borgonovo, Flaminio, et al., RR-ALOHA, a Reliable R-ALOHA broadcast channel for ad-hoc inter-vehicle communication networks, 2002, pp. 1-5.

International Search Report dated Aug. 17, 2007, issued in corresponding International Application No. PCT/US06/30159.

International Search Report dated Aug. 26, 2008, issued in corresponding International Application No. PCT/US07/63493.

"Methods of Remotely Identifying, Suppressing, Disabling and Access Filtering Wireless Devices of Interest Using Signal Timing and Intercept Receivers of Effect Power Reduction, Minimization of Detection, and Minimization of Collateral Interference" Specification, Drawings, Claims and Prosecution History of U.S. Appl. No. 12/065,225, filed Feb. 28, 2008 by James D. Haverty, which is stored in the United States Patent and Trademark Office (USPTO).

"Methods of Suppressing GSM Wireless Device Threats in Dynamic or Wide Area Static Environments Using Minimal Power Consumption and Collateral Interference" Specification, Drawings, Claims and Prosecution History of U.S. Appl. No. 13/424,153, filed Mar. 19, 2012 by James D. Haverty, which is stored in the United States Patent and Trademark Office (USPTO).

"Node-Arbitrated Media Access Control Protocol for Ad Hoc Broadcast Networks Carrying Ephemeral Information" Specification, Drawings, Claims and Prosecution History of U.S. Appl. No. 12/377,583, filed Feb. 13, 2009 by James D. Haverty, which is stored in the United States Patent and Trademark Office (USPTO).

"Methods for Identifying Wireless Devices Connected to Potentially Threatening Devices" Specification, Drawings, Claims and Prosecution History of U.S. Appl. No. 12/538,662, filed Aug. 10, 2009 by James D. Haverty, which is stored in the United States Patent and Trademark Office (USPTO).

"Methods for Surreptitious Manipulation of CDMA 2000 Wireless Devices" Specification, Drawings, Claims and Prosecution History of U.S. Appl. No. 12/846,633, filed Jul. 29, 2010 by James D. Haverty, which is stored in the United States Patent and Trademark Office (USPTO).

"Using Code Channel Overrides to Suppress CDMA Wireless Devices" Specification, Drawings, Claims and Prosecution History of U.S. Appl. No. 12/877,064, filed Sep. 7, 2010 by James D. Haverty, which is stored in the United States Patent and Trademark Office (USPTO).

Langton, Charan, "Code Division Multiple Access (CDMA): The Concept of signal spreading and its uses in communications," 2002, 2006, pp. 1-18.

* cited by examiner

301

(700)

Call Setup on Dedicated Channel

Coder state = 00000
0 input hypothesis = (a) path emits 00
1 input hypothesis = (b) path emits 01

Hard Decode

Hard Received Symbol Transition Pair = 10
(a)path weight = 1 differ 0 + 0 match 0 = 1
(b)path weight = 0 differ 1 + 1 differ 0 = 0

Soft Decode

1st symbol weight 0 => 0.5; 1 => 0.5
2nd symbol weight 0 => 0.8; 1 => 0.2
(a)path weight = .5 + .8 = 1.3
(b)path weight = .5 + .2 = .7

ENHANCED METHODS OF CELLULAR ENVIRONMENT DETECTION WHEN INTEROPERATING WITH TIMED INTERFERS

CROSS-REFERENCE TO RELATED APPLICATIONS

The present patent application claims priority from:

U.S. provisional patent application 61/087,642, Haverty, Enhanced method of GSM environment detection when interoperating with timed interferers, filed Aug. 9, 2008 and U.S. provisional patent application 61/088,531, Enhanced method of cellular environment detection when interoperating with timed interferers, filed Aug. 13, 2008.

The present patent application is a continuation-in-part of the U.S. national stages of PCT patent application PCT/US2006/030159, James D. Haverty, Methods of Remotely Identifying, Suppressing and/or Disabling Wireless Devices of interest, filed Aug. 1, 2006, which claims priority from U.S. provisional patent application 60/704,808, James D. Haverty, Methods of Remotely Identifying, Suppressing and/or Disabling Wireless Devices of Interest, filed Aug. 2, 2005, U.S. provisional patent application 60/712,704, Haverty, Methods of surgical wireless device access filtering and threat suppression using signal timing, filed Aug. 29, 2005, and U.S. provisional patent application 60/717,131, Haverty, Methods of power consumption minimization as applied to the remote interrogation and/or suppression of wireless devices, filed Sep. 14, 2005.

PCT/US2006/033738, Haverty, Methods of Remotely Identifying, Suppressing, Disabling and Access Filtering Wireless Devices of Interest using Signal Timing and Intercept Receivers to Effect Power Reduction, Minimization of Detection, and Minimization of Collateral Interference, filed Aug. 29, 2006, (claiming priority from U.S. provisional patent application 60/712,704 filed Aug. 29, 2005 and 60/717,131 filed Sep. 14, 2005

The U.S. national stage of PCT/US2006/030519 and PCT/US2006/033738 is U.S. patent application Ser. No. 12/065,225, Haverty, Methods of remotely identifying, suppressing, disabling and access filtering wireless devices of interest using signal timing and intercept receivers of effect power reduction, minimization of detection, and minimization of collateral interference filed Feb. 28, 2008.

PCT patent application PCT/US2007/063493, James D. Haverty, Methods of Suppressing GSM Wireless Device Threats in Dynamic or Wide Area Static Environments having Minimal Power Consumption and Collateral Interference, which claims priority from U.S. provisional patent application 60/780,006, James D. Haverty, Methods of Suppressing GSM Wireless Device Threats in Dynamic or Wide Area Static Environments having Minimal Power Consumption and Collateral Interference, filed Mar. 7, 2004. The U.S. national stage is U.S. patent application Ser. No. 12/280,716

All of the above U.S. provisional patent applications, PCT patent applications, and U.S. national stage patent applications are hereby incorporated by reference into the present patent application for all permitted purposes.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The techniques disclosed in this patent application are enhancements to a system for surgically surveying, and interrogating cellular telephone systems and surgically neutralizing components of such systems. The systems in which the enhancements are implemented are described in the U.S. national stages Ser. Nos. 12/065,225 and 12/280,716. Such systems may be termed in the following surgical interferers. The enhancements to the systems of Ser Nos. 12/065,225 and 12/280,716 enable the enhanced system to continue to survey and interrogate cellular telephone systems despite the presence of either co-located or temporally adjacent interferers designed to suppress signals from the cellular telephone system. In the terminology used in the relevant arts, the enhanced surgical interferer can "look through" the signals produced by the interferers.

2. Description of Related Art

Prior art describes systems that employ interference to neutralize components of cellular telephone systems use broad-based nonspecific interfering techniques. An important class of such interferers are reactive interferers, which listen to the signals being produced by the cellular telephone system whose components are to be neutralized and then produce interfering signals based on what they have heard and the kind of neutralization required. In the following, this listening activity may be termed acquiring the environment of the cellular telephone system. The environment may be termed the cellular environment. The interfering signal produced by the reactive interferer of course makes listening to the environment impossible, and because the environment is dynamic, a reactive interferer must cease producing the interfering signal in order to again acquire the environment. A period during which a reactive interferer has ceased broadcasting the interfering signal in order to listen to the environment is termed in the following a hole in the interfering signal. Of course, if a number of reactive interferers are in operation, they must agree as to when the holes will occur and how long the holes will be.

Prior-art reactive interferers generally do not do complex analysis of the environment they acquire during a hole. Typically, they perform spectral analysis which simply determines where there is energy present in the environment and then produce interference signals which interfere with the detected energy. Some systems may take this a step further and attempt to characterize the signaling enough to minimize false alarms. However, the analysis techniques cannot acquire deeper structures from the signaling environment such as whether the signal is a beacon, what the parameters carried in the beacon are, or whether the signal is being generated by a frequency hopping phone that is connected to some potentially threatening device. As set forth in PCT/US2007/063493, techniques are available that permit acquisition of such deeper structures and detection of potentially-threatening cellular telephones and that further permit generation of interfering signals which can neutralize potentially threatening cellular telephones without interfering with cellular telephones that are clearly non-threatening. These techniques, however, require access to access to a wireless device's forward link the beacon and related signals which are provided to the cellular device in the forward link and that govern subsequent interactions between a wireless device and the base station. Acquisition of the cellular environment at this level is not possible in the presence of a signal from a broad-based interferer.

Prior art suggests other schemes which permit a receiver to acquire the cellular environment in the presence of an interferer. One approach is canceling the signal produced by the interferer out of the signal received by the receiver. However this approach has serious practical limitations when used with cellular environments because of propagation and dynamic range issues. For example, one can directly sample or perhaps generate a copy of the interfering waveform, negate it, and combine it directly with the incoming RF signal. However, the waveforms used in the cellular systems have wavelengths on the order of inches. Apart from the stringent sub nanosecond calibration tolerance issues raised by such wavelengths (bringing into question manufacturability in quantity), the effects of multipath (e.g., reflections) on the actual interferer signal will, in either case, cause time phase delays and instead of canceling the waveform may enhance it. Even if the technique is partially successful in canceling some parts of the waveform it is likely that the unsuppressed portions of the signal will cause the automatic gain control features common to most receivers to render the receiver incapable of listening to the signals of interest at uncontrollable times. Another shortcoming is that this approach will not necessarily cancel non-collocated interferers (e.g., another interferer on another vehicle operating in proximity to the receiver). For example using the signal sampling method of generating the cancellation signal, it is impossible to predict the phasing (time delay of the non-collocated) interferer, as its position will not necessarily be fixed with respect to the receiver. It is further not possible to completely predict the waveform which needs to be generated using the generated signal approach.

Another approach would be to include the interfering signal in the signal being analyzed and subsequently use signal processing to estimate and thereby cancel the effects of all interferers. However due to collocation of the interferer and the receiver, the potential dynamic range between the interfering signal and the signal of interest is enormous rendering this approach impractical using existing cost-effective technology.

What is needed, and what is disclosed in the present patent application, is techniques which make the use of the techniques for acquiring the cellular environment which are described in Ser. Nos. 12/065,225 and 12/280,716 possible in a cellular environment in which the receiver is restricted to listening during the holes in the interfering signals.

SUMMARY OF THE INVENTION

The invention enhances the system disclosed in PCT/US2007/063493 so that it can use holes in the interference to acquire the information about the cellular environment which the system disclosed in PCT/US2007/063493 needs to carry out the surgical neutralization of possibly threatening devices.

Summary of the Invention

In one aspect, what is provided by the inventive techniques is a method of obtaining information about a repeated structure in a signal which is generated according to a standard. The signal represents a sequence of symbols and the repeated structure has a first timing in the signal. The method is performed in apparatus that includes a receiver and a signal analyzer. The steps include

- Receiving the signal for a set of discrete periods in the receiver. The periods in the set of discrete periods have a second timing relative to the signal such that over a plurality of repetitions of the repeated structure in the signal, the entire repeated structure is received in the receiver.
- Converting the signal as received in each of the discrete periods into symbols belonging to the sequence.
- Analyzing the symbols in the analyzer to obtain information about, the repeated structure.

Continuing in more detail, the method may be employed in a situation in which the signal is being interfered with by an interferer. In that situation, the set of discrete periods is made up of periods during which the signal is not interfered with by an interferer. The apparatus performing the method may determine the set of discrete periods from the interferer's behavior or the apparatus may be operating in cooperation with the interferer. In such a case, either the interferer or the apparatus may specify the set of discrete periods.

In the step of analyzing, the method may combine the symbols using a statistical method.

The repeated structure may further be a frame which includes another repeated structure which contains timing information about the frame, and the analyzer may further perform the step of obtaining the timing information from the other repeated structure.

The discrete period may be too short to receive a portion of the signal that contains an entire substructure. The discrete portions that contain portions of the substructure may be combined to obtain the symbols for the entire substructure. The combination may be done using a statistical method. The combining may further include using soft decoding techniques which employ the results of the statistical method. The substructure may include an error detection code and the method may use the error detection code to determine whether a result of the combination is correct. The error detection code may contain error correction information and that information may be used to reduce the number of possible combinations of the symbols.

Other aspects of the foregoing techniques include their application to the GSM and CDMA cellular telephone standards.

Further inventive techniques include an automatic gain control which is particularly adapted to a receiver which is employed to listen to a target signal that is hidden by another much stronger signal except during a discrete interval whose timing is known. The automatic gain control has a rapid rise time and a decay time which is much longer than the rise time. The receiver resets the automatic gain control according to the timing of the discrete interval's beginning.

Other inventive techniques involve managing a baiting beacon in an environment in which there are both discrete intervals without interferers and reactive interferers which may react to signals produced by the baiting beacon in the discrete intervals. The techniques involve basing the interaction between the baiting beacon and the wireless device on portions of the signal which have enough redundancy to permit interaction between the baiting beacon and the wireless device in spite of the interferers. In the GSM version of the techniques, the baiting beacon directs a wireless device that is being baited to a traffic channel and interacts with the wireless device at times other than during the discrete intervals using the fast associated channel associated with the traffic channel. In the CDMA version, the baiting beacon relies on CDMA's built-in coding redundancy to permit interaction between the beacon and the wireless device even if the beacon ceases transmitting during the holes.

A still further inventive technique uses the ability of the surgical interferer to modify the signals received by a wireless device to send DTMF digits to a suspect wireless device. Other objects and advantages will be apparent to those skilled in the arts to which the invention pertains upon perusal of the following Detailed Description and Drawing, wherein:

The general techniques described herein may be employed with any signal which is generated according to a standard and represents a sequence of symbols. The particular techniques described herein are specific to a given cellular standard. What information about the signaling environment is acquired, how it is acquired, and how it is used will of course depend on the nature of the signaling environment. In GSM, for example the beacon timing is not likely to be commensurate with holes. The holes will therefore slide across the beacon and hence allow a receiver in a surgical interferer to recover the beacon information in pieces. The surgical interferer can then analyze the pieces to acquire the signaling environment. In the case of CDMA/UMTS beacons the holes are sufficient to unambiguously detect (a) beacon(s) and its (their) associated pilot(s) and from this glean sufficient information to attack the associated signaling received by the wireless device. Depending on the whole timing and width it is also possible to recover most if not all of the beacon information necessary to perform a complete survey and subsequently interrogate as well.

Figure 1:
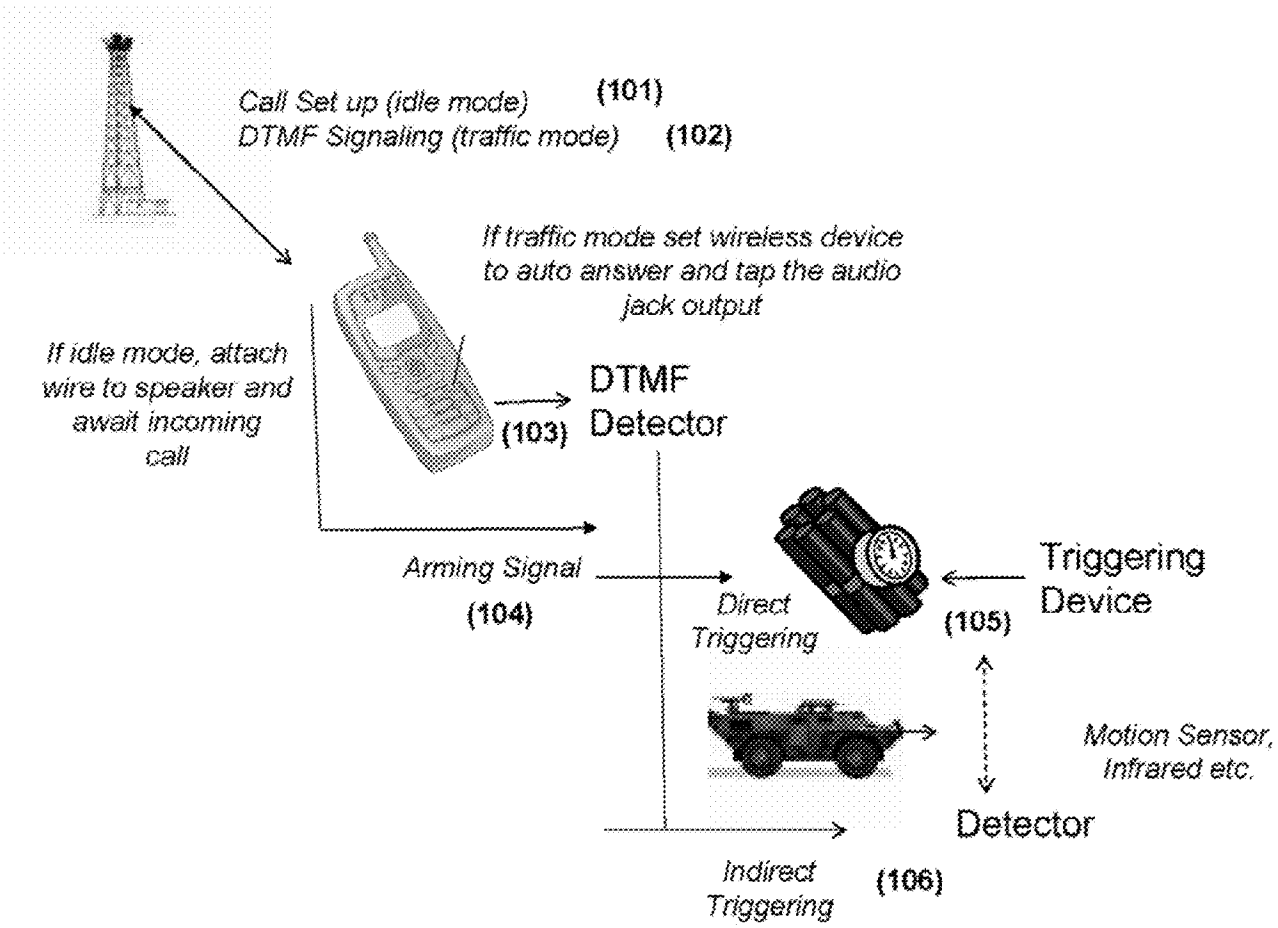
FIG. 1 provides an overview of how a wireless device may be used to trigger an explosive device.

Reference numbers in the drawing have three or more digits: the two right-hand digits are reference numbers in the drawing indicated by the remaining digits. Thus, an item with the reference number 203 first appears as item 203 in FIG. 2.

DETAILED DESCRIPTION OF THE INVENTION

The following Detailed Description contains the complete Detailed Description of PCT/US2007/063493, James D. Haverty, Methods of Suppressing GSM Wireless Device Threats in Dynamic or Wide Area Static Environments having Minimal Power Consumption and Collateral Interference, of which the present patent application is a CIP. The new material in the present Detailed Description begins with the section Detecting cellular telephone environments when interoperating with timed interferers.

Certain Definitions

Cellular—Wireless communication in any of the generally accepted bands allocated for individual subscriber based voice or data communications.

DTMF—Dual Tone Multi-frequency (touch tone). Pairs of audible tones that are used in phone signaling to represent digits pressed on a wireless device keypad.

DTX—Discontinuous Transmission—the process by which either side of the terminus in a wireless network will stop normal transmission when it detects that there is no voice activity. The purpose of DTX is to conserve power.

PCS—Personal Communications Systems (synonymous with 'cellular') for purposes of this discussion Mobile Wireless device—A mobile device used by a subscriber for voice communication.

Wireless Device—general term for any wireless device, including but not limited to a mobile phone, a portable data assistant, or pager.

Standards—The governing technical standards describing the operation of certain cellular or other wireless systems.

CDMA (CDMA 2000)—Code Division Multiplexed Access as governed by the TIA IS-95 and IS-2000 standards.

GSM—Global System for Mobile Communications—ETSI standard describing a second generation system for mobile wireless communications.

Collateral Wireless Devices—Any wireless device that is not of interest operating either inside or outside of the operational area.

Beacon—A generic term used for the signal broadcast by a cell tower that continuously provides cell tower and system level information as well as timing so as to aid a wireless device in gaining access to a wireless network.

Operational Area—A predefined area in which all wireless devices will be affected by the surgical neutralizing system.

IMSI—International Mobile Standard Identifier—A unique identifier that is either associated with a specific subscriber or a wireless device used thereby.

TMSI—Temporary Mobile Standard Identifier—A temporary identification number used for local shorthand while the wireless device is operational in a system.

UMTS—Universal Mobile Telephone System—ETSI standard describing a third generation system for mobile wireless communications.

CRC—Cyclic Redundancy Check—A collection of bits that is appended to a packet of data Which is used to detect if one or more bits in said packet was erroneously received.

Forward Channel—transmission in the direction from the beacon to the wireless device—also known as the Downlink Channel.

Reverse Channel—transmission in the direction from the wireless device to the beacon—also known as the Uplink Channel.

TCH—GSM designator for a traffic channel

SDCCH—GSM designator for a Stand-Alone Dedicated Control Channel

SACCH—GSM designator for a Slow Associated Control Channel

FACCH—GSM designator for a Fast Associated Control Channel

BCCH—GSM designator for the Broadcast Control Channel

SCH—GSM designator for the Synchronization Channel

FCCH—GSM designator for the Frequency Correction Channel

CCCH—GSM designator for Common Control Channel—umbrella designator for a collection of channels that carry either PCH or AGCH PCH—GSM designator for Paging Channel AGCH—GSM designator for Access Grant Channel Overview of the Surgical Neutralizing System The techniques for attacking, suppressing, or baiting wireless devices and apparatus for their implementation are collectively described as a surgical neutralizing system. The surgical neutralizing system employs the techniques for surgical signal generation described herein to reduce the power consumption required for suppressing wireless devices by factors of 1000 or more. The reduced power consumption makes the surgical neutralizing system usable either in ground based or air-borne vehicles and even as a portable device that can be carried by a soldier. The surgical neutralizing system is also capable of surgically limiting the attack to only those wireless devices that are deemed to be a potential threat or otherwise minimizing collateral interference in cases where the wireless device-specific surgical operation is not possible.

The surgical neutralizing system employs a receiver paired with a signal generator. The receiver obtains information in real time about beacons and wireless devices in the convoy's operational area. This information may be broadly termed environmental information. The environmental information includes the parameters of the beacons and their timing relative to a timing signal provided by the surgical neutralization system. It also includes what wireless devices are present in the operational area and the hopping sequences of the wireless devices. Finally, it includes the current position of the surgical neutralizing system when the environmental information is obtained. The receiver provides the environmental information to the signal generator, which generates jamming signals, that is, waveforms which surgically neutralize wireless devices which pose threats in the convoy's operational area. The surgical neutralizing system further saves the environmental information for future reference. When the convoy returns to a location, the saved environmental information for the location can be recovered and used to accelerate determining the current environmental information for the location.

The surgical neutralizing system is also capable of cloning a beacon by passing the beacon's parameters in the environmental information to the signal generator. The signal generator employs the parameters to clone the beacon on another frequency channel. The clone beacon is termed in the following an artificial beacon, while the beacons belonging to the service providers are often termed live beacons. In a preferred embodiment, artificial beacons are used in three ways:

As a source of timing information about the live beacons.

As a baiting beacon. A baiting beacon is an artificial beacon which is set up in such a fashion that the wireless devices in an operational area monitor the baiting beacon instead of a live beacon.

As a communications medium between different instances of the surgical neutralizing system in an operational area.

When used as a source of timing information or as a communications medium, the artificial beacon is modified so that beacons and wireless devices in the environment will not respond to it. In a preferred embodiment, this is done by setting the mobile country code or mobile network to some values that will not entice the wireless device such a 0, 0 or inverting the CRC of one of the artificial beacon's compulsory system messages.

When an artificial beacon is used for timing, the receiver listens for the artificial beacon and determines the timings of the live beacons which it is monitoring relative to the artificial beacon. It then provides the timing difference information to the signal generator for use in generating waveforms to attack wireless devices that are interoperating with or using the timing of the beacons.

When the artificial beacon is set up as a baiting beacon, all of the wireless devices in the operational area are enticed to monitor the baiting beacon and are thereby prevented from interacting with the live network, That in turn prevents the wireless devices from receiving incoming calls that act to either indirectly arm or directly trigger explosive devices. The use of artificial beacons as baiting beacons is completely independent of their use to determine the timing information for the live beacons. Like live beacons, a baiting beacon must broadcast continually. An artificial beacon that the receiver is using for timing information will not be set up to entice wireless devices; moreover, the timing information for live beacons is very stable, so the generator need transmit an artificial beacon that is being used for timing only at intervals of several minutes to permit the receiver to refresh the timing information it provides to the generator. It should be finally be pointed out that while it is convenient to use an artificial beacon to determine timing information, any signal that is regularly provided by the generator can be used for that purpose.

The receiver paired with a generator is also capable of engaging a wireless device by setting up a baiting beacon to entice the wireless device and then acting as the baiting beacon's base station. As such, the surgical neutralizing system can disable the wireless device using various techniques described herein.

Characteristics of GSM which Render it Attackable by the Surgical Neutralizing System The techniques of attacking the cellular signal are predicated on a number of characteristics of GSM. These include but are not limited to:

a) GSM uses highly-structured digital modulation that requires extremely precise timing as established by the network. Therefore any surgical attack requires that the interferer synchronize to the timing on the network of interest.

All digital standards have specific waveform vulnerabilities that can be exploited if the timing is known to a high degree of precision. This also makes it possible to limit transmission to only a small percentage of the time as well as limit the required signal bandwidth. This reduces the average required power by several orders of magnitude over conventional techniques that use nonspecific targeting of the signal. For example, even if the peak power required to interfere with a signal may be significant, it is only on for a very small fraction of the time making the power consumption averaged over time very low.

Having a high degree of synchronization to the network of interest also makes it possible to hijack a signal by overriding it with a higher signal level. It further makes it possible for the interference to hide within legitimate waveforms by crafting a waveform with the same frequency and modulation characteristics. This coupled with pseudo-random transmit times makes it extremely difficult to detect and subsequently locate and/or counter the source of the interference.

b) All communication in wireless telephony systems is necessarily full duplex. If either direction in the communication link is severed then the network will necessarily end the connection. It is therefore not necessary to attack both sides of the communications link simultaneously.

c) The GSM standard makes use of expressly reserved synchronizing sequences and parity checking (e.g., cyclic redundancy checks—CRCs) that respectively enable a receiver to unambiguously synchronize to a transmitter and to detect and discard information that is received in error. Therefore the interfering signal needs only to be sustained to the degree necessary to force either a synchronization or a parity error in the receiver. Consequently, only a small number of symbols within packctized information need be corrupted in order to have the intended effect. Furthermore parity failures and in many cases synchronization failures are insensitive as to which bits in the transmission are received in error, which makes it possible to randomize the transmission time so as to thwart either detection or subsequent location of the source of interference.

d) Duplex operation—fine timing makes it possible to both listen to and interfere with the same signal without the interference affecting (e.g., blinding) the reception.

Application of the Surgical Neutralizing System to Other Wireless Telephony Standards The general principals of identifying wireless device beacons, synchronizing to them and in turn using this timing to drive signal generators to surgically corrupt vulnerable parts of the signaling waveforms between wireless devices and associated beacons, so as to cause parity or synchronization errors, are not limited in their application to the GSM standard. Other standards including but not limited to CDMA, CDMA 2000 and/or UMTS also use protocols that have precise timing and that have vulnerabilities that can be exploited by taking advantage of the precise timing to surgically attack specific parts of the signaling waveform and thereby to corrupt messages belonging to the standard in a fashion which prevents the wireless device from performing the action that arms, triggers, or otherwise causes a hostile device to detonate or otherwise become active. Therefore, while the particular techniques described herein are specific to the GSM standards, it will immediately be understood by those skilled in the relevant technologies that the surgical neutralizing system as applied to GSM is a particular example of a general methodology that can be applied to wireless devices that operate according to any, digital wireless standard.

Idle Versus Active Wireless Devices and Triggering Methods—FIG. 1.

A wireless device will be in either an idle mode (101) or traffic mode (102). The wireless device can be used to trigger an explosive device in either mode. In idle mode, the wireless device is waiting for an incoming call. When an incoming call to the wireless device arrives in the tower, a call setup must take place, and the call set up activity can trigger the explosive device. For example, part of the call set up activity is the alert message sent from the tower to the wireless device. The alert message causes the wireless device's audible ringer to sound (105). The current needed to make the ringer sound can also be used to detonate the explosive device. Another way of using the wireless device when it is in inactive mode is to place a call to the wireless device in advance to arm some other primary triggering mechanism, for example a motion sensor, in order to thwart jamming of the wireless device when the convoy comes within close proximity to the device (106).

For a perpetrator, a potential drawback of calling a wireless to effect direct detonation is that the timing of the call is likely to be imprecise (due to the vagaries of the call setup timing, the network loading etc.) meaning, the device could easily detonate prematurely or well after the intended target is out of range. This limitation suggests that a perpetrator may attempt to operate in traffic mode (102). Here, the call has already been established in advance and the perpetrator is waiting for the right time to perhaps hit a key or otherwise send a signal to the phone. An example (103) would be to set up the wireless device in auto-answer mode and connect the headset audio output to a readily available DTMF detector. The perpetrator then keys in a series of DTMF digits (akin to a personal identification number—a.k.a. PIN) but refrains from keying in the last digit until precisely the right moment. In this case, the suppression techniques must necessarily deal with problem of frequency hopping and discontinuous transmission (DTX) employed in the GSM standard. More specifically wireless devices employ discontinuous transmission to improve battery life by only transmitting when the subscriber is talking. In the absence of speech, the device will only transmit relatively infrequently—primarily to keep the communications link open. This will be the expected case when the wireless device is connected to an explosive device. While the exact timing of these transmit bursts is precisely dictated by the network timing and therefore known by the receiver described herein, the transmit bursts will hop from frequency to frequency according to a sequence (the hopping sequence) over a potentially wide swath of spectrum. The hopping sequence is determined at call set up and will not be known to the surgical neutralizing system in advance. Methods for dealing with these conditions are described herein.

Modes of Operation

Figure 2:
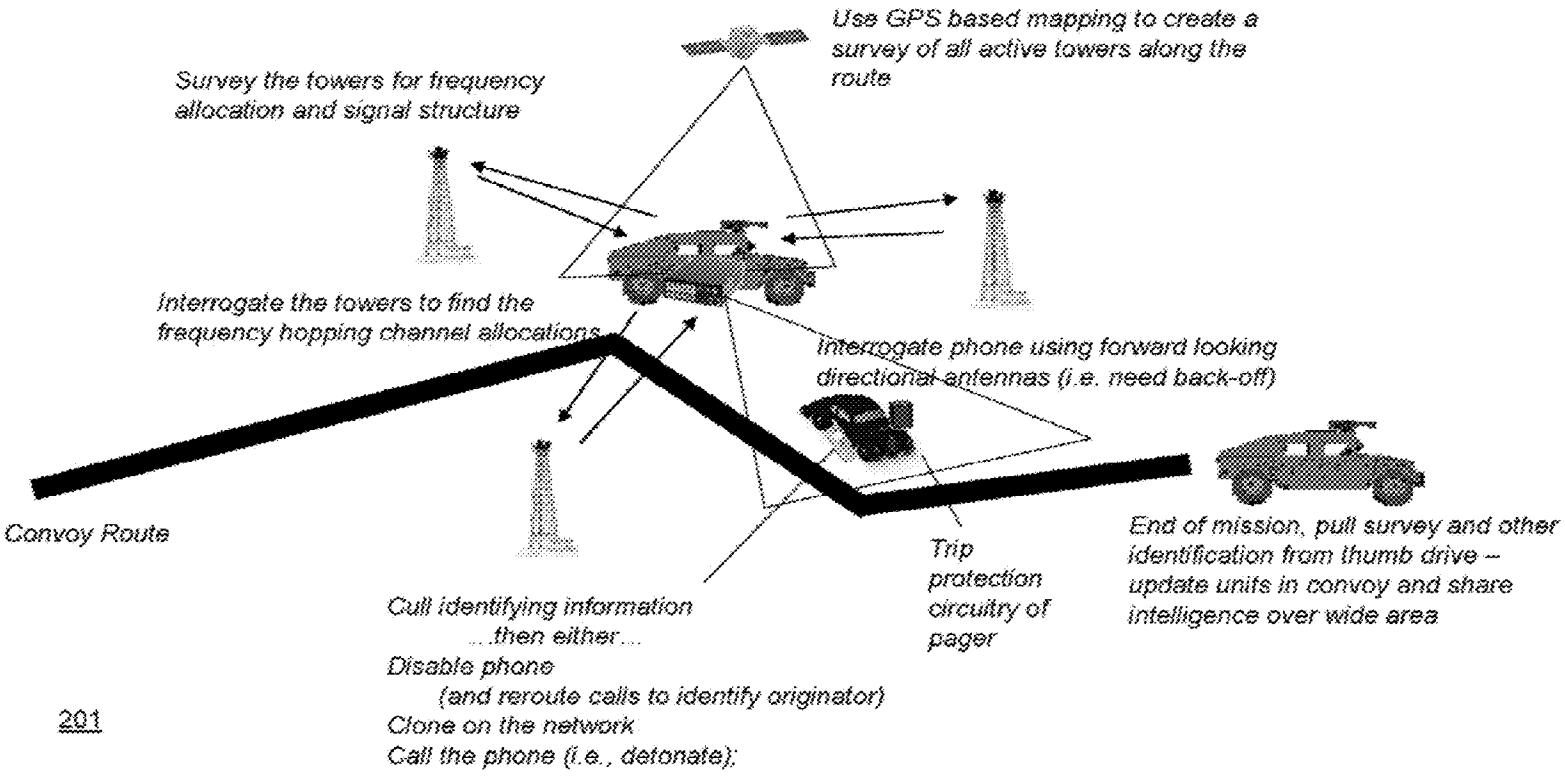
FIG. 2 shows the scout mode of operation of the surgical neutralizing system.
Figure 3:
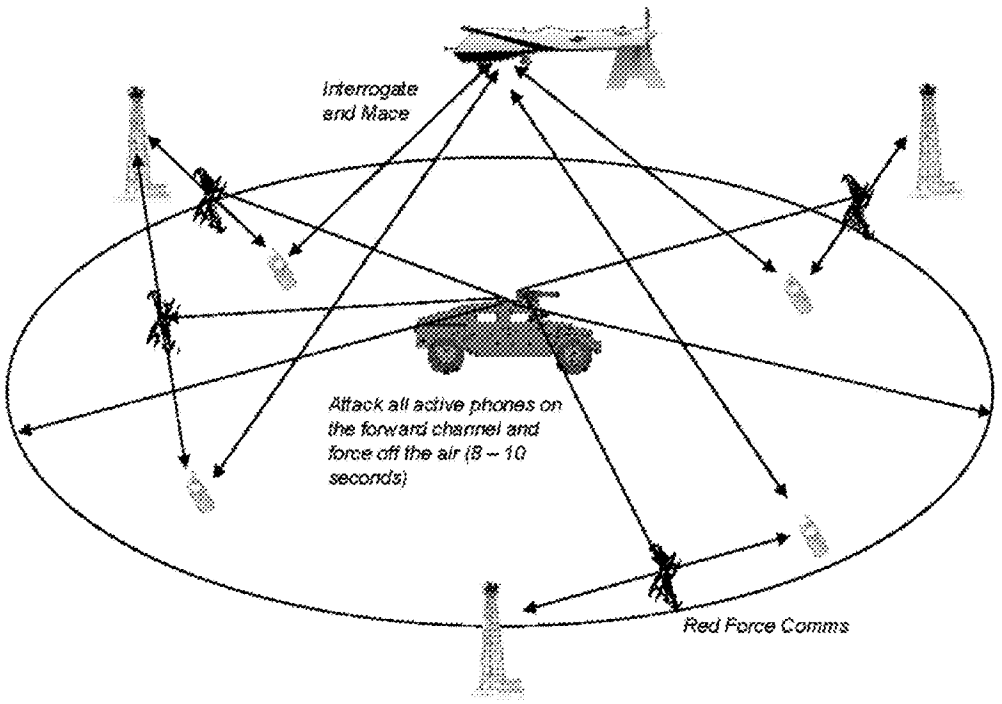
FIG. 3 shows the static mode of operation of the surgical neutralizing system.
Figure 4:
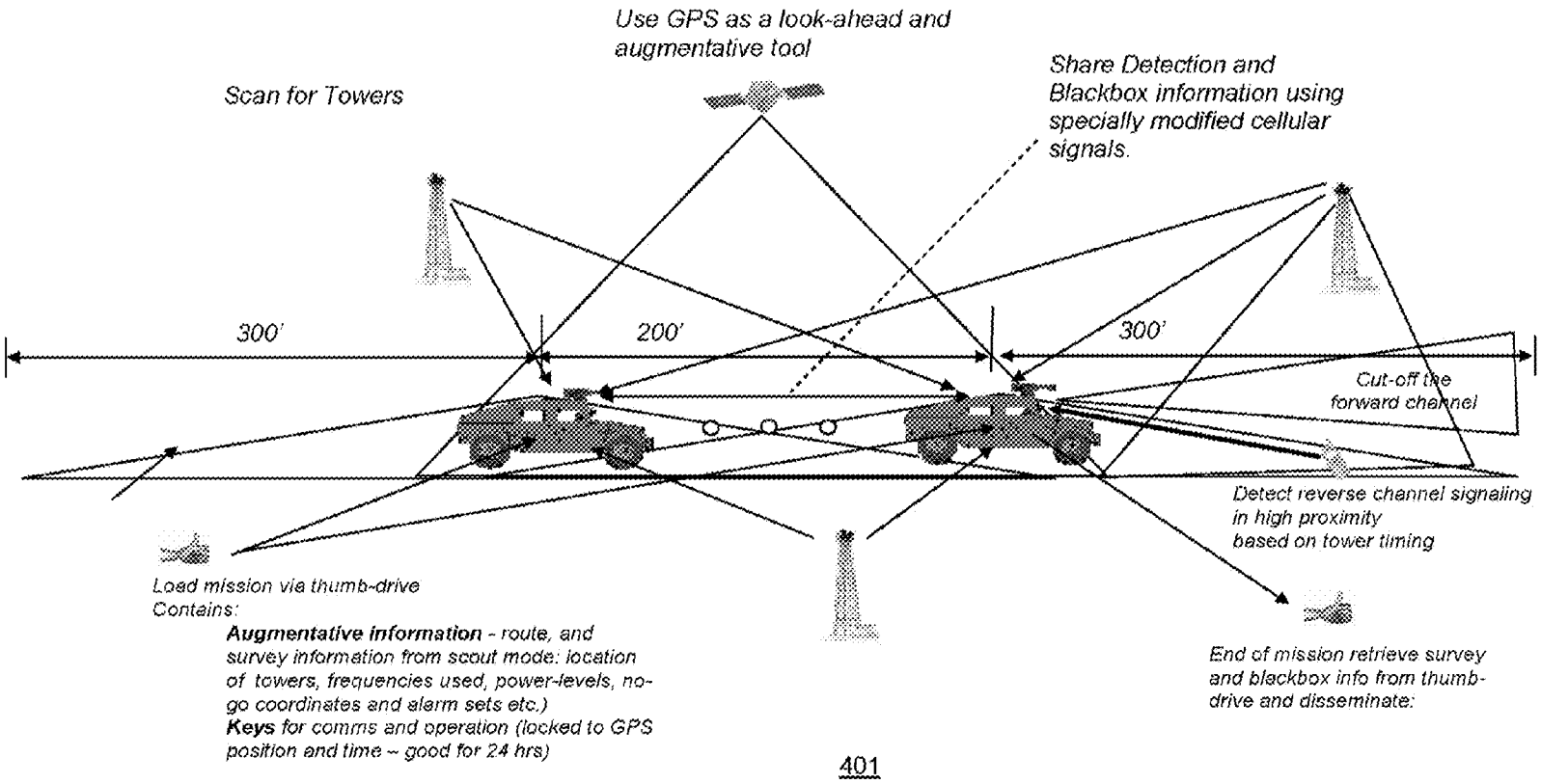
FIG. 4 shows the convoy mode of operation of the surgical neutralizing system.

The surgical neutralizing system has three modes of operation: scout, static and convoy as shown in FIGS. 2, 3 and 4 respectively. In scout mode (201), the surgical neutralizing system finds cell phones that are in idle mode and on either side of the roadway in advance of a convoy. Once a cell phone is detected, a number of techniques which are described herein can be used to neutralize or otherwise obtain intelligence from the wireless device. Scout mode (201) can also take the proactive step of monitoring any beacon in a location areas) in which a convoy will be operating in order to inventory all wireless devices that are active and then send detach messages en masse to the network for the inventoried wireless phones that indicate to the network that the wireless devices are now powering down. Because the network believes that the wireless devices are powered down, it will not forward incoming calls to the wireless devices. This technique is described under the heading of General Attack Strategies.

In static mode (301), a mission is being performed in either well defined localized area or the convoy has stopped moving for an appreciable period of time. Here the surgical neutralizing system is concerned with preventing access to the system for purposes of suppressing hostile communication. For example, the surgical neutralizing system needs only to force existing subscribers that are in traffic mode off the air (attack for several seconds) and then begin either a highly surgical attack or enter a baiting mode which keeps all wireless devices in the operational area from gaining or regaining access to the live network. Given sufficient time, the surgical neutralizing system can take the added step of interrogating and subsequently disabling any or all phones either temporarily or semi-permanently within the operational area. This not only provides added protection, but also provides a basis for estimating the number of people that are present in the operational area.

In convoy mode (401), suppression has to be provided dynamically because the convoy is on the move. Here the surgical neutralizing system is concerned with suppressing wireless devices that are in close proximity to the convoy and are actively signaling. All that is necessary in convoy mode is to suppress communications between the beacons and the wireless devices until the convoy has passed. There is no need to force the wireless telephone system to drop the call. In many cases the ability to neutralize a call without forcing it to drop is a welcome feature, as only a very tiny fraction of wireless devices will be employed as detonators. One method of suppressing communications without causing the call to drop is to refrain from attacking the slow associated control channel (SACCH) which is primarily used to manage the communications link but does not carry any signaling information that can effect triggering of some device. This method is described under the heading of Specific Attack Techniques.

Which mode of operation is required at a given moment can be determined either from GPS or from accelerometers built into the hardware. Furthermore none of the techniques or apparatus described herein is limited to a particular platform. Surgical neutralization systems may be constructed which have size, weight, and power requirements such that they may be carried in ground or air vehicles or even by individuals.

Preferred Embodiment

Figure 5:
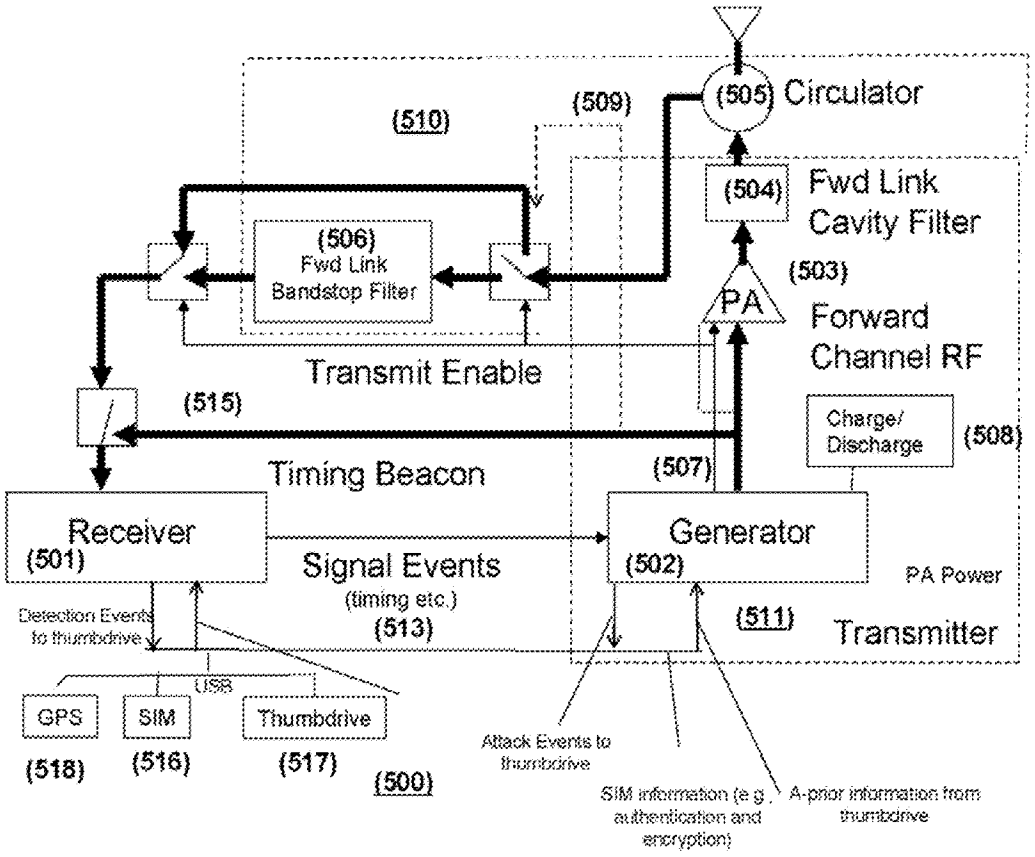
FIG. 5 is a functional block diagram of a preferred embodiment of the surgical neutralizing system.

FIG. 5 shows a preferred embodiment of surgical neutralizing system 500. It consists of a receiver 501 and a transmitter (511). Transmitter (511) includes a generator (502) and an RF assembly 510. The purpose of the receiver (501) is to a) dynamically detect GSM beacons as the convoy moves and extract relevant timing and channel assignment information and b) detect when a wireless device is actively signaling in close proximity. The purpose of generator (502) is to generate some number of signals that are expressly timed to any or all of the beacons in the local area to within less than a microsecond. This highly precise timing enables highly surgical signal attacks on the wireless devices which appear to be threats. Furthermore, generator (502) is also capable of simulating the operation of a GSM beacon or wireless device and is therefore able to bait, interrogate, and/or neutralize beacons or wireless devices. These capabilities of generator (502) find their primary use in scouting mode (201). The generator and receiver can exchange information using any number of communication paths depending on a particular implementation. This can include but is not limited to shared memory, USB, a common back plane or perhaps Ethernet.

RF assembly (510) provides the final power amplification (PA) (503) as well as combining, distribution and switching circuitry that enable the system to operate in full duplex mode. It shows a cavity filter, a circulator and a stop band filter (504, 505, 506), the combination of which vastly diminishes the transmit energy that loops back into the receiver path to prevent the receiver from being damaged while transmitting. In other embodiments, separate transmit and receive paths including separate antennas may be employed in place of the circulator coupling of the transmit and receive paths. The separate antennas may be strategically placed or otherwise designed to provide additional spatial isolation. Because very little transmitted energy loops back into the receiver path, the receiver (501) can constantly monitor the wireless device's reverse link without regard to the transmit state and to be blanked from monitoring the wireless device's forward link only when transmitter 511 is on. Not shown is additional sub-band filtering in the receiver.

An important aspect of this embodiment is that PA (503) is surgically enabled to only be active when needed (507) as controlled by generator (502). Since PAs are notoriously power inefficient (typically 35%), the ability of the surgical neutralizing system to surgically enable and disable them at will achieves a significant average power consumption reduction. The techniques described herein do not require any particular amplification level; what the amplification level provided by the PA determines is the potential operational area over which the surgical neutralizing system will have influence. Also shown in FIG. 5 is a charge/discharge circuit (508) that is used to provide large power levels for short durations. This serves the purpose of averaging the power consumption over time and thereby makes it possible to power the surgical neutralizing system from very modest sources such as a cigarette lighter in a vehicle. The specific nature of the charge/discharge is not material to the design and can use various technologies such as capacitors or gel cells depending on the anticipated level and duration of extra power draw.

The preferred methodology of synchronizing the generator to live wireless networks is to generate an artificial beacon (509) and then have receiver (501) compute the timing difference between the artificial beacon and the live beacons belonging to the wireless networks and pass this information back to generator (502) so that it can correct the timing of any subsequent attacks (513). However this embodiment also makes provision for an internal loopback (515) to prevent potential countermeasures from jamming the artificial beacon (509) and thus thwarting the operation of signal (512).

The preferred embodiment can also emulate a GSM wireless device that can make live calls to the network. The purpose is to discover the frequency hopping sets employed by a particular tower when in scouting mode. A particular difficulty in dealing with wireless devices that are already in the traffic state is that they are hopping using an unknown sequence over a potentially wide swath of spectrum. This causes a delay in the time it takes to detect their presence when they are signaling in high proximity. The potential number of hopping sequences is large (several thousand). Furthermore, a threatening wireless device is likely to be in DTX mode and consequently only rarely emitting an active burst. The combination of the large number of hopping sequences and the paucity of active bursts makes it challenging to discover the threatening wireless device's hopping sequence in a timely fashion. However it is well understood in the art that because of radio frequency planning constraints, the pool of sequences used by a tower (or sector thereof) is only a very small fraction of the total possible. Therefore, by making a test call to the tower it is possible to identify the complete set of channels over which the phone will hop and whittle the number of sequences the tower uses down to a very small set. Doing so gives the surgical neutralizing system an enormous head start in discovering which hopping sequence is being used in any subsequent attack. A specific methodology for discovering the actual hopping sequence is described under the Active Mode subheading of General Attack Strategies.

A transceiver that can easily be augmented to implement the surgical neutralizing system is the ComHouse Wireless Network Subscriber Test (NST), which may be purchased from ComHouse Wireless LP, 221 Chelmsford St., Chelmsford, Mass. 01824. The unit is a software defined radio capable of testing both wireless devices and base stations using the GSM and CDMA standards. NST can interrogate wireless devices by acting as a beacon and can scan cellular environments so as to identify and analyze beacons, and can generate multiple simultaneous signals which can be used as interference signals. The interference signals may be customized to surgically attack or manipulate cellular signals with sub-microsecond precision. The unit can also make and receive outgoing and incoming phone calls. The NST provides the receiver and generator subsystems (501) and (502), with the remaining circuitry shown in FIG. 5 being added to perform the functions of boosting the generated signal to levels necessary to neutralize live signals, the receiver protection circuitry being designed to keep the transmitter from damaging the receiver and the artificial beacon loopback circuitry being used to provide generator timing to the receiver.

Full Duplex Principal and Look Through/Jam Through

In convoy mode (401), only wireless devices that are in close proximity to the convoy pose a threat. Thus, in convoy mode, surgical neutralizing system (500) works by having receivers listen on the reverse link for close proximity signaling and when such signaling is discovered, having the transmitters surgically attack the paired forward link. This capability of listening and then jamming known in the art as a look through/jam through capability. This capability is advantageous for the reasons enumerated below:

- Minimization of Receiver Complexity—The receiver complexity is dramatically reduced as it is only necessary to perform energy detection on the reverse link channels (as opposed to for example demodulation that might be required if attempting to detect specific signaling in other possible modes of operation). This is a direct consequence of acquiring, in advance, the timing of the signal from the forward link.
- Minimization of False Alarms, Collateral Interference and Power Consumption—Only high proximity wireless devices cause a response from the surgical neutralizing system. This diminishes the false alarm rate and subsequently attacks by the surgical neutralizing system on the high proximity devices are limited in scope and duration, which in turn reduces power consumption and collateral damage.
- Continuous Full duplex operation—This enables the surgical neutralizing system to continuously listen on the reverse link without being blinded by the forward link attack or to otherwise have to schedule access to the reverse link signal. This makes it possible to immediately detect a close proximity wireless device and eliminates the control complexities associated with scheduling. It also makes it possible to unambiguously determine when to end an attack based on whether the signaling from the wireless device under attack drops below some threshold or ends altogether.
- Forward channel attack—Attacking a wireless device's forward channel attack is superior to attacking its reverse channel for the following reasons
  - Detonation signaling comes down on the forward link.
  - Minimization of collateral interference—this is achieved by controlling the transmitted power. A reverse channel attack is likely to affect all subscribers, regardless of how the power levels are controlled. The reverse channel attack will also alert the network to the presence of the interference.

Any attack on the reverse channel is likely to precipitate a handover to another beacon via the presumably still viable forward channel. An attack on the forward channel cuts off this avenue.

The geometry is not always favorable for an attack on the reverse channel because it may be the case that a tower can "see" the wireless device and not the attack signal (e.g., due to sectoring) or possibly fading.

It can take IS seconds or more for either side of the link to drop a call when the link is attacked. Attacking only the reverse channel will leave the forward link viable and still capable of effecting detonation for this period of time.

Beacon Timing, Surgical Attacks, and Scheduling

The surgical neutralizing system mounts surgical attacks on close-proximity wireless devices by recovering the timing of any and all beacons with which the wireless device could conceivably be communicating. The receiver continuously scans the forward link spectrum (in parallel to any reverse channel energy detection) searching for beacons.

When a beacon is detected it recovers the relative timing to within a microsecond. This timing must in turn be provided to the generator. The technique used to do this in the preferred embodiment (509, 510, 511) is to use an artificial beacon that gets looped back (509) from the generator to the receiver. The receiver then reports the timing of any legitimate beacon relative to this artificial beacon to the generator so that the generator can correct the timing of the artificial beacon. The loopback can either be internal to the unit using RF switching or be done directly over the air. This technique dramatically simplifies the problem of generator timing because it eliminates the need to expressly synchronize the generator and receiver (including accounting for any subsystem timing vagaries and/or calibration) and furthermore establishes the timing as it is seen "in the air" as opposed to the time established post receiver signal detection (which invariably has some number of delays that may be difficult to characterize and therefore calibrate). It also completely decouples the receiver and generator so that changes in design or manufacture of one do not affect the other. The surgical neutralizer makes provisions for one or more USB interfaces to accommodate a subscriber identity module (SIM) (516) and/or a mass storage device such as "thumbdrive" (517) and or a global positioning system (GPS) (518). The purpose of SIM (516) is to enable the neutralizing system to make legitimate phone calls to the network, most notably to discover the hopping sequence number (HSN) employed by a beacon (i.e., broadcasting on some sector of some tower), the purpose of thumbdrive (517) is to record information detected in the environment such as which beacons where detected at what position, what was attacked and when, such that it can be used for post mission analysis or used as a-priori information on a subsequent mission (e.g., taking the thumbdrive out of one system and inserting it in another), and the purpose of GPS (518) is to provide the current position of the surgical neutralizing system to receiver 501 to be included in the environmental information.

Figure 6:
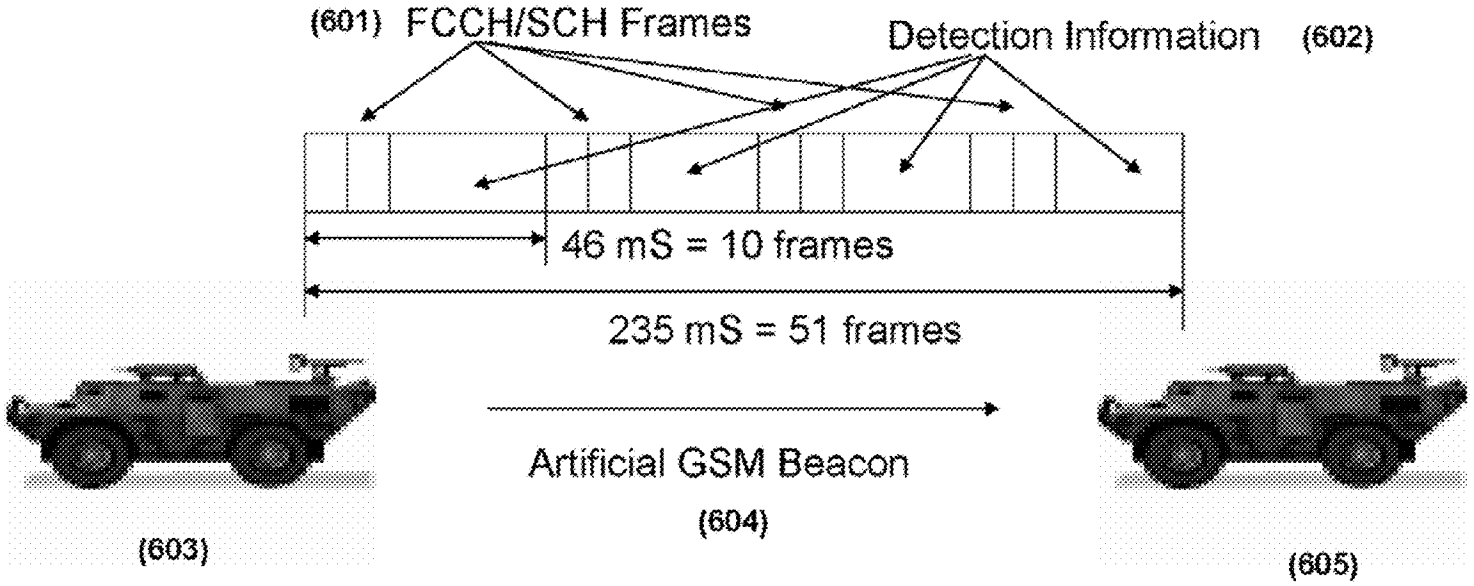
FIG. 6 shows how the artificial beacon produced by the surgical neutralizing system can be used to communicate information among instances of the surgical neutralizing system.

The surgical neutralizing system further uses the artificial beacon to communicate between several surgical neutralizing systems in a convoy. This is shown at (600) in FIG. 6. Here, artificial beacon (604) is used to propagate information between a vehicle (605) at the head of the convoy and a vehicle (603) at the rear. The information may include information concerning the detection of wireless devices of interest between vehicles. This is useful when one of the vehicles is either significantly delayed in detection of an active wireless device or even blinded by the metal in the convoy vehicles. Artificial beacon (604) can carry this extra information because the only information actually required by the receiver to achieve timing is the FCCH/SCH channel pairs (601). These occur approximately every 46 mS in the 235 mS, 51 multi-frame and last for approximately 10 mS. This leaves a significant amount of unused time in the 51 multi-frame that can be used to convey information between systems (602). The worst case latency for communicating information via artificial beacon (604) between vehicles is 50 mS, which is well within the anticipated reaction time of the surgical neutralizing system.

All that is required to make artificial beacon (604) into a communication channel is to create a new message that always follows the FCCH/SCH pair in the BCCH and identifies beacon (604) as being artificial. The remaining frames of artificial beacon (604) can be utilized to convey communications in a broadcast fashion to other units of the convoy that can receive an artificial beacon (604).

Other techniques may be employed as well for communication between surgical neutralizing systems. Another possibility is to use GSM forward traffic channels employing frequency hopping that is synchronized to GPS. This can serve several purposes, such as hiding within the cellular system so as to thwart detection and/or potential countermeasures that might be employed to attack the modified artificial beacon.

The ability to establish live beacon timing to within a microsecond makes it possible for the surgical neutralizing system to surgically attack vulnerable points in the GSM waveform using methods described herein. The nature of the attacks are described under the heading Specific Attack Techniques. One problem with this strategy is that the receiver and transmitter can collide with respect to gaining access to the forward link. To prevent damage to the receiver circuitry, the receiver signal path for the forward link (which is searching for and or characterizing beacons) must be shut off when the transmitter is active. The surgical neutralizing system deals with this as shown in FIG. 5 (506, 507) where the purpose of the RF switch filter path is to insulate the receiver while the transmitter is active. Switch signal (507) is controlled by the generator and is also used to gate fast-on amplifier (503).

Because the generator is now synchronized to the live beacons, the generator can independently determine when the receiver will scan a beacon and suppress transmission of the artificial beacon and/or attack wave forms for that period. Consequently, the receiver is never starved for information. This is described in detail under the heading Detection Mode. Because the generator can independently determine when the receiver will scan a beacon, the receiver and generator need not expressly coordinate their scheduling. This in turn dramatically simplifies control and further fosters treating the receiver and generator as abstractions.

General Attack Strategies

As described previously the surgical neutralizing system must consider both idle case (101) where the mere act of establishing a call sets off the device and the traffic mode case (102) where the call has already been established and is waiting for some triggering information transmitted on the traffic channel (TCH) or the fast associated control channel (FACCH). The following is a brief description of each case.

Idle Mode 101

In the idle mode, the wireless device is registered (location updated) with the network and monitoring a paging channel of some serving cell (presumably on the closest tower—but not necessarily) awaiting pages from the network. GSM employs the notion of "location areas" where pages intended for some wireless device are simultaneously distributed to all of the towers in the same location area. The premise is that it frees the wireless device from being tethered to some specific tower as it moves. Instead the wireless device can unilaterally choose to monitor any tower that is in the same location area so as to improve roaming fluidity. It is only when the wireless device moves to another location area (as evidenced by the fact that it can detect a more prominent tower in a new location area) that it performs what is termed a "location update" and reregisters with the network on this beacon (tower) presumably in the new location area. An important implication of the fact that a wireless device may choose to monitor any tower in a location area is that it may be necessary in some modes of operation to suppress not just the strongest beacon in an operational area, but all beacons in the operational area.

Figure 7A:
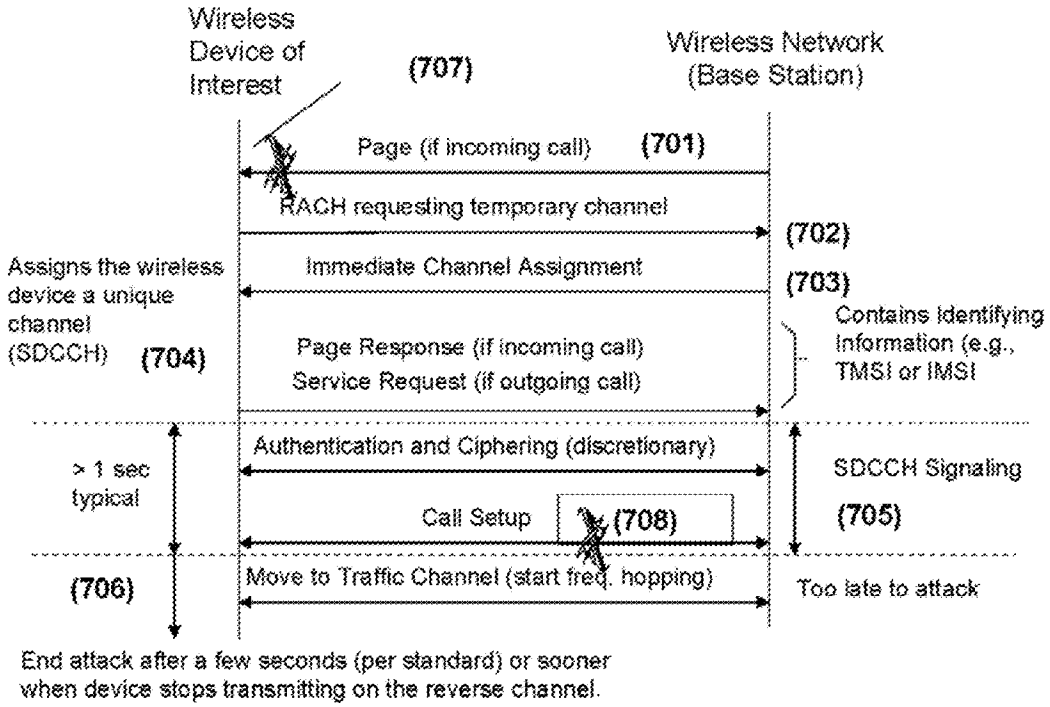
FIG. 7*a* shows the GSM call set up signaling process.

The GSM call setup signaling process is illustrated at (700) in FIG. 7*a*. When a wireless device detects a page (701) from a beacon that the wireless device is monitoring, the wireless device will send a very short burst back on the Random Access Channel (RACH) to the tower requesting a temporary channel (702) There is no identifying information for the wireless device in the RACH burst). The tower reserves a timeslot, channel, and perhaps a set of channels for frequency hopping for the temporary channel and then responds on either the paging or access grant channels (which one is immaterial in this context) with information indicating the reserved channel, timeslot and so on (703). The reserved channel is the stand-alone dedicated control channel (SDCCH) (704). The wireless device and the tower then communicate back and forth on this SDCCH (705) to among other things establish the identity of the wireless device and set up a traffic channel for the incoming call that caused the page. The communication between the tower and the wireless device on SDCCH (704) is encrypted early on, but as will be explained in detail below, the fact that the communications on the channel are encrypted does not prevent the surgical neutralizing system from attacking them. Once the call setup control signaling is complete, the tower directs the wireless device to a traffic channel (706) to start voice conversation and issues the aforementioned "alert" message alerting the wireless device that there is an incoming call. This message causes the wireless device to ring and can thus be used to arm or detonate an explosive device that is attached to the wireless device. As can be seen from the foregoing, if an attack on the forward SDDCH link can cause call setup to fail before the wireless device receives the "alert" message, a call to the wireless device will be unable to arm or detonate an explosive device (708).

The surgical neutralizing system uses two strategies to handle the idle mode (i.e., call setup) case: proactive or reactive, with the understanding that nothing precludes combining both strategies. In the proactive case, as soon as a tower is detected, the surgical neutralizing system moves to suppress the paging channels/access grant channels and camp on those channels until the tower is no longer detectable in the operational area (707). Another strategy is to offer a baiting beacon that entices all of the wireless devices to monitor it rather than the live network beacons. In either case, any possibility of consummating an incoming call is cut off. In the reactive mode, the surgical neutralizing system instead camps on the reverse SDCCH channels and looks for close proximity activity by a wireless device. When such activity is detected, the surgical neutralizing system attacks the paired forward SDCCH channel before the alert message can get through (708) to the wireless device. The following compares the two strategies.

Proactive Idle Mode Pros and Cons

The proactive solution does not require fast reaction times. It also removes the need to allocate receiver resources to continually monitor the reverse SDCCH channels. Furthermore, it addresses a theoretical concern that a mere page could set off the explosive device. However, because the wireless device may monitor any beacon belonging to the location area in which the wireless device is located, all paging channels for all of the beacons in the operational area must be suppressed simultaneously. This may require significant signal generation resources and corresponding high power requirements and high costs for the surgical neutralizing system. The need to suppress all paging channels simultaneously also presents significant resource scheduling challenges in areas with a high concentration of viable beacons.

Figure 7B:
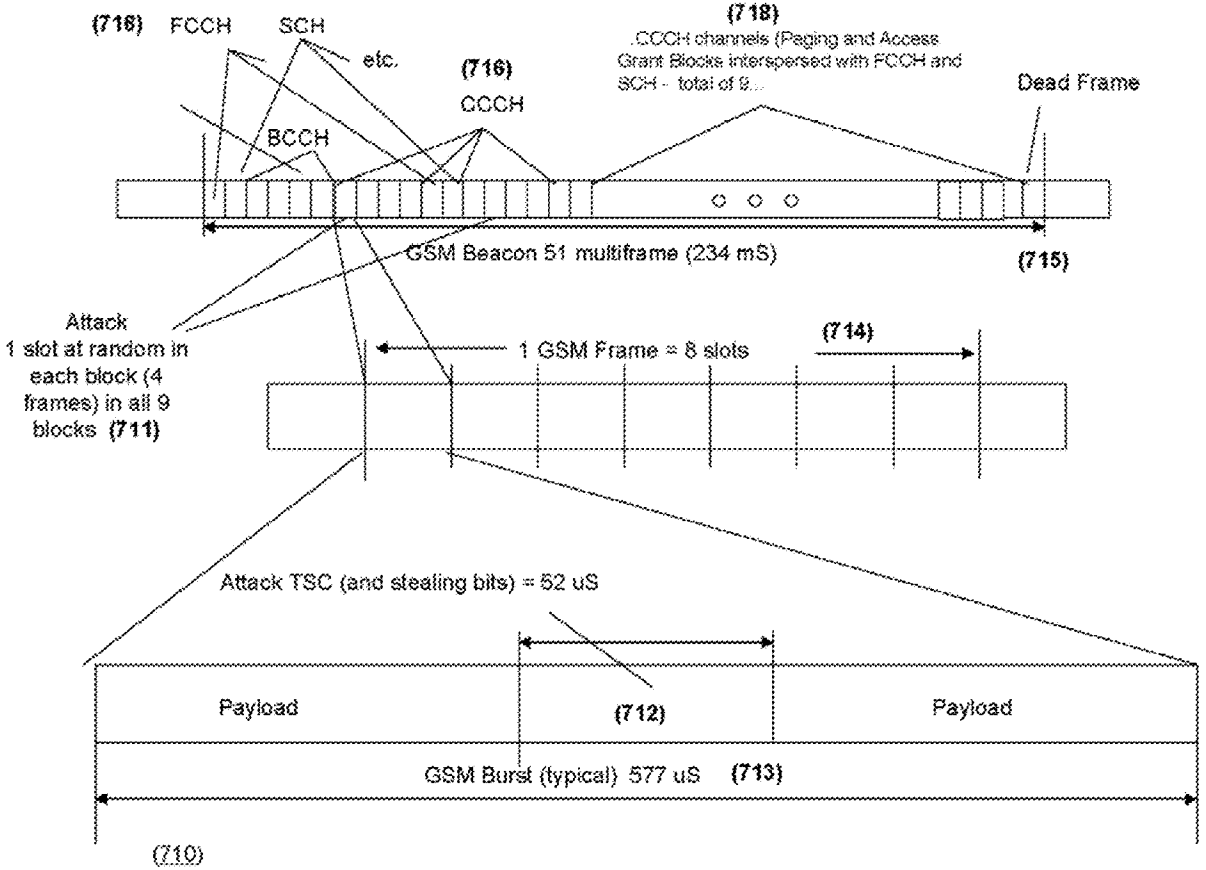
FIG. 7*b* shows the structure of a GSM 51 multiframe, a GSM frame, and a GSM slot.

FIG. 7*b* shows the signaling structure (710) employed by a GSM beacon and the paging channels contained in the signaling structure. The paging channels are surgically attacked using methods described under the heading of Specific Attack Techniques. One out of every 4 frames in a paging or access channel block in the 51 multi-frame is attacked at random) so as to provoke a CRC error and hence force the wireless device to ignore the message (711). The attack need only be only sustained in 9 frames of the 51 multi-frame and lasts only 50 uS per frame for a total of 9*50 uS=450 uS out of a total 51 multi-frame cycles of 235 mS which equates to a 0.2% duty cycle or a 500-fold reduction in average power consumption over a sustained non-surgical attack (712). Some beacon configurations might require a higher duty cycle (possibly by as much as a factor of 4), but even in this case, the power savings over a non-surgical attack are dramatic.

Another possibility is setting up one or more artificial beacons as baiting beacons. The baiting beacons can be set up so that all of the wireless devices in the operational area are forced to monitor the baiting beacons instead of the live beacons. To ensure that all wireless devices are baited, there must be a baiting beacon for each combination of location area and service provider that is detected in the operational area. The technique can be refined by having one baiting beacon reference another baiting beacon as a neighbor and enticing all wireless devices to a single baiting beacon. The other baiting beacons can then be shut down to conserve power.

The mode that should be used in a given situation is the one that requires the minimum amount of power and/or generation resources. This will in turn be governed by the number of active beacons and their relative power as seen in the operational area. For example, it may be the case that there is a single prominent beacon that all of the wireless devices are monitoring. In that case, the best strategy may be a direct attack on that beacon. Conversely if there are a number of beacons of more or less equal signal strength, setting up a single baiting beacon may prove to be more power efficient than attacking all of the live beacons. Further still, because it may take some time to set up baiting beacons and entice all the wireless devices (10 s of seconds or more), the direct attack strategy is the preferred method when the convoy is on the move, while the baiting beacon technique is likely to be of more use when operating in a static mode.

Reactive Idle Mode Pros and Cons

The reactive idle mode promises significant power savings because it is surgical and only reacts when a wireless device is signaling on the SDCCH. Such signaling should be very infrequent given a relatively small operational area. It consequently requires far less generation hardware resources than an attack in active mode. This becomes an important consideration when active mode suppression (described under a subsequent heading) is addressed. The reactive idle mode also addresses the case where the surgical neutralizing system is not able to hear the tower on which the wireless device is listening but can see the reverse channel activity. Lastly, it minimizes the potential for scheduling conflicts because the forward channel attack is brief and hence the receiver is always able to do beacon detection.

The minuses include:

The SDCCH channels are not predefined in the beacon, so they must be detected on the fly by detecting the immediate channel assignment messages on the paging channels.

The techniques cannot address the theoretical page message detonation scenario.

the techniques increases the receiver software complexity required for dynamic detection (although not greatly if dynamic detection is treated as an extension to the active mode detection problem).

The technique requires that the surgical neutralization system be able to react rapidly to signaling on the SDCCH channels (typically within less than ½ second).

The reactive idle mode requires that the surgical neutralizing system have knowledge of the structure of the SDCCH channels. As mentioned previously this requires that the receiver camp on the paging channels of the beacon until at least one immediate channel assignment is detected. This does not present a problem because any high proximity wireless device must receive an immediate channel assignment before it can begin signaling on the SDCCH. This means that the surgical neutralizing system necessarily acquires information about the SDCCH before the tower and the wireless device can use the SDCCH to set up the call and the wireless device can receive the alert message.

Figure 7C:
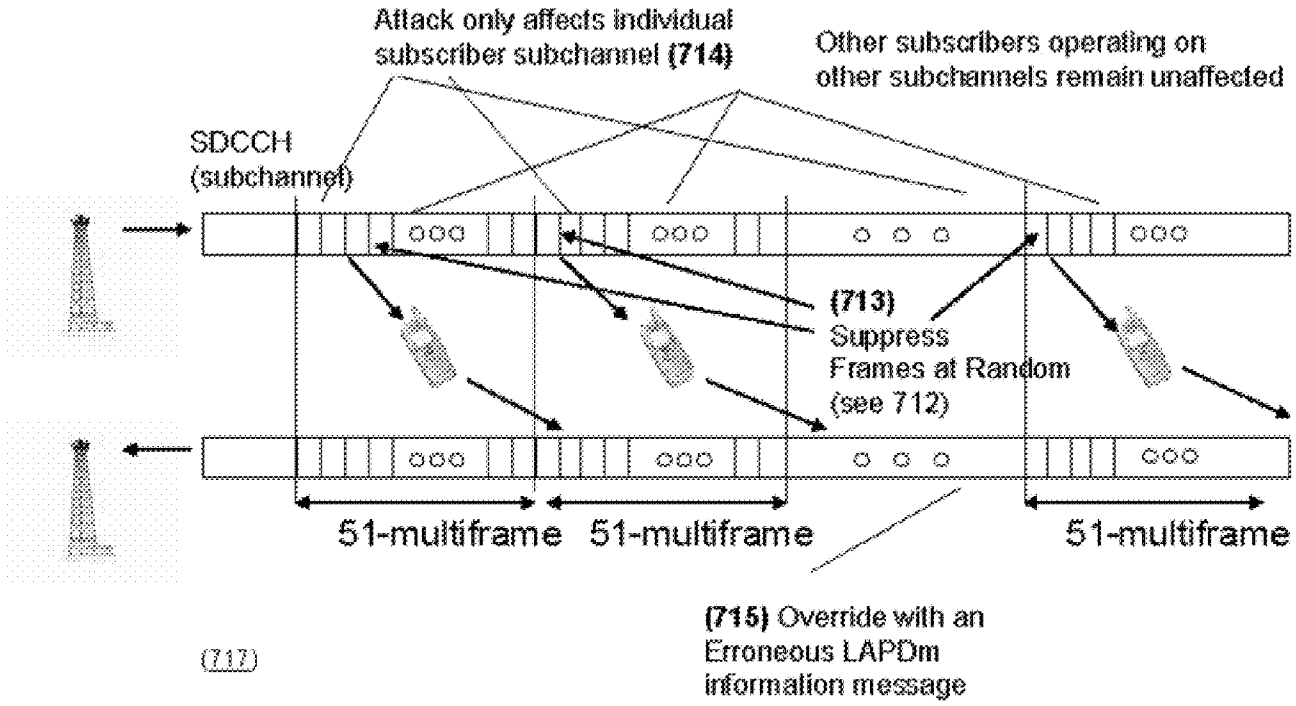
FIG. 7*c* shows how the frames of an SDCCH subchannel for a specific wireless device may be attacked.

Once the SDCCH information is extracted for a particular beacon, the channel(s) and time slots on which the SDCCH are operating are added to a reverse link monitoring list maintained by the surgical neutralizing system. The instant any signaling is detected on this channel and time slot, the receiver immediately alerts the generator, which goes to work by attacking one out of every 4 frames (as described for proactive idle mode) on the SDCCH subchannel specified by the receiver as shown at (717) in FIG. 7*c* (713). A particular subchannel of the SDDCH is only allocated a single block of 4 frames in the 51 multi-frame. This means for example that the surgical neutralizing system needs only to corrupt 50 uS (e.g., one TSC in one frame) out of the total of 235 mS in the 51 multi-frame. This translates into almost a 5000 fold reduction in power consumption over the equivalent wideband non-surgical sustained attack. The attack is also surgical from a collateral interference perspective because it is only the wireless device detected in high proximity that is attacked. This follows from the fact that all SDCCHs are reserved for specific wireless devices and therefore attacking on a specific SDCCH only affects the wireless device for which the SDCCH is reserved (714).

The SDCCH attack on the forward channel ends when the signaling is no longer detected in the paired reverse SDCCH. One difficulty is that this attack may require generation over a period of some number of seconds before the SDCCH link is dropped by either side or the convoy is out of range. Another approach is to use the waveform override technique described under the heading of Specific Attack Techniques to end the call immediately by generating a supervisory acknowledge message (that is part of the LAPDm protocol that is used on the SDCCH) with numbering that is out of phase from the current expected number (715). The wireless device presumes from the fact that the numbering is out of phase that the beacon and the wireless device are hopelessly out of phase and responds by immediately dropping the link. The surgical neutralizing system may further refine the attack by having the receiver perform spot processing to recover the training sequence of the wireless device under attack and supply this information to the generator so that it can employ several other attack methods such as TSC flipping, described under the heading of Specific Attack Techniques. The use of the TSC may also prove useful for tying together frequency hopping channels for a single subscriber when multiple attacks are under way. These and other methods are described under the heading of Detection Mode.

In the unusual case of the SDCCH employing a frequency hopping channel set, the signal is attacked as is described for active mode below.

Active Mode

Active mode describes the case where the wireless device is already actively signaling while a convoy is driving by or is being used for hostile communication While the convoy is stopped (static operational mode). In either case, it is already too late to attack the control channel signaling required to set up the call, so a direct attack on the forward hopping (traffic) channels is called for. Here the surgical neutralizing system must rely on detecting energy being emitted by the wireless device on the reverse link traffic channel and immediately follow the detection of that energy by an attack on the paired forward channel.

Figure 8:
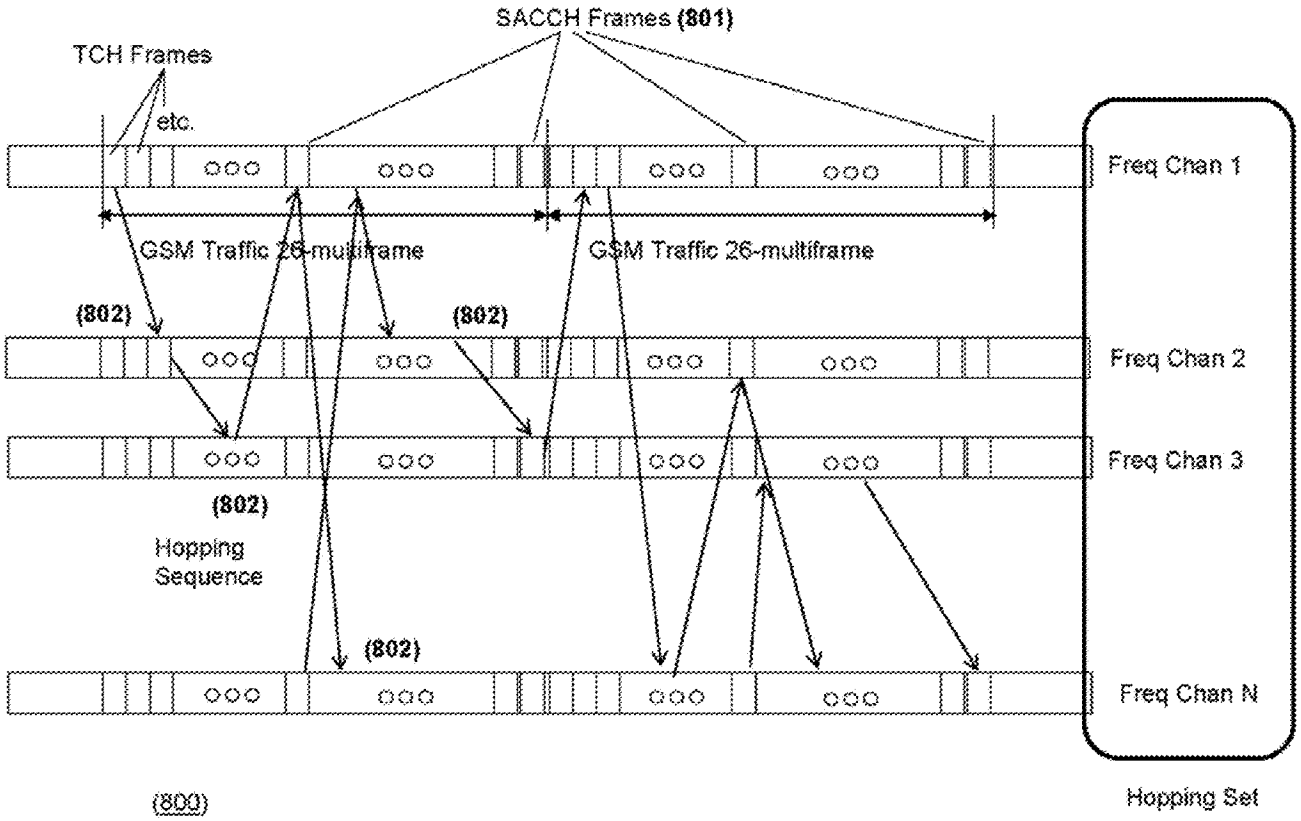
FIG. 8 shows a hopping set, a hopping sequence, and the SACCH frames in the hopping sequence.

The difficulty with attacking the traffic channel is that the traffic channel hops across some fixed set of channels in a pseudo-random fashion. The hopping sequence for a traffic channel is established during call set up and the information that defines the hopping sequence is encrypted. Further, a wireless device that is intended to detonate an explosive device is most likely operating in the discontinuous transmission (DTX) mode and is therefore only transmitting on a relatively small number of frames per second. The process is shown at 800 in FIG. 8. In this case only the traffic channel's SACCH frames have guaranteed occurrence and timing (801). Also interspersed on the traffic channel (802) will be sporadic silence indicator frames (SID) on the traffic channels (TCH) (802). While the periodicity of these is well established, their occurrence (or equivalently phase in the 26 multiframe) is not. The problem here is determining the traffic channel's hopping sequence in time to surgically disrupt the traffic channel before a message on the traffic channel causes the explosive device to detonate.

In the general case where there is no a priori information regarding the hopping sets or sequences therein (other than the timing derived from the associated beacon), the receiver resorts to forming a histogram that notes on which channel the hopping has been detected. The receiver refines this histogram technique by noting specifically on which time slot the hopping is occurring as well as spot checking the TSC through simple correlative techniques. This allows the receiver to distinguish multiple wireless devices. The transmitter can then attack each device individually.

Upon the first detection, the receiver begins to periodically report the current histogram to the generator. Since the frequency hopping sequence is such that it visits a channel with a uniform probability distribution, the histogram will rapidly begin to develop a picture of which channels are being employed. An example of the specific methodology is presented under the heading of Example Implementation. The technique may be further refined by using the surgical neutralization system to place a call to the beacon and obtain information from the beacon about the beacon's hopping set and hopping sequences.

Figure 9:
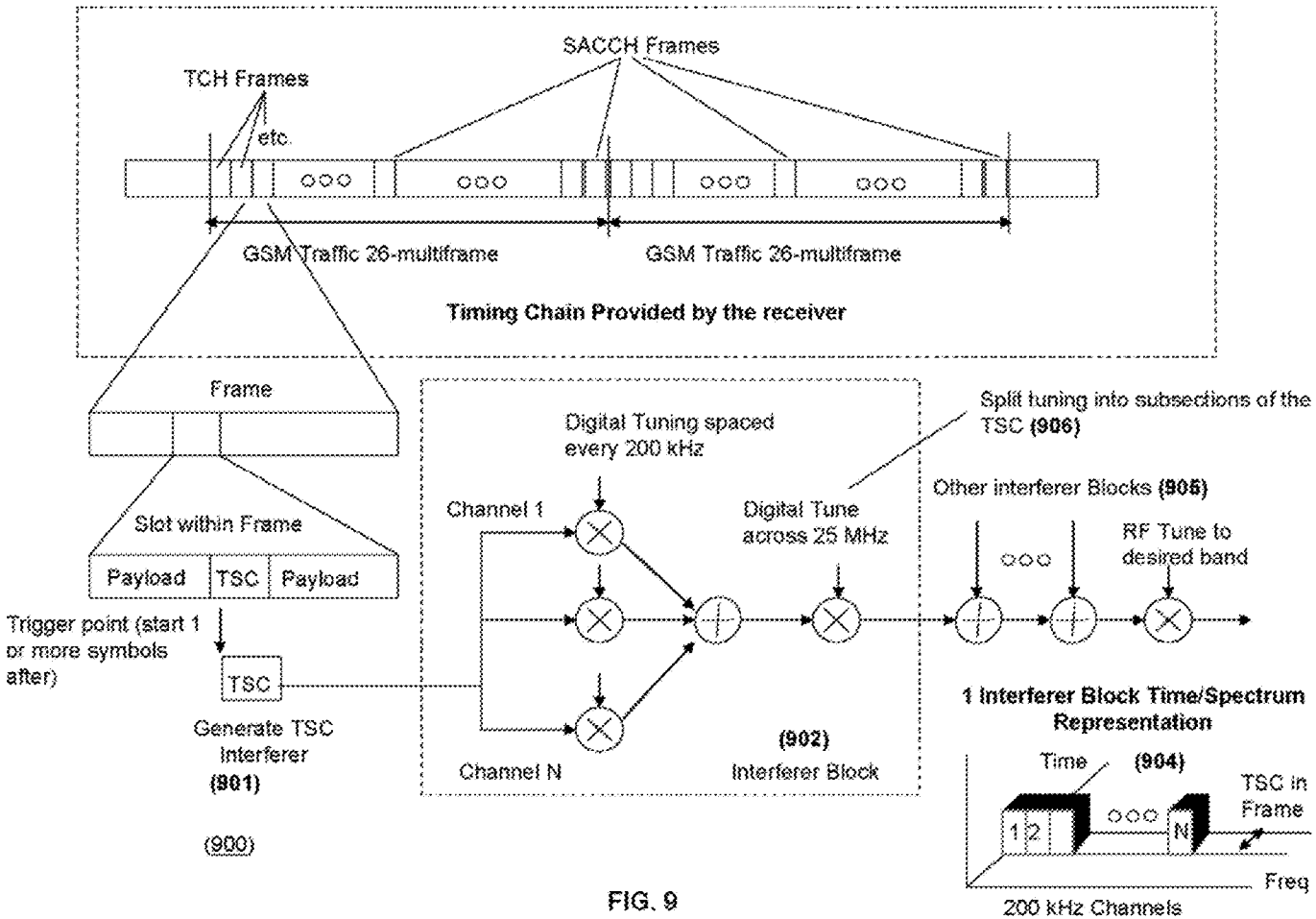
FIG. 9 shows a wideband TSC attack.

One method of attack, shown at (900) in FIG. 9 uses a wideband signal such as a multi-channel interfering waveform to hop at random across the channels identified in the histogram. The purpose is to take out as many channels as possible on any given hop and in the aggregate suppress enough frames to either defeat the vocoder such that the link is rendered unintelligible or force a CRC error in any fast associated control channel (FACCH) messages embedded in the traffic channel's signaling or both. In this example the generator creates a waveform snippet (of any type described under the heading of Specific Attack Techniques.) (901) having a maximum of a 200 kHz bandwidth that is synchronized to and interferes with the TSC in the slot of interest on a frame by frame basis. This waveform is then distributed to N tuners (902) where the tuners are spaced 200 kHz apart thus the waveform is spread across N channels simultaneously. The collection of N channels is termed an interferer block. The interferer block has the time-spectrum representation shown in (904).

This interferer block is either swept or hopped at random across parts of the spectrum where the histogram shows there to be hopping occurring. The attack is not limited to a single interferer block, as other blocks can also be added as shown in (905). The purpose of adding interferer blocks is to bring enough resources to bear that a sufficient percentage of frames are corrupted to render the link unintelligible. Possible refinements to this technique are t to attack only a fraction (e.g., ½) of the entire TSC and then time duplex the interferer block to cover additional spectrum (e.g., cover twice the spectrum simultaneously) or to use the convolutional coding attacks described below to attack different parts of the payload of the burst (apart from just the TSC) and thereby increase further still the amount of spectrum a single interferer can cover by hopping the interfering block more times in every frame (905).

For example a FACCH is at least 8 frames long and consequently makes at least 8 hops. If at least ⅓ of the channels in the wireless device's hopping sequence are being interfered with by the generator's interferers, then the interferers have an effective bandwidth that is ⅓ the effective bandwidth of the wireless device. There is thus a ⅓ probability on any given hop 1 in the hopping sequence that the hop will be interfered with by an interferer. In that case, the probability that none of the frames of the FACCH are interfered with is $$(1-\tfrac{1}{3})^8=0.039 \text{ or less than } 4\%$$

At ½ collision probability, the number drops to about 0.3%.

In the case of vocoded traffic, the primary threat is DTMF getting through to the phone. DTMF requires an "on" period of at least 40 mS for detection. This translates into two vocoder frames (each 20 mS). The vocoded frames themselves consist of 4 GSM frames and therefore a total of 8 GSM frames in a row need to be received unmolested for DTMF to get through to the phone—giving it the same attack statistics as those for FACCH suppression calculated above.

In general, the efficacy of this technique is directly related to the bandwidth of the attacking signal as a fraction of the effective bandwidth of the hopper—where the effective bandwidth is equal to the bandwidth of the channel multiplied by the number of hopping channels (as opposed to the total span between the lowest and highest frequency channels). The surgical neutralizing system can dynamically modify both the channels the interferers are applied to and the number of interferer blocks. For example, the surgical neutralizing system can use multiple interferer blocks to increase the effective bandwidth coverage until the hopping sequence for a given wireless device begins to emerge from the histogram. As the hopping sequence emerges, the number of interfering blocks and possibly their bandwidths (i.e., N) may be diminished until the wireless device's hopping sequence is completely determined. At that point, a single GSM (200 kHz) interferer that is hopping in rhythm with the signal under attack is all that is required to suppress the wireless device.

The advantages of reduced bandwidth hopping are threefold. First significant power savings are achieved by limiting the bandwidth to be a fraction of the effective bandwidth of the signal under attack. Citing the example above, the surgical neutralizing system achieves power savings as the inverse of the fraction of the effective bandwidth that is covered on any given hop. For instance a ⅓ mask affords 3 times the power savings. Second, while the surgical neutralizing system could achieve the same effect by parking the interfering signal on some subset of channels and let the hopping of the wireless device work on behalf of the surgical neutralizing system, introducing hopping combats fading as seen at the wireless device. This translates into additional significant power savings (perhaps a factor of 10 or more), because it eliminates the need to consider the additional power that would be required to overcome the fade and still cause interference. Third, the histogram and subsequent hopping sequence detection algorithms will eventually converge to a solution (typically within a few seconds) in which the energy can now be limited to that required for a single interferer. By limiting the attack to the TSC (as described under the heading of Specific Attack Techniques) the duty cycle is reduced to ⅛ (a single slot)*1/10 (only the TSC)=1.25% or another 80-fold reduction in power over a non-surgical attack.

The technique can be refined further still by attack only the stealing bits that surround the TSC The purpose of stealing bits is to alert the devices that are receiving the traffic stream that a short message burst, as opposed to vocoder data, has been embedded in the traffic stream. These injected messages constitute what is known in the standard as the fast associated control channel (FACCH), and corrupting these bits will lead the receiver to believe that it has a message as opposed to voice or vice versa. The messages are staggered to occupy 8 frames and in each frame the stealing bit associated with the burst in the slot for that frame is set. In principle therefore only one bit in each of eight frames need be attacked and hence the amount of power reduces to be approximately 1 millionth of that required to achieve the same effect as the equivalent non-surgical broad band attack performed across the entire cellular spectrum.

Stealing bits are, however, unprotected and therefore properly designed receivers may be forgiving of errors in the stealing bits (e.g., by declaring that a portion of the signal that appears to be an FACCH channel is one even though the stealing bits indicate otherwise and subsequently attempting to process it as an FACCH message as long as N of the M stealing bits indicate an FACCH message). Furthermore, any attack only has on average a 50% chance of corrupting a stealing bit and hence it is likely to be necessary to attack virtually all stealing bits in order to achieve the desired effect. However, effective use of either of these techniques would still enjoy many orders of magnitude in average power savings over a blind wideband attack. The TSC attack can be extended to include the stealing bits (as they are contiguous within the burst) and thereby combine the effects of both attacks to further minimize the chances that coded frames get through to the receiver.

While there is no guarantee that the foregoing attacks will not affect an unintended subscriber, the surgical techniques used in the attacks greatly diminish the probability of collateral interference. Collateral interference only occurs if one or more unintended subscribers are signaling on the same set of hopping channels in the same time slot and are in close proximity while a wideband attack is underway. Moreover, once the hopping sequence of a threatening wireless device is discovered, any collateral interference ceases. As it will typically take only a few seconds to lock to the hopping sequence, the most the collateral subscriber will experience is an almost indiscernible gap in speech (not unlike typical dropouts experienced in everyday use). In all likelihood, the collateral interference will not force the call to be dropped, as the GSM signal is robust in the presence of signal drop outs and will typically hold the call for perhaps 10 to 15 seconds without intelligible communication before ending it.

Another refinement to this technique is to forego a TSC or stealing bit attacks in favor of the convolutional encoder attacks as described under the heading of Specific Attack Techniques. GSM employs convolutional encoding and attendant interleaving. If particular sets of bits are attacked that are contiguous after the de-interleaving process, the convolutional decoder can be forced to jump track, garble the frame, and cause the frame to fail the CRC or other error checking. This makes it possible to cover more spectra simultaneously by time multiplexing the attacks across the entire active span. It is not important which sets of bits are attacked in the GSM bursts as long as they meet the post de-interleave contiguity criteria. Therefore a particular set of bits can be attacked in one part of the slot within a frame and the generator can then jump to another portion of the spectrum and attack a different set of bits in the same slot. This technique therefore is not limited to attacking just a small portion of the burst (e.g., the TSC is $1/10^{th}$ of the entire burst), but instead lays the entire burst open to attack. In principal, this makes it possible to cover the entire spectrum of the hopping signal simultaneously while using only a modest wideband signal. The tradeoff is that the signal is likely to have a greater duty cycle than the strictly TSC attack and thereby have greater power consumption. On the other hand, the modest wideband signal lessens the probability of a signal making it through to the wireless device. This duty cycle disadvantage is also somewhat mitigated by the fact that the attack bandwidth (and thereby power consumption) can be lessened as time is essentially traded for bandwidth. Furthermore it allows more energy to be concentrated in a smaller band and hence improves the efficiency of the attack by reducing the required instantaneous power.

The preferred embodiment of the surgical neutralizing system employs both strategies in tandem. Initially, the convolutional encoding attack is employed to cover large swaths of spectrum. This gives the reverse channel receiver time to converge to the hopping sequence where, in addition to the convolutional coding attack, either the TSC or stealing bit attacks can now be employed with maximal effect, as the generator is hopping in rhythm with the signal under attack. This allows the peak power to drop by a factor of 10 to perhaps 100 (depending on several factors including the effective bandwidth of the hopping channel set) over period of a few seconds.

In all cases, the attack on a particular signal ends when the receiver can no longer hear the reverse channel signaling, either because the call was dropped or the convoy has moved out of range.

Specific Attack Techniques

Baiting and Disablement

Figure 10:
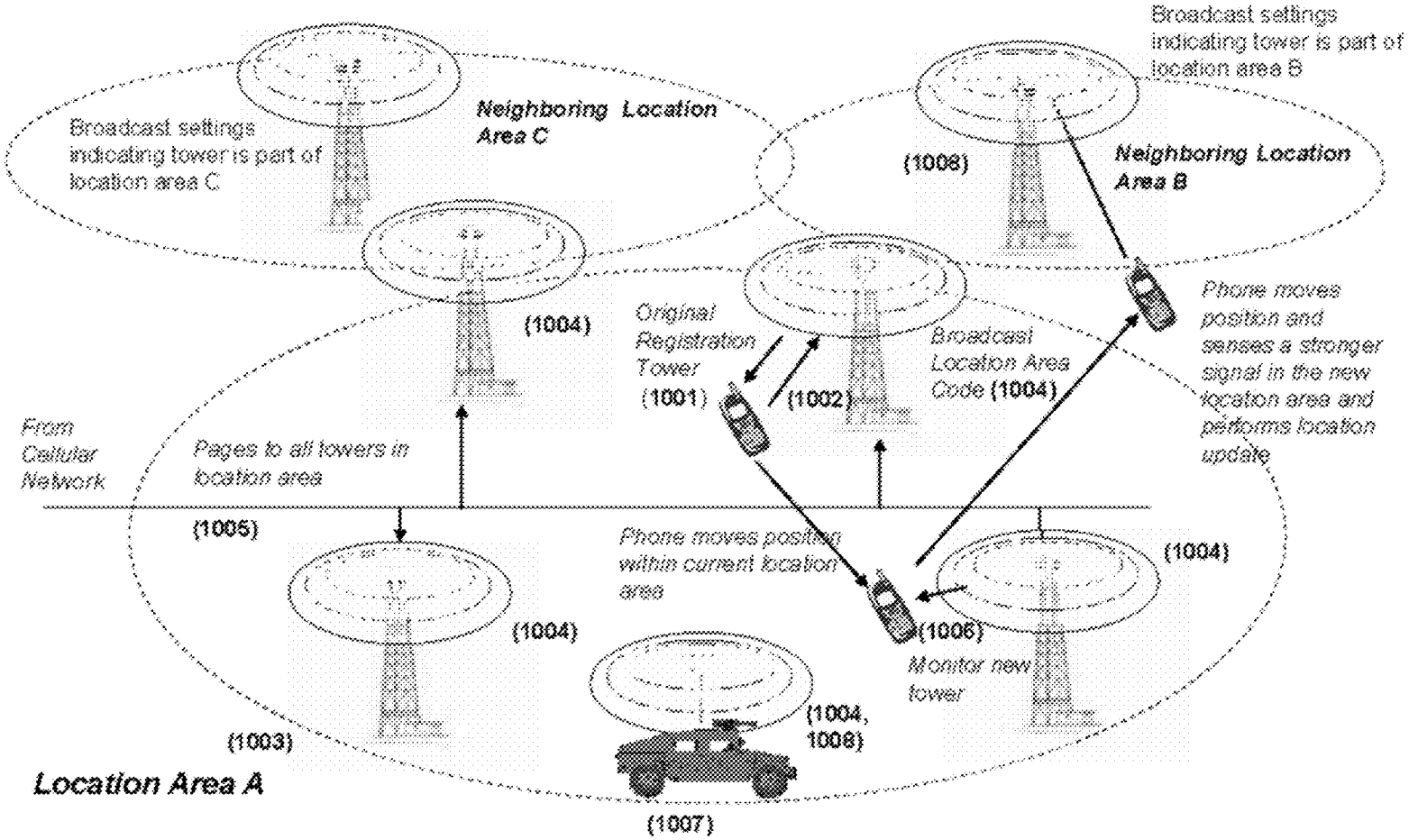
FIG. 10 shows a typical GSM system with beacons and location areas.

The approach to baiting used in the surgical neutralizing system can be best understood from a general description of the typical operation of most wireless devices, as illustrated in FIG. 10. Upon power up, the wireless device scans prescribed bands looking for beacons. If one or more beacons are identified, the wireless device will chose the best beacon (be it for quality, signal strength or compatibility) and attempt a registration or what is known in the standard as a location update (1001). The purpose of a location update is to inform the wireless network that the wireless device is on and therefore able to accept pages. As part of location update, the wireless device identifies a set of neighbor beacons, either by taking its own measurements of the beacons in its environment or from a list broadcast by the live beacons (1002). The wireless device then enters an idle state in which it continues to monitor the beacon on which it registered or one of its neighbors for pages.

FIG. 10 also illustrates the notion of a location area. The location area notion frees a wireless device from being tethered to the original registration (1003) beacon and thereby creates more fluidity for the wireless device to roam. Sets of beacons distributed over some presumably contiguous geographic area are grouped together as a location area collection on the basis of a common identifying code embedded in their signals (the location area code messages are in System Information 3 and 4 messages) (1004). All pages intended for a wireless device are then dispatched simultaneously to all beacons (towers) in the location area in which the wireless device is currently registered (1005). It is thus actually unimportant which beacon a wireless device actually monitors as long as it is one that belongs to the same location area in which the wireless device originally registered (1006). Moreover, it is left entirely up to the wireless device to determine which beacon to monitor within the location area.

When being used to establish a baiting beacon, the surgical neutralizing system scans the cellular environment and identifies all of the viable beacons in some defined operational environment. It then makes a clone of one of the beacons, The clone has a number of important differences from the beacon it was cloned from.

a) The clone uses a frequency channel assignment that is on the neighbor list (preferably all of lists) of all the live beacon(s) and is furthermore not detectable in the operational area; and b) The clone has the same location area code (system information 3 message) as those in the live environment—this is critical as it keeps the wireless device from attempting a location update and ignoring the baiting beacon if the location update fails; and c) The clone system information 4 fields, most notably the cell selection/reselection fields, are set to request minimum power from the wireless device (equivalent to boosting the priority of the beacon). This makes the clone as attractive as possible to the wireless device. This refinement makes it possible to reduce the power of the baiting beacons because the standard requires that a wireless device give more weight in the cell selection process to a beacon that requires less power from the wireless device). Sec ETSI 45.005 Section 4.1.1 and 45.008 Section 6.4

The effect of these differences is that the baiting beacon will entice all of the wireless devices to monitor it rather than the beacons of the live network (1007, 1004)). The radius of the effect is controlled by adjusting a combination of the aforementioned minimum required wireless device power (i.e., its priority) and the actual baiting beacon power. Adjusting either upwards will increase the effective radius in which wireless devices will be baited. The mode of operation of the preferred embodiment is to maximize the baiting beacon priority and then adjust the baiting beacon strength to moderate the radius of influence. This ensures minimal power consumption.

Figure 11:
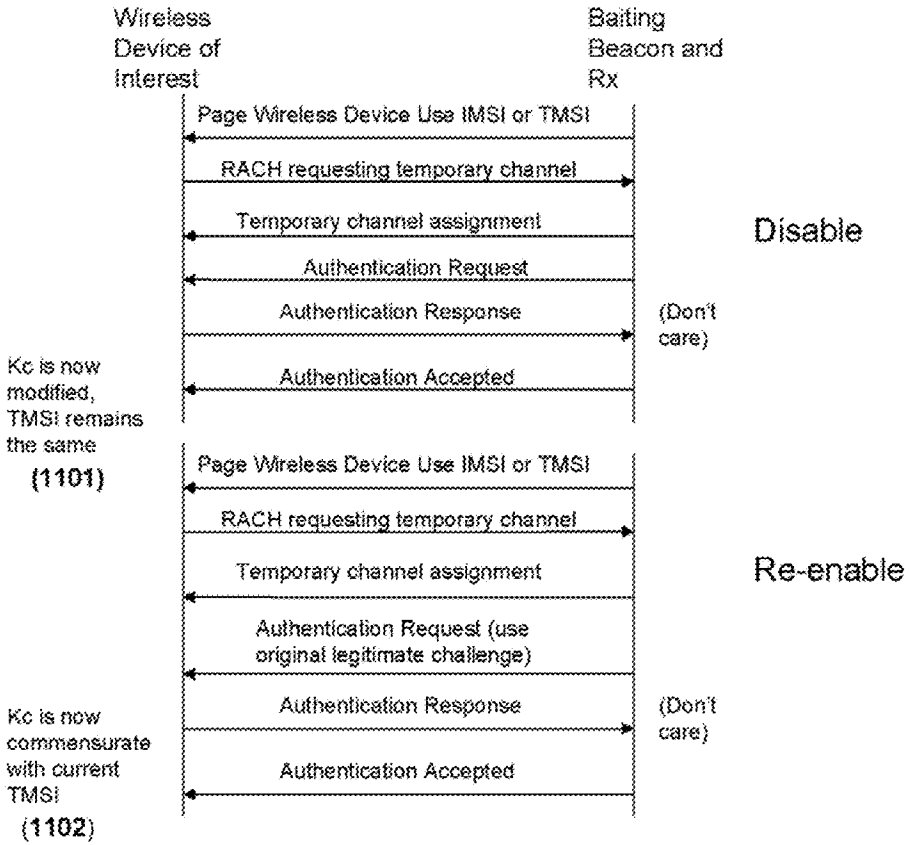
FIG. 11 shows an attack in which a wireless device is disabled by using a baiting beacon to change the wireless device's cipher key.

Given sufficient time, the baiting beacon can be used to perform the added step of disabling any or all phones in the operational area. In this case, the same baiting beacon is used but instead the location area is modified to be different than that of the existing location area (1008). In response to apparently being in a new location area, the wireless device updates its location instead of passively monitoring the beacon for pages. It is at this point that the surgical neutralizing system can gain control of the wireless device through the baiting beacon and apply any of the several techniques enumerated below:

a) issuing an authentication reject that disables the subscriber identity module (SIM) which prevents either incoming or outgoing calls until the wireless device is power cycled; or b) interrogating the phone to determine its IMSI or TMSI and using this information to impersonate the phone to the network and perform a detach procedure which will have the effect of fooling the network into believing the wireless device is no longer on or otherwise unable to accept calls and will therefore likely route the call to either voice mail or another automated message; or c) rekey the encryption key as shown in FIG. 11. Generally, when a GSM beacon responds to a location update from a wireless device, it provides the wireless device with a new TMSI and a new cipher key. The baiting beacon, however, foregoes the TMSI reallocation that is normally part of the location update process. As a result, the TMSI for the wireless device and the wireless device's cipher key are now effectively out of phase. When a wireless device's cipher key is out of phase with its TMSI and the wireless device attempts to initiate a call, the network will generally not re-authenticate the wireless device. Instead the network will presume that because the wireless device's TMSI has not changed, the wireless device is still using the cipher key that it is paired with the TMSI. Because the cipher key the wireless device is using does not match its TMSI, the wireless device will not be able to complete the cipher mode sequence in the call setup (1101). The network responds to the failure to get past the cipher mode sequence by dropping the call. The same sequence of events occurs when an attempt is made to call the wireless device. The wireless device is consequently effectively cut off from the network.

The wireless device will remain cut off from the network until such time as the network chooses to re-authenticate the wireless device. After re-authentication, the TMSI and the cipher key will again be in phase. The period of time during which the TMSI and the cipher key are out of phase depends on the interval between re-authentications which is specified in the network configuration. Typical intervals range from 10 minutes to an hour but in many cases, if the TMSI has not changed, the device will not be reauthenticated and in this case the wireless device can remain disabled indefinitely—perhaps even after it has been power cycled. That is the case because the wireless device retains its TMSI even after the wireless device has been power cycled and cannot be reauthenticated with the network until it has a new TMSI.

If sustained denial of service is desired, the surgical neutralization system can again put the TMSI and the cipher key out of phase each time the network re-authenticates.

Another aspect of this technique is that the wireless device can be restored to the network at any time by putting the TMSI and the cipher key back in phase. This can be done by re-interrogating the wireless device with the random challenge that was used for the legitimate authentication, as this will restore the original key state and therefore put the cipher key back in phase with the currently established TMSI (1102). Another important feature of this technique is that the only effect that the user of the wireless device sees is that he or she is unable to make an outgoing call.

Surgical Waveform Attacks

Wideband Extensions to the TSC and Stealing Flag Attacks

Figure 12:
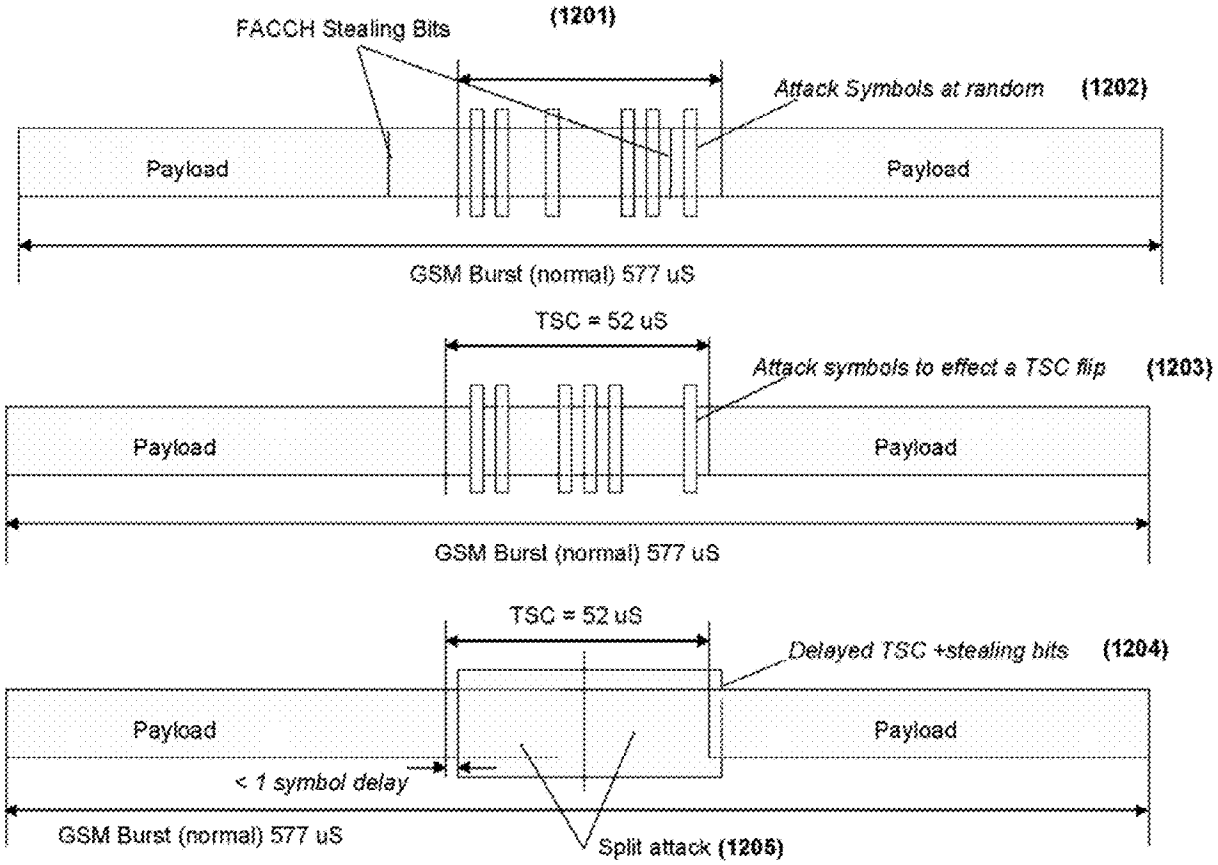
FIG. 12 shows several modes of attacking the TSC.

The GSM waveform is described in ETSI 45.002. It is structured as sequence of frames lasting 4.602 mS and is subdivided into 8 time slots as shown in FIG. 7*b*. Each slot contains a Gaussian Minimum Shift keyed (GMSK) modulated burst having the structure shown at (1201) in FIG. 12. The burst consists of a training sequence (referred to in the standard as the TSC) surrounded on either side by stealing bits and payload data. The standard provides for 8 distinct (orthogonal) TSCs and the TSC persists for approximately 50 uS out of the total 577 uS for the burst. The purpose of the training sequence is to enable the receiving device, be it the wireless device or the base station, to synchronize to and equalize each and every burst so as to demodulate the associated payload data. The TSC thus represents a fundamental weakness in the GSM signaling. If the TSC is sufficiently modified, the receiving device cannot recover the payload data. Ways of attacking the TSC include but are not limited to:

- using white noise or a tone to interfere with the portion of the slot containing the TSC (1202);
- offering a delayed version of the TSC to give the receiving device false timing, which in turn causes the receiving device to misinterpret the payload data in the slot (1203); or
- overriding a specific expected TSC pattern with another pattern so that the receiving device ignores the burst altogether (1204). As noted previously the technique also contemplates splitting the attack (1205) such that more than one TSC on a channel can be attacked at a time.

The white noise or tone attacks on the TSC are the most obvious choices. They can be further refined to only attack a smaller subset of the symbols at random in the TSC to further reduce the power consumption. However they are not necessarily robust against a sophisticated receiving device. The remaining two methods are improvements that allow the neutralizer to randomly attack a smaller subset of the TSCs while thwarting sophisticated receivers. Sophisticated receiving devices will attempt to flywheel through garbled TSCs using averaging techniques. Therefore a white noise or tone attack necessitates that a slot of interest in all frames be attacked to prevent such flywheeling (i.e., to prevent the receiving device from forming any averages). The other two methods expressly play to a sophisticated receiving device by proffering either a delayed copy or a different higher powered TSC that overrides the expected TSC. In the former case the receiving device will lock onto the delayed version of the TSC and use this to equalize the payload. The payload will not have this delayed characteristic and the mismatch will cause the receiving device to garble the payload. This technique furthermore requires significantly less power than the white noise or tone attack because the receiving device treats the delayed signal as a multipath component to be equalized and therefore the error adds coherently instead of incoherently as is the case for white noise or tone attacks. In the case of a white noise or tone attack, the receiving device will assume that it has locked on to another signal with a different TSC (perhaps due to pathological propagation) and presumably drop the burst. In either case the number of frames that need be attacked is reduced significantly.

The stealing bits implement the Fast Associated Control Channel (FACCH). When the wireless device enters traffic mode, it is no longer communicating with the beacon but is instead operating on a dedicated traffic channel (TCH). When a stealing bit is set to 1 it indicates that a FACCH message has been inserted (i.e., the TCH frame is being stolen thus interrupting the vocoded traffic with a very short message that is used to convey control information such as a call waiting alert. The duration is such that the pause in traffic is imperceptible to the user. When the bursts carry ordinary traffic, the stealing bits are set to 0. Corrupting the stealing bits will in principle cause the receiver to believe it has a FACCH message when it is in fact ordinary traffic and vice versa. However, either the vocoded traffic or a FACCH message can be used to arm or detonate an explosive device, and it is consequently necessary to prevent both kinds of traffic. Because this is so, corrupting the stealing bit may not be robust enough, particularly since any given stealing bit only has a 50% chance of being corrupted (due to the differential coding employed by GMSK, making it impossible to predict the instantaneous frequency of the carrier of the stealing bit) and consequently how the receiving device will react to the corrupted stealing bit. For example there is a chance that only 4 of perhaps 8 stealing bits are corrupted (or conversely received correctly) but the four correct stealing bits may be enough for the receiving device to attempt to frame the information as a FACCH message and thereby permit the message to get through to the wireless device. Instead, the stealing bit corruption is best used as an extension of the TSC attack: the stealing bits are included in the TSC attack and that adds another layer of protection against signaling of any kind reaching the wireless device.

In situations where the surgical neutralizing system is unable to provide any useful information about the hopping sequence, a wideband TSC attack is employed. In this attack, the TSC attack described above is carried out over multiple contiguous channels as shown at 902 in FIG. 9. It shows the same waveform being generated on multiple frequency contiguous GSM channels. This collective signal is then hopped at random across the hopping set to effect the attack described under Attack Strategies for cases where the hopping set is known but not the sequence. More than one such wideband signal may of course be used in the attack, with corresponding tradeoffs regarding power consumption and generator resources.

Methods for Discovering the Hopping Set

Given a sufficient number of frames, the surgical neutralizing system can definitively determine not just the hopping set but the hopping sequence itself. When the hopping sequence has been determined, the surgical neutralizing system may switch the attack from a probabilistic wideband attack to a deterministic narrow band attack that is in precise frequency hopping rhythm with the wireless device. In the narrow band attack, the surgical neutralizing system attacks a specific slot within each frame on a single channel (or more aptly the active slot therein) and thereby greatly reduces the probability of signaling getting through to the wireless device while dramatically reducing power consumption.

Since adjacent base stations may have overlapping hopping set allocations, different sequences of those frequencies are assigned to wireless devices in order to minimize the likelihood of collisions (i.e. two or more wireless devices transmitting on the same frequency at the same time). The mapping of frame number to frequency is a function of the current frame number, the hopping set, and the HSN and MAIO parameters supplied during the initiation of a call (see ETSI, 45.002 6.2.3). Collisions are inevitable; for example, for a particular frequency and frame number, every HSN has exactly one MAIO that will result in the wireless device transmitting on that frame at that frequency. However, since the sequence-generation algorithm avoids long strings of such collisions, only a few observations of where the wireless device is currently transmitting are required to establish the specific sequence in use. Additionally, the knowledge that the wireless device is NOT transmitting at a particular frequency at a particular time further helps constrain the possible sequences. As the number of potential sequences decreases, the number of frequencies the transmitter must attack per frame similarly decreases, ultimately resulting in the transmitter attacking only the specific frequencies/frames on which the wireless device is listening. Furthermore, since a particular sector will typically use one HSN with several MAIOs, if the HSN the sector is using has already been discovered (i.e. by placing a phone call to the sector), only one observation is required to establish the MAIO (and hence the exact sequence) that the wireless device is using.

Figure 13A:
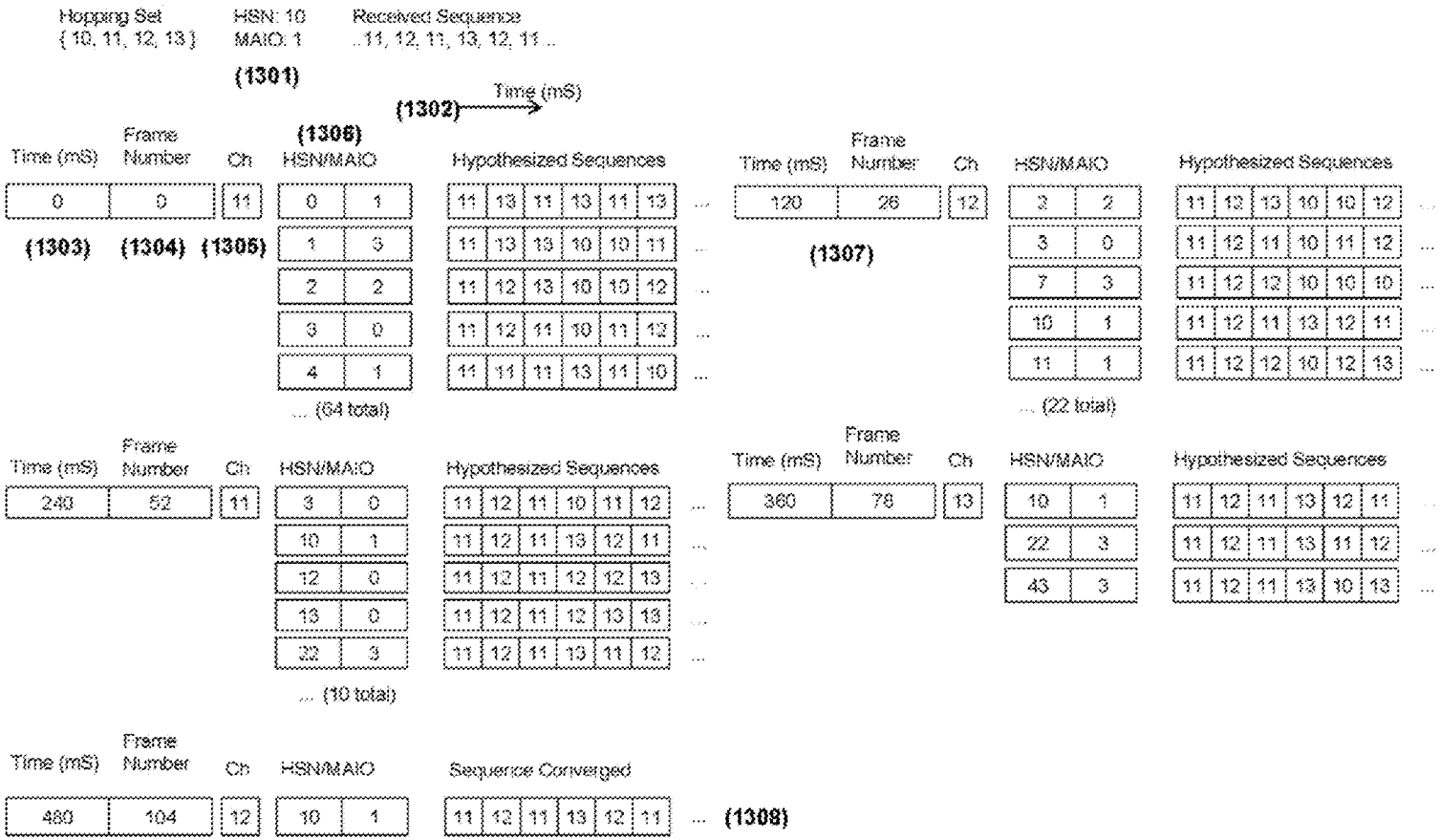
FIG. 13*a* shows how the hopping sequence for a GSM wireless device may be determined.

FIGS. 13*a* and *b* illustrate the process. FIG. 13*a* is a strictly instructive example showing a hopping set consisting of channels 10, 11, 12 and 13 (known to the receiver—for example as derived from the system information 1 message broadcast by the beacon) with HSN of 10 an MAIO of 1 (1301) (heretofore unknown to the receiver). The presumption in this diagram is that the receiver is very wideband and can detect all channels in the set simultaneously such that it never misses on which channel the wireless device has hopped. Reading from left to right it shows the receiver looking for SACCH detections approximately every 120 mS the timing of which is definitively established by the network and has therefore been previously derived by the surgical neutralizing system (1302). The first column is the time in mS (1303) and the associated frame number (1304) and the channel on which the wireless device was detected (1305). The next column pair (1306) lists the total possible set of HSNs (64) and which MAIO would be on channel 11 on that particular frame. In this example only there are only 22 possible combinations of FISN/MAIO pairs that meet this criterion. Progressing to the next occurrence of the SACCH burst 120 ms (1307) thereafter, the example shows the receiver detecting the burst on channel 12 and therefore whittles the HSN/MAIO candidates to 10 possible (i.e., only 10 pairs could have hopped on both channels 11 and then 12 on those particular frame numbers). Continuing further we see that in 5 iterations (within less than one second) there is only one solution for both the HSN and MAIO that will uniquely satisfy the received sequence (1308).

Figure 13B:
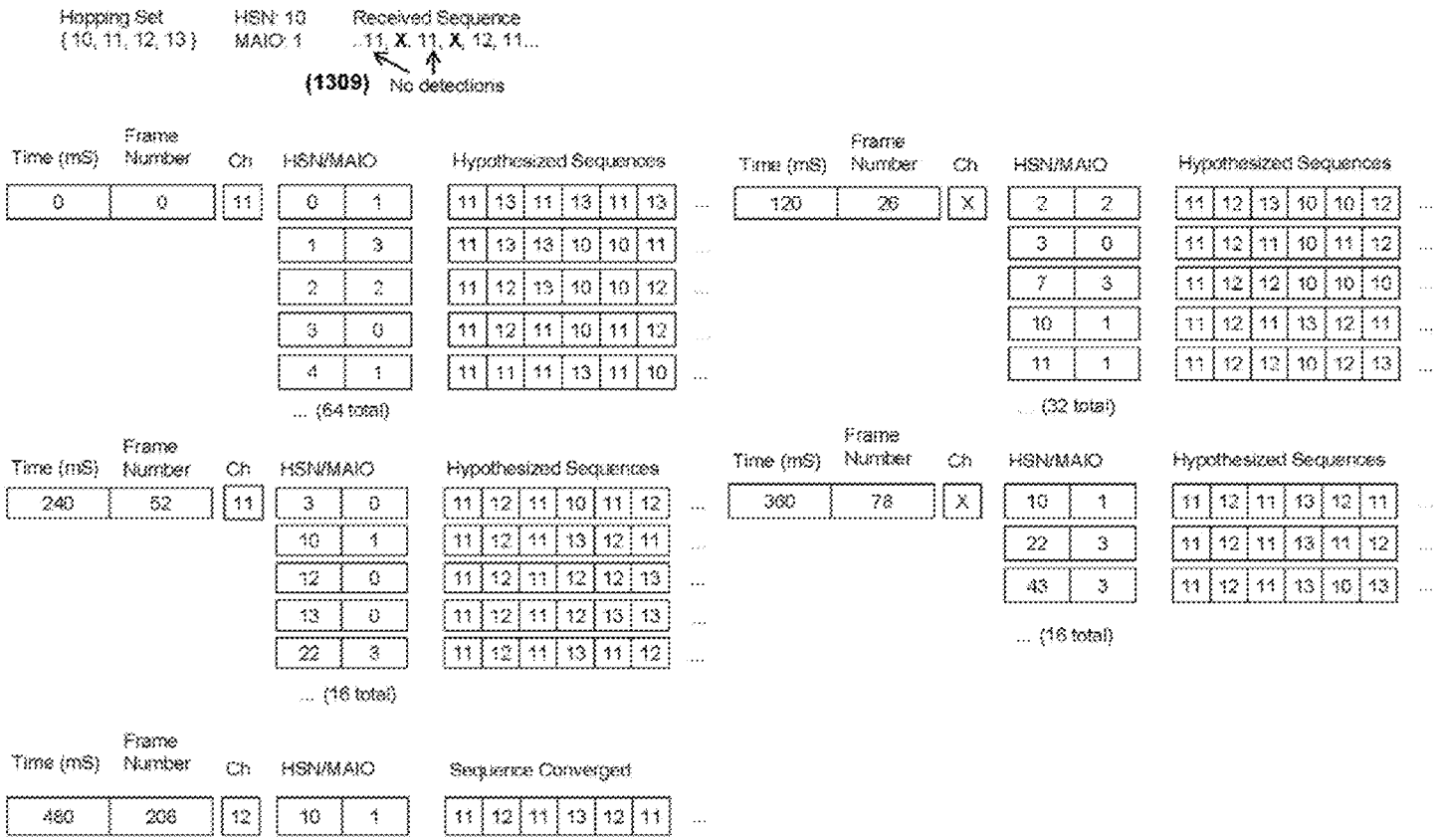
FIG. 13*b* shows how failure to detect a member of the hopping sequence can be used to narrow the number of possibilities for the hopping sequence.

Since the receiver bandwidth of the preferred embodiment of the surgical neutralizing system may not be able to simultaneously cover the entire spectrum spanned by the hopping set, the receiver must rapidly tune around, detecting and/or predicting where the next hop will occur as it does so. The receiver mitigates this problem as illustrated in FIG. 13*b* by using "negative" detection. In negative detection, failure to detect energy in a band can be used to winnow the possible HSN/MAIO combinations (1309). The failure to detect energy is more ambiguous than a positive detection and therefore fewer HSN/MAIO combinations can be discounted on each pass (e.g., every 120 mS). Therefore while the same principles of converging to the hopping sequence apply, it will necessarily take longer with a more modest receiver bandwidth. However, this method of search will in general converge geometrically, particularly after the first definitive detection, as the receiver can now better predict where to look for subsequent energy, which in turn suggests that even with a modest bandwidth receiver, the time to detect is not significantly longer.

The foregoing presumes knowledge of the hopping set but presumes no knowledge of the HSN or MAIO. The problem is greatly simplified if a single phone call is placed to the tower (either previously or perhaps on the fly) allowing the surgical neutralizing system to discover the HSN. As described previously a beacon in a sector will use a single HSN and then dole out different MAIOs and time slots (within a frame) to keep multiple wireless devices from interfering with one another. Any beacons in adjacent sectors are likely to use different HSNs or possibly different sets of MAIOs while reusing the same HSN so as to preclude collisions. When the call is placed, the surgical neutralizing system can immediately determine both the HSN and the hopping set (if it has not already been gleaned from system information 1) being employed by that sector. In this case it only requires a single detection to uniquely identify the MAIO and hence the complete sequence. This is possible due to the uniqueness criteria established above which dictates that different MAIOs of the same hopping sequence do not collide and hence there is only one possible solution for the MAIO given the HSN, hopping set and the frame number.

Convolutional Encoding Attack

Figure 14:
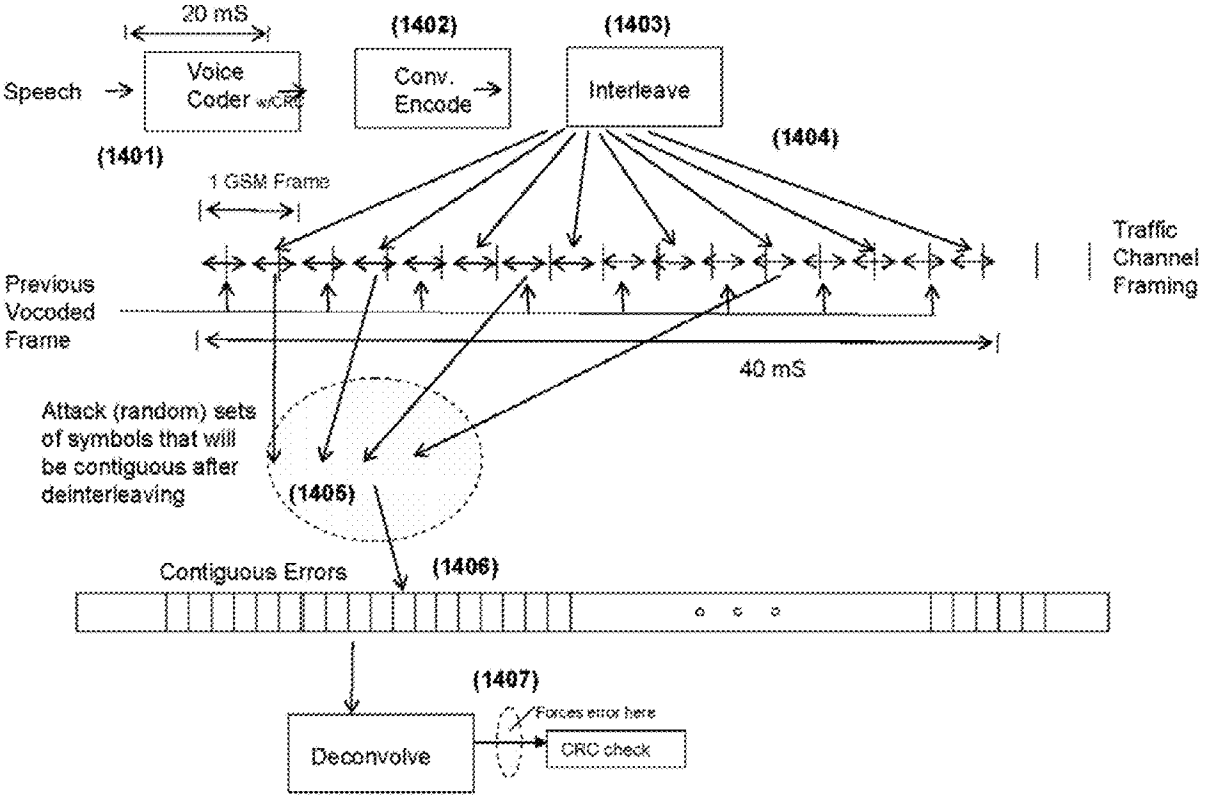
FIG. 14 shows a method of corrupting convoluted and interleaved payload.

Another possible attack, shown in FIG. 14, is to recognize that all framed messages or vocoded frames use cyclic redundancy checks (CRCs) and convolutional encoding (1401) to deal with errors in the data represented by the signal. A CRC indicates whether data in a portion of the signal termed a CRC checking span is valid. Associated with the convolution encoding process is data interleaving. Cellular interference tends to occur in bursts instead of being uniformly spread over time. The purpose of data interleaving is to shuffle the data symbols prior to transmission so that when they are subsequently deinterleaved at the receiver, any bursts of errors introduced in the transmission channel will tend to be distributed over time instead of occurring in contiguous bursts. The intent is to improve the performance of the deconvolution process (an example of which is the Viterbi algorithm) that is well understood in the art to perform best when errors are more or less uniformly distributed over time instead of occurring in sets of contiguous symbols. However, the deconvolution process diminishes rather than improves the demodulation performance when errors occur in contiguous bursts in the pre-deconvolved data, as it makes it more likely that the trellis path decoding will forsake the expected traceback path in favor of a competing traceback path and thus cause the receiver to completely corrupt the decoded signal.

Each vocoded frame carries 20 mS of speech. The speech data is convolutionally encoded (1402), interleaved (1403) and interspersed across 40 mS (i.e. 8 GSM frames) (1404). The GSM standard is specific as to which GSM frames a vocoded frame begins and ends at and therefore the receiver can predict the interleaving pattern with certainty.

Contiguous bursts of errors in the deconvolved data can be produced by attacking the pre-deinterleaved symbol sequence at seemingly disparate but in fact deliberate places that are matched to the interleaving process (1405). The attack introduces errors into the post-interleaved symbol sequence at the locations that are related by the interleaving process such that when they are subsequently deinterleaved by the receiver, the errors occur in contiguous bursts (1406). Selection of particular interleaved candidate symbol sets is not generally important and therefore this technique lends itself to randomization of the attack within any given frame, which further disguises the attacking signal. Moreover, not every frame of the beacon's signal need be attacked. Instead merely successfully attacking a single frame within the total CRC checking span (1407) is generally sufficient to force the intended CRC error. Because this is the case, frames can be randomly selected for attack. In the former instance, this leads to a further reduction of on-time and therefore required power and in the latter instance, further reduces the conspicuousness of the attack. The choice of specific attack waveform can be as simple as a tone snippet applied on a per symbol basis, since the GMSK waveform is sensitive to frequency shifts.

Beacon Framing and Protocol Attacks

In GSM, the signals transmitted by beacons and wireless devices are divided into frames and the information contained in the signals is contained in sets of the frames. For example messages are typically collectively coded and CRC'd across 4 frames. Therefore it is only necessary to attack one of the frames of a message at random using the surgical attack techniques described previously to cause the entire message to be dropped due to a CRC failure. Certain messages are necessary for the wireless device to gain access to or otherwise subsequently interact with the wireless telephony system, and a wireless device can consequently be suppressed by attacking frames belonging to these messages.

The GSM beacon waveform operates on a single 200 kHz channel that does not frequency hop. As described previously, the beacon's signal is divided into frames that are in turn divided into 8 slots. A slot is approximately 577 uS (713) and a frame in turn is approximately 4.6 mS. (714). 51 frames are grouped together to form what is known in the standard as the 51-multiframe that has the specific structure shown in (715). The beacon operates on slot 0 of each frame, with any other types of channels that are in use operating on the remaining slots. The standard dictates that unused slots within all frames will carry dummy bursts so that the beacon is guaranteed to be transmitting in every slot of every frame. This makes it easier for the wireless device to monitor the beacon.

The remaining description is concerned with slot 0. The first two frames of the slot carry the frequency correction channel (FCCH) and the synchronization channel (SCH) (716). The information carried in the FCCH channel permits the wireless device to correct any frequency error it may have relative to the base station. The information carried in the SCH channel permits the wireless device to determine the precise timing of the frame and its slots. The beacon repeats the FCCH and SCH frames every 10 frames within the 51-multiframe. The next 4 frames in the 51-multiframe carry the Broadcast Control Channel (BCCH) (717) which carries the system information for the beacon as well as the parameters which the wireless device must use to access the beacon. The remaining channels are grouped into blocks of 4 frames each and constitute collectively what is known as the common control channels (CCCH). Depending on how the beacon is configured, these channels are subdivided into sets of paging and/or access grant channels (718).

Because the beacon's signal is highly structured, once the timing is known, only a small part of the beacon need be attacked in order to effectively neutralize it as an access point. For example the BCCH (which carries the compulsory system information messages 2, 3 and 4) only occurs for 4 frames (on slot 0) out of each 51 multiframe and only one of those four frames need be attacked as described previously. Because the 51 multiframe repeats 4 times per second, this suggests that only four frames (more aptly 4 TSCs each lasting 50 uS) need be attacked for a total of 200 uS out of every second translating to a duty cycle of $1/5000^{th}$. Similar arguments apply to attacking other channels such as the paging channels (proactive idle mode) or the SDCCH channels (reactive idle mode). The surgical neutralizing system may even elect to generate a tone that interferes with the FCCH such that the wireless device becomes mistuned and thereby unable to demodulate any messages received from the beacon.

Figure 15:
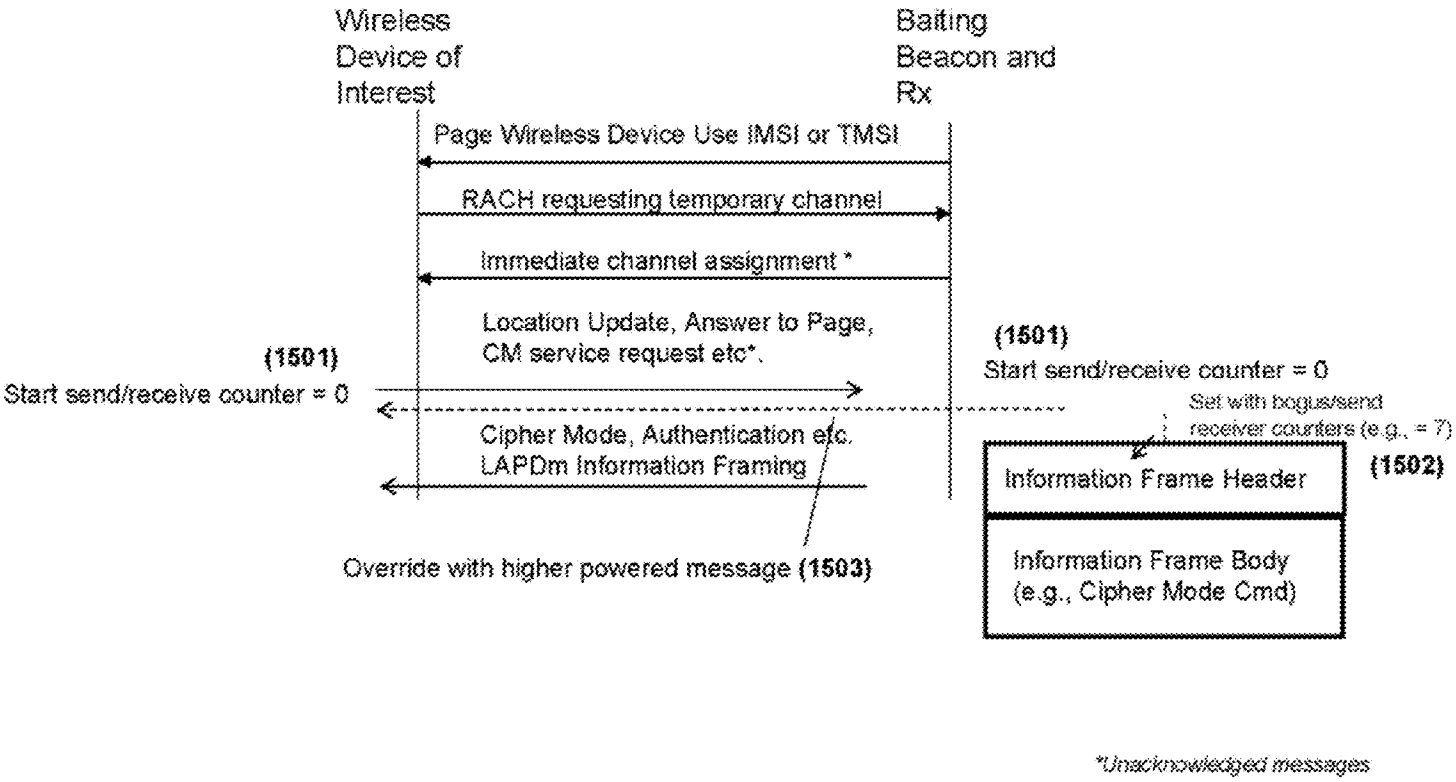
FIG. 15 shows a method of corrupting a message that is part of the GSM call set up protocol.

Another avenue of attack, given that the timing and structure of the beacon is definitively known, is to override one (or more) of the messages that are traded between the network and the wireless device as part of the call setup procedure. The principle is illustrated in FIG. 15. The SDCCH signaling is encapsulated in the Link Access Protocol (modified) protocol as specified in ETSI 44.006. In the header of information messages there are two counts designated as the send and receive count. When the SDCCH is established, the send and receive counters are zeroed in the information message frames (1501). By formulating an information message (such as a Channel Release message) and modifying the counts such that they are out of step (1502) with what is expected by the wireless device, and generating the message at a higher power (1503)), the wireless device will drop the call as cited in ETSI 44.006 Section 8.7.4. An important subtlety is that the surgical neutralizing system be able to modify the counts before the true cipher mode command is issued so that wireless device is able to recognize the message. The attack forces the wireless device to drop the call immediately because the values of the send/receive counters indicate that the wireless device is now hopelessly out of phase with the tower.

Operational Modes

Figure 16:
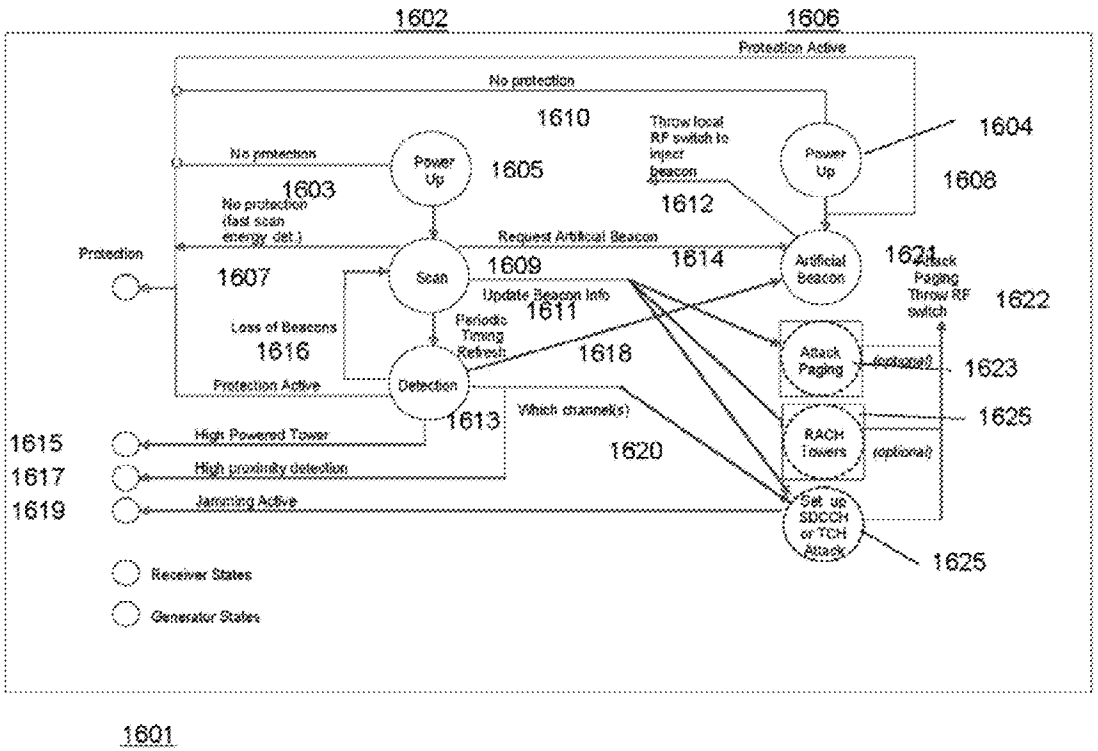
FIG. 16 presents an overview of the relationships between the states of the receiver and generator.

The operational modes and the relationships between the receiver and generator are shown at (1601) in FIG. 16. Receiver states are shown at (1602) and generator states at (1606).

Overview—upon powering up. (1604, 1605), the surgical neutralizing system alerts the operator with a no protection alarm and enters into an initial scan mode (1609) that searches RF environment looking for beacons. Initially, the scan is a fast scan (1607), which merely looks for signaling metrics (such as energy or GMSK modulation characteristics) that may indicate the presence of a beacon. For example the GMSK waveform has several characteristics that can be exploited to rapidly identify a beacon and therefore discount false alarms, without the need to dwell on it and perform a conventional demodulation, and thus rapidly decreasing the beacon scan time. One such technique is to exploit the Gaussian trajectory of the keying in the phase between symbol transitions. By phase discriminating a GMSK waveform it will demonstrate a strong baud rate characteristic indicating the presence of GMSK.

Once an environment of beacons has been established, the receiver reports the beacon list including the power level and differential timing of the beacon to the generator (1611). The information contained in any particular entry of the beacon list is a complete clone of all of the system information messages including but not limited to messages 1, 2, 2bis, 2ter, 2quater, 3, 4 and 13. (reference ETSI 44.018).

The scan process also saves the neighbor lists present in all beacons reported above so that it now has a fast refresh list that it can use when it periodically updates the beacon list. Having completed the initial scan, the protection alarm ends and the receiver enters detection mode (1613). In this mode, the receiver continues to scan the neighbor beacons in the background (1615) while searching in the foreground for signals that indicate wireless devices that are in close proximity to the convoy (1617). When such signals are found, the receiver determines the hopping sequence for the traffic between the beacon and the close wireless devices.

The states entered by the generator depend on the activity of the receiver. If the receiver detects one or more beacons, it requests an artificial beacon (1614) from the generator. The receiver then provides timing information (1618) to the generator which relates the timings of the beacons in the environment to the timing of the artificial beacon. The generator then uses timing information (1618) in generating attack signals. As shown at (1622), in generating the attack signals, the generator leaves a window which permits the receiver to continue to listen to the environment.

The attack signals depend of course on the kind of attack; attack signals which attack the beacon's paging signals are generated at (1623); attack signals which attack the random access channel used for call set up are generated at (1625); signals for surgical attacks on the SDCCH or TCH are shown at (1625); in this state, the surgical neutralizing system is surgically jamming a specific wireless device.

Details of the Initial Scan Mode

When no beacons are detectable, the surgical neutralizing system ends the protection alarm. However a difficulty arises when in convoy mode because of the difficulty in predicting when a beacon is likely to pop up while driving down the road. It may take a second or two for a preferred embodiment of the surgical neutralizing system to analyze a beacon once the beacon has been detected. The surgical neutralizing system addresses this problem by breaking the detection process into two parts: a fast scan mode that looks for energy and acquires only the synchronization channel (SCH—which is broadcast every 50 mS) and another that presumes that the detected energy is a beacon and camps on the detected energy while performing analysis in the background to extract beacon information. The surgical neutralizing system also deals with the problem by signaling an alarm any time it detects uncharacterized energy over some threshold in the scanned bands and only ends the alarm when all such signals have been either characterized or discounted as threats.

Details of Detection Mode

Once a stable set of scanning channels has been identified, the surgical neutralizing system enters the detection mode. The surgical neutralizing system remains in this mode until it can no longer detect any beacons and reverts to the initial scan mode.

If the surgical neutralizing system detects that the convoy has stopped moving for an appreciable period of time (e.g., 10 seconds) as indicated by either the GPS receiver or an accelerometer and no reverse channel signaling is detected in this time period, the surgical neutralizing system enters static mode (301). Here either of two strategies can be employed. The first is set up artificial beacons to bait wireless devices that are in the operational area into monitoring the artificial beacons. This prevents all incoming calls, as the wireless devices are enticed away from listening to the live beacons and therefore cannot detect incoming pages.

The other technique simply camps on the reverse SDCCHs of all of the towers (eliminating the need to keep scanning forward channels) looking for any activity. The surgical neutralizing system then surgically picks off the reverse SDCCH channels described above as they are detected (worst case a few per second with typical being may be every few minutes or more derived from the fact that the surgical neutralizing system is only concerned about high proximity wireless devices). This translates into enormous power savings. This also gives the surgical neutralizing system subtle but important advantages as it relates to collateral interference and required interference power. Specifically it addresses the problem of wireless devices driving past the now stalled convoy where the subscriber is connected and actively talking. In this case the wireless devices are not affected because they are not in the act of either placing or receiving a call. It also allows the transmitter power to be adjusted. For example, when the convoy is moving it will increase the transmitted power to project the signal ahead of the convoy. When static, the power can be reduced for the same reason.

In the case of wide area static operations, it is not enough to suppress just wireless devices in close proximity but also necessary to suppress communications in a wider area. This is achieved by decreasing the reverse channel energy sensitivity thresholds so that the surgical neutralizing system is now sensitive to wireless devices that are active in that wider area. The surgical neutralizing system then attacks all of the forward channels associated with reverse channel energy where it is found using the techniques described for active mode until it is satisfied that the active wireless devices are now off the air. For purposes of power savings, the surgical neutralizing system then enters into the proactive idle mode so as to prevent any subsequent access to the network by attacking the paging/access grant channels on all of the beacons detected in the operational area. If the number of beacons in an operational area is low, then a baiting approach in which an artificial beacon is generated to prevent the wireless devices from monitoring the live network will also work.

When the convoy is moving again, the challenge becomes timely detection of new beacons and new energy in the reverse link. The surgical neutralizing system uses the neighbor list broadcast in each beacon to rapidly determine where to search for new beacon activity. However the surgical neutralizing system recognizes that a neighbor list only enumerates the beacons that are being used by the same service provider. It does not adequately address the case of entering an area where there is a new or additional service provider whose beacons are presumably not on the neighbor list of the other previously established service provider(s). The surgical neutralizing system addresses this by employing the fast scan methodology to identify beacons that are not on the existing neighbor list and raising a protection alert until the beacon can be scrutinized (e.g., on the order of a second). In the meantime there is enough information from the fast scan to, as a minimum, perform reverse channel scanning for active mode wireless devices, thus mitigating the exposure risk.

The surgical neutralizing system addresses active mode detection by scanning the reverse link looking for new energy that is not associated with a known SDCCH. It detects the high proximity signals by searching for SACCH signaling that occurs every 26 frames and then camps on the forward channel to discern the hopping channel sequence. The receiver then passes the hopping channel sequence to the generator, which subsequently attacks the forward hopping channels. A specific description is provided under the heading of Example Implementation.

Co-spectral Signals

The spectral allocation used by GSM is not unique to this standard and can just as easily shared by multiple service providers using other standards such as CDMA, CDMA-2000 or UMTS (W-CDMA). Therefore the surgical neutralizing system must also be capable of expressly separating GSM signaling from other signals that can potentially be found in the same spectral bands.

GSM signals have very specific signatures that can be uniquely identified using fairly standard techniques such as demodulation or correlation. The greater difficulty is preventing signals belonging to other standards from producing onerous false alarms when scanning for energy. The surgical neutralizing system raises an alarm when these classes of signals are detected and then removes the sections of spectrum that they occupy from foreground GSM processing.

Signals belonging to the various standards are easily identified using simple autocorrelation techniques. Furthermore they operate in fixed spectral sub-bands so once identified they can easily be discounted on both the forward and reverse links. Any persistent signals detected on the forward link that are not characterized as GSM can be treated in the same fashion as signals belonging to other standards. Therefore the surgical neutralizing system augments the fast beacon scanning algorithm with a search for persistent non-GSM energy.

Example Implementation

The following presents a presently-preferred embodiment of the surgical neutralizing system. While other implementations are possible, the preferred embodiment is characterized by efficient use of a modest bandwidth receiver that is capable of being rapidly tuned over the spectral bands of interest. The use of such a receiver significantly reduces the cost, size, and power requirements of the surgical neutralizing system as compared with sophisticated wideband implementations of techniques for neutralizing wireless devices.

Receiver Subsystem Design and Operation

Figure 17:
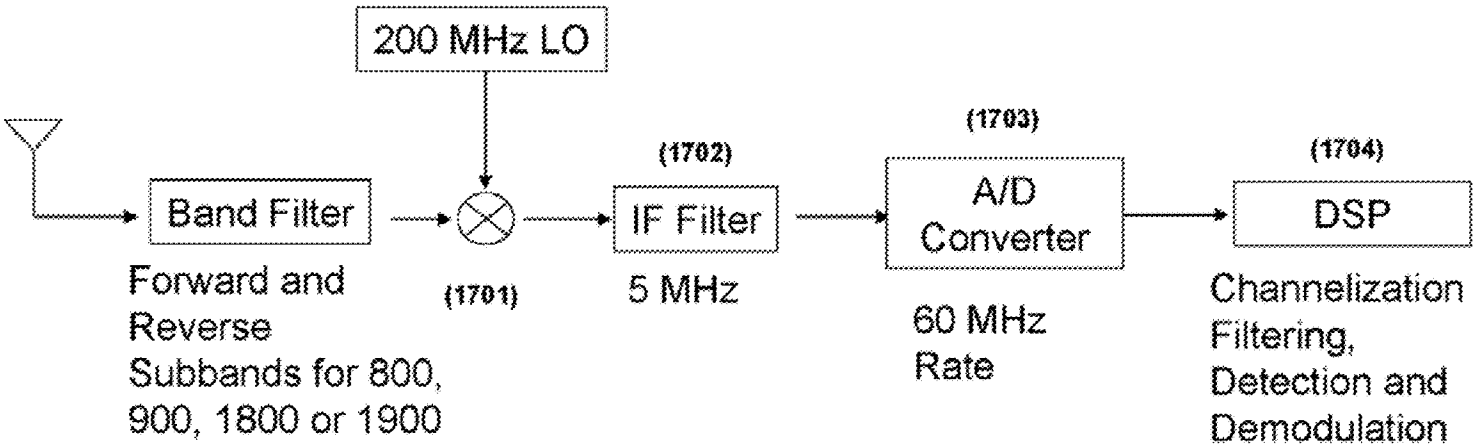
FIG. 17 is a detailed block diagram of the receiver in the preferred embodiment.

The surgical neutralizing system uses a modest receiver having an effective bandwidth of 5 MHz that is tunable across the forward and reverse links as shown at 1700 in FIG. 17. Receiver 1700 consists of an RF tuner (1701) that can variably tune any portion of either link to an intermediate frequency (IF), using what is known in the art as superheterodyning. The IF tune is followed by a band limiting filter (1702) that limits the output to 5 MHz, which in turn is followed by another conversion to baseband where the signal is subsequently sampled for digital processing (1703). This baseband conversion can be achieved by what is known in the art as undersampling where the output of the IF section is sampled directly. Undersampling eliminates the need for a second superheterodyne stage. This technique however is not central to the surgical neutralizing system. In summary, receiver (1700) is able to extract on demand 5 MHz sections anywhere in either the forward or reverse link. RF tuner 1701 is also capable of tuning to such a section within 100 uS.

Following digitization, the signal is passed through a digital channelization filter (1704) and then processed by a digital signal processor (collectively referred to as baseband processing). The design is repeated for each band of interest (e.g., 800, 900, 1800 or 1900 MHz). In the descriptions that follow it is useful to refer to FIG. 5.

The receiver of the preferred embodiment is able to perform the following functions in a timely manner:

Forward Link

- Recover the artificial beacon whether looped back from the generator and/or from other external systems.
- Detect the presence of a new beacon anywhere in the forward link within 100 mS of entering the new beacon's coverage area and report the timing of the new beacon relative to the artificial beacon.
- Monitor a new beacon until the structure of the SDCCH channels can be determined.
- Monitor subsections of the forward link spectrum looking for frequency hopping activity.

Reverse Link

- Monitor the reverse SDCCH channels associated with all currently detected beacons looking for control signaling involving wireless devices that are in high proximity to the convoy.
- Monitor the SACCH channels associated with all currently detected beacons and detect high proximity wireless devices within 500 mS of the wireless device entering the convoy's operational area.

Monitor the RACH associated with each detected beacon.

Figure 18:
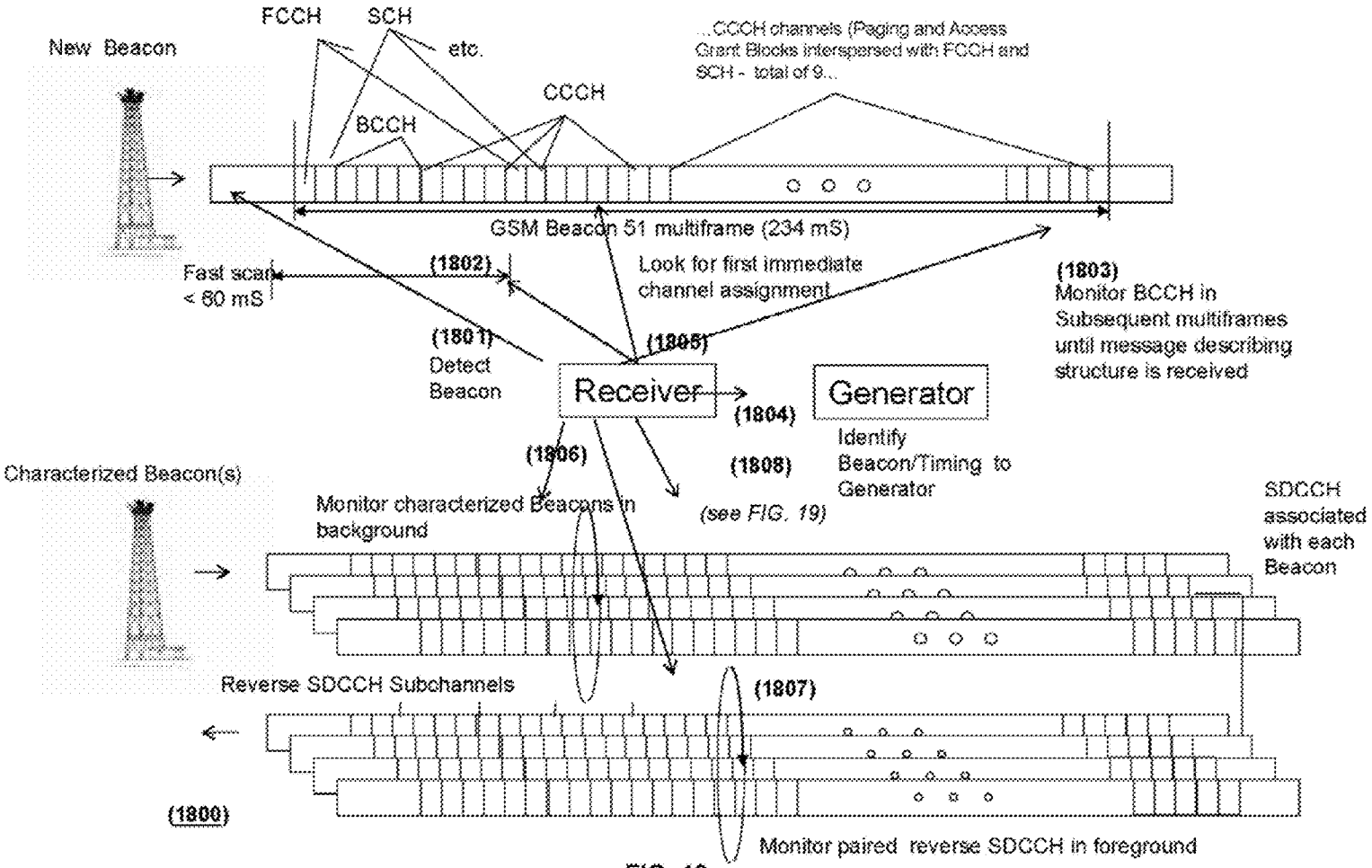
FIG. 18 presents a detail of the receiver's operation.

FIG. 18 shows the operation of receiver (1700) at (1800). Upon detecting a beacon (1801), receiver 1700 immediately reports the timing to the generator (1802) (fast scans it) and then extracts the structure of the paging channels from the system information messages that are regularly broadcast by beacon (1803) on the BCCH. It also indicates to the generator the frequency at which the artificial beacon should be placed so that it does not interfere with an existing legitimate beacon (1804). The receiver then listens to the paging channels on the beacon until such time that the first immediate channel assignment (identifying the structure of the SDCCH) (1805) is detected on any of the paging channels and then adds the detected information to an SDCCH scan list. Subsequently, the receiver infrequently revisits (resynchronizes to) the beacon (perhaps only every few seconds as scheduling permits) to determine whether the beacon has been lost and if so, the associated SDCCHs are discarded from the aforementioned list. As described previously, no race condition exists between waiting for an immediate channel assignment and a call setup because the call setup requires an immediate channel assignment. Therefore the surgical neutralizing system can dwell on a beacon indefinitely without fear that call will slip through while doing so. However, the need to dwell on a beacon for an extended period of time may cause scheduling difficulties with respect to all of the other real-time monitoring that is required of the receiver. The surgical neutralizing system deals with this problem as described below under the heading of Combined Subsystem Operation and Scheduling.

Because beacons broadcast constantly, it is relatively easy for the receiver to scan the band for energy without regard to the beacon timing. Using a 5 MHz receiver with a dwell time of 100 uS, the surgical neutralizing system can scan the entire forward link (worst case 75 MHz) looking for energy in 1.5 mS (1806). Once energy is detected, the surgical neutralizing system need dwell for no more than 50 mS before it can expect to see an FCCH/SCH combination. The combination has a duration of 10 mS. Therefore a new beacon can be unambiguously detected (not to be confused with characterized) in as little as 60 mS (1802). Because beacons broadcast constantly and can be rapidly detected, scanning for beacons can easily be performed in a background mode (i.e., be preempted) while the more pressing problems of beacon monitoring and forward channel hopping analysis as well as SDCCH/SACCH detection can proceed in the foreground.

While scanning on the forward link, the receiver must simultaneously detect both SDCCH (1807) and SACCH (1808) signaling on the reverse link. In the former case the receiver is looking for energy at very specific places in time on a specific time slot on a specific frequency channel that is expressly paired with a detected beacon. The purpose is to detect the control signaling that presages any call setup with the intent of reacting to this event before the wireless device can enter traffic mode. In the latter case the wireless device has already entered traffic mode and is frequency hopping in DTX mode.

An SDCCH can have as many as 8 sub-channels. Each subchannel has one block consisting of 4 frames on every 51 multi-frame. As a minimum, there will be at least 4 messages (1 on each 51 multi-frame) exchanged between the wireless device and the network before the alert message comes through, for a minimum setup time of approximately one second. This dictates that the surgical neutralizing system must visit every one of up to 8 subchannels at least once per second. While this timing is fixed by the network, the fact that a message occupies 4 frames gives the surgical neutralizing system some leeway in scheduling of the detection. This can be used for example to schedule SDCCH scans when there are multiple beacons that have SDCCHs that overlap in time.

Figure 19:
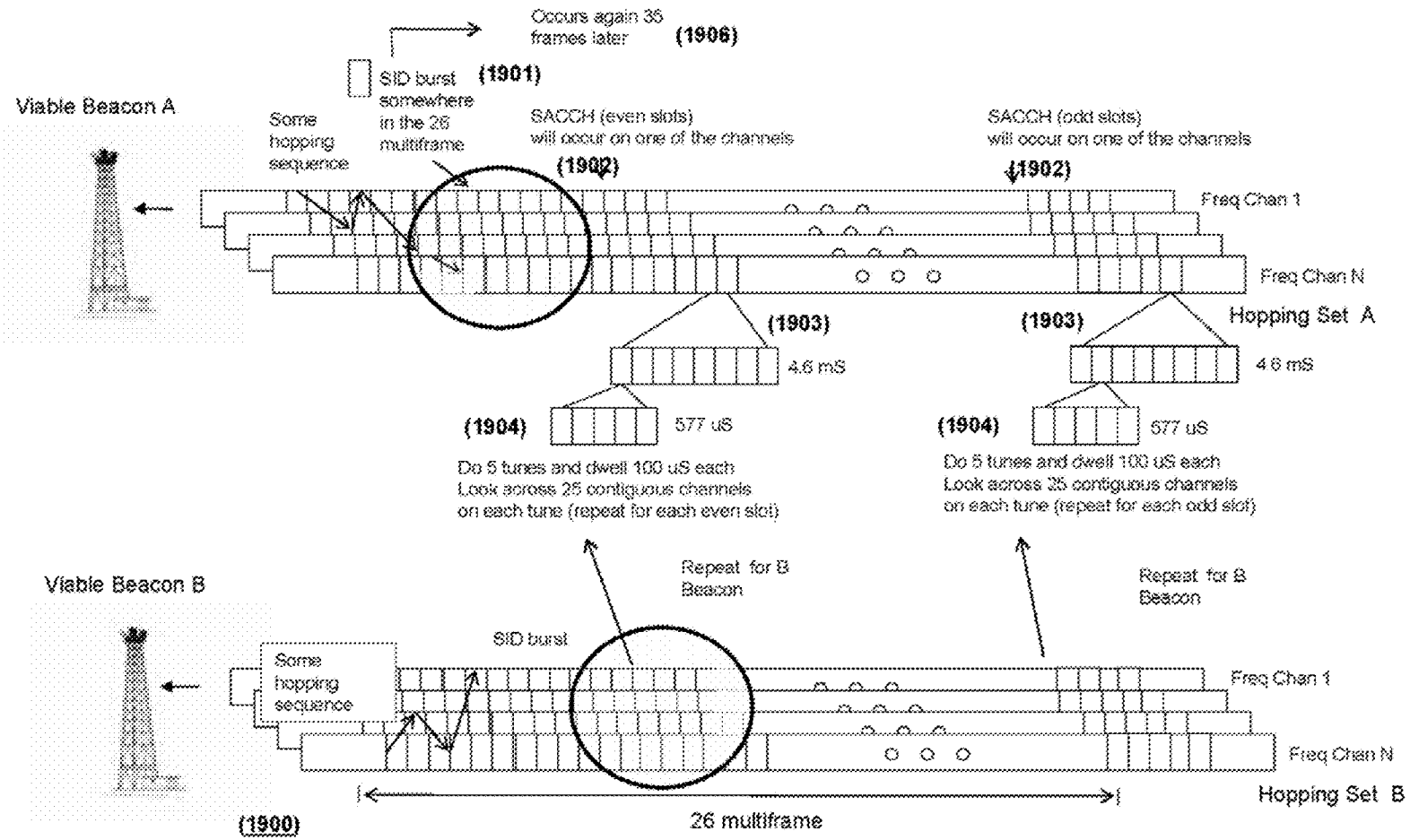
FIG. 19 presents details of how the receiver uses SACCH slots for a wireless device to detect the wireless device's hopping sequence.

The SACCH detection process on the reverse channels is shown at (1900) in FIG. 19. The purpose of SACCH detection is to address the expected (and worst case) scenario in which a wireless device is in active mode in close proximity and the forward and reverse links are operating in DTX mode. The operation in DTX mode indicates that neither side of the link is speaking or otherwise signaling. The immediate difficulty is the ability of the receiver to not only detect the presence of a wireless device in close proximity, but to ascertain the hopping sequence for the wireless device. To determine the hopping sequence, the receiver must, as previously described, form an activity histogram and pass the histogram to the generator in a timely fashion so that the generator can attack enough channels in the hopping set to render the forward link between the network and the wireless device unusable while the receiver ferrets out the wireless device's hopping sequence.

In the DTX case, the wireless device is presumably frequency hopping across as yet undiscovered channels but will only burst what is defined in the standard as SIDs (silence indicator) across 4 contiguous frames every 35 frames (approximately every 160 mS) (1901). While the occurrence of SID bursts is periodic and will necessarily line up on specific frame boundaries, its phase within the 26 multi frame is unpredictable. However the surgical neutralizing system takes advantage of the fact that the slow associated control channel (SACCH) is signaling at least once every 26 frames (1902) (approximately 120 mS) regardless of whether the wireless device is in DTX mode and such signaling is perfectly predictable based on the network (beacon) timing gleaned in any forward link scan. Therefore the DTX detection issue can be resolved by relying instead on the compulsory SACCH transmissions.

The receiver solves the SACCH detection problem by scheduling a one frame scan at the predicted time (1903). However since it is not possible to know with certainty on which beacon the wireless device is operating, and since the timing between beacons can be arbitrary, it is necessary to perform the scheduled scan for every associated beacon that is currently detected in the operational area. Refinements of the SACCH scanning technique can reduce the scan requirements. For example, the receiver may ignore the SACCH signaling associated with beacons other than the strongest beacon and beacons whose signals are above a certain threshold in relation to the strongest beacon.

While the SACCH timing is perfectly predictable, the slot and channel on which the wireless device is hopping is not. A GSM burst lasts for 577 uS and will be in one (yet to be determined) of the 8 slots of the 4.6 mS frame being scanned. Since the receiver of the preferred embodiment can tune within 100 uS, it can look for energy at least 5 times per slot (1904). (5 dwells). Since each dwell can search 5 MHz (i.e., the bandwidth of the receiver), the receiver can, by implication, scan a single slot across 25 MHz (i.e., five 5 MHz dwells). By extension, the receiver can sustain a scan on single frame (all eight slots) across 25 MHz. This therefore implies that the receiver can scan the entire worst case 75 MHz reverse link in approximately 360 mS (every ⅓ second or 3 times per second) (1905). This number represents the time the surgical neutralizing system requires to detect a wireless device. The derivation of the number further makes clear that the time to detect the wireless device is directly related to the receiver bandwidth and tuning speed. Increasing either decreases the time required to detect the wireless device.

There are several problems with this scheme as presented. They are enumerated below with a description of how they are addressed by the surgical neutralizing system.

Frequency Hopping Coverage—Because of the paucity of SACCH frames it can take several seconds to collect enough frames to form a coverage histogram for most or all of the hopping channels and/or converge to a hopping set solution. For example there are approximately 8 SACCH frames per second and frequency hopping can operate across as many as 64 channels. The SID information on the TCH is also available for detection, but has an unpredictable phase.

Solutions to the problem posed by the paucity of SACCH information include searching for SID information directly on the reverse channel and camping on the forward channels waiting for the wireless device to come out of DTX while collecting the same SID/SACCH information. The following observations apply to either approach:

- The GSM standard dictates that the maximum frequency hopping span cannot exceed 25 MHz.
- The forward and reverse links use the same frequency hopping channels and time slots (albeit delayed by three slots).
- Once the SID frames have been detected (i.e., their phase in the multiframe), they have a perfectly predictable periodicity.
- A priori knowledge of the beacon's HSN and the hopping set dramatically limits the total search space.

Reverse SACCH/SID Detection

In reverse SID detection, it is presumed that the wireless device is not likely to come out of DTX. Consequently, the receiver must rely strictly on SACCH and SID detection to fill in the hopping set histogram. The receiver takes advantage of the fact that there are a combination of at least 32 frames of SACCH and SID over a period of one second. Because this is so, the receiver can immediately dwell on the part of the spectrum where the original SACCH was detected for a period of 160 mS (the SID periodicity) (1906) to determine the timing of the SID and then use this to subsequently schedule scanning on both the SACCHs and SIDs as to discern the hopping set. From this may be seen that that the total time to suppress the wireless device in the preferred embodiment will be on the order of 1360 mS after initial detection. One benefit of this detection scheme is that having the receiver remain on the reverse link requires less sensitivity in the receiver, since any wireless device that is a threat to the convoy must be in close proximity to the receiver. It also requires less intense scheduling than the forward link solution described below. However it has the potential drawback that the hopping set may not be found quickly enough to suppress the forward link before the wireless device comes out of DTX and can detonate the device.

Forward SACCH/SID/Activity

The forward SACCH/SID/Activity solution performs the same SACCH and SID detection but does it on the forward link. It is also presumes that forward channel is operating in a DTX mode prior to the onset of detonation signaling. Therefore it has the added burden of allocating sufficient resources to perform an intense scan of the forward channels so as to rapidly formulate the histogram as soon as the forward link comes out of DTX. However, one benefit is that this can be used to minimize collateral interference by not molesting cell devices that remain in DTX, as they are not able to act as detonators in that mode.

The surgical neutralizing system must also deal with the conflict on the forward link that arises because the receiver is attempting to formulate and update the activity histogram of the signal while the generator is actively attempting to suppress the same signal. The problem is solved by using surgical generation techniques to attack only the TSC. The TSC comprises only 10% of the signal burst in the time slot. This leaves 90% of the burst in the time slot open to detection by the receiver, and this is more than adequate. Because the receiver and generator are synchronized by the artificial beacon, the receiver is able to determine the part of the burst that contains the TSC and avoid that part of it.

In either approach, once the first SACCH is detected, the receiver scans 25 MHz centered around the channel in which the detection occurs, as the standard limits hopping to no more than a 25 MHz span. As the activity histogram fills in, the receiver dynamically re-centers itself around the mode of the histogram to better refine the search. This technique is further refined when the surgical neutralizing system has determined the hopping set a priori. In that case, only the channels in the hopping set are scanned.

If either link is not in DTX or other subscribers are active (and presumably using the same hopping set), the problem is simpler, since in that case, the receiver will have already identified the hopping set.

Nothing precludes using either strategy or even a combination of both. The forward and reverse time slots are offset by three slots, which makes it possible for the receiver to flip back and forth between them if resources and scheduling permits. Flipping back and forth essentially doubles the number of frames that can be detected, and that should halve the time it takes the receiver to converge to a hopping set solution.

Wireless devices operating on hopping sets that straddles a 25 MHz dwell. In this case the wireless device detection is not guaranteed because it is possible that it is hopping out of phase with the dwell. A simple example is when the wireless device happens to hop into one 25 MHz dwell band while the receiver is dwelling on another and then hops back into the current dwell band when the receiver moves on to the next dwell band. The receiver solves this problem by staggering the center frequency the 25 MHz dwell bands on each sweep through the band (2009). Staggering the center frequency increases the worst case time to detect a wireless device in the preferred embodiment to 360×2=720 mS.

Figure 20:
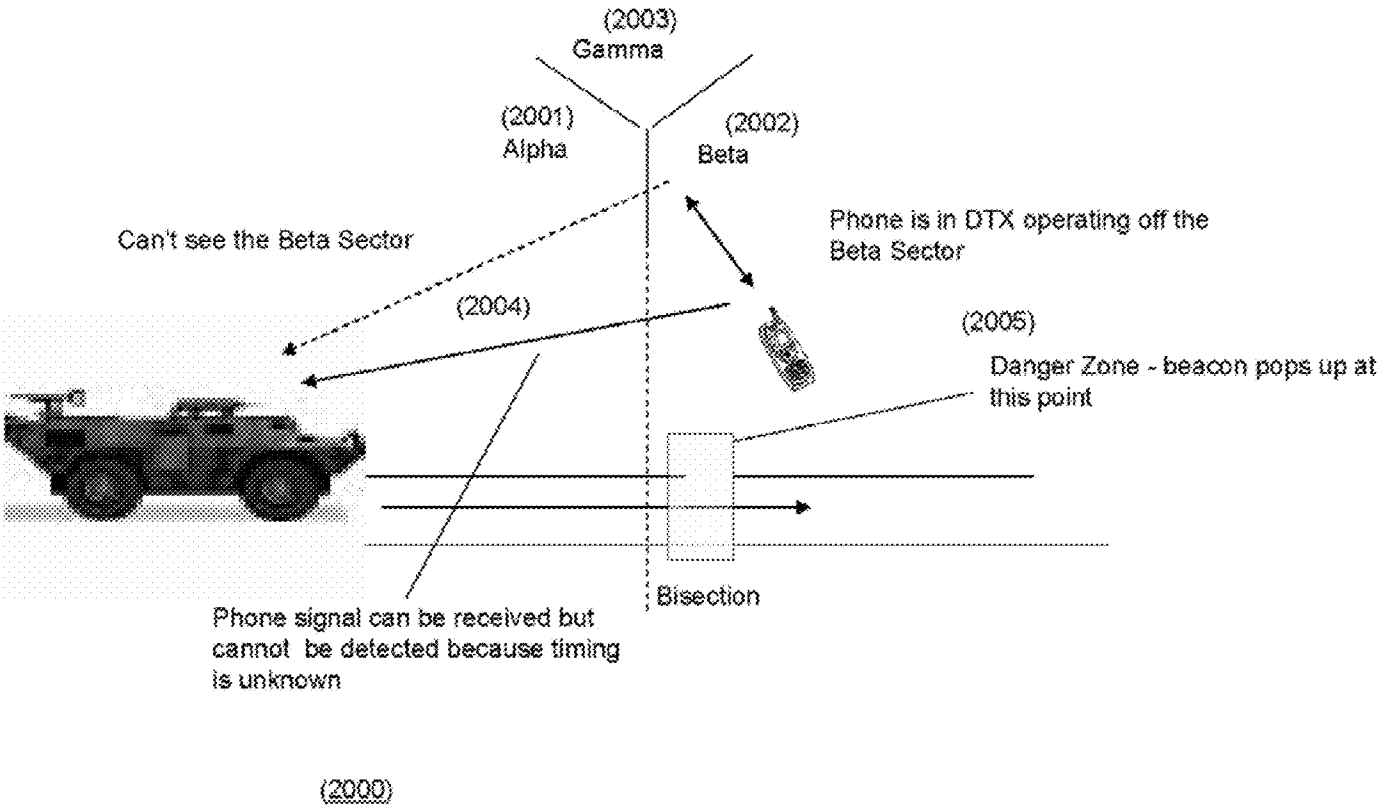
FIG. 20 presents a worst-case problem of wireless device neutralization.

Sector Blinding—The worst case for detecting a wireless device is shown at 2000 in FIG. 20. It shows a very common tower configuration having three sectors denoted alpha, beta and gamma (2001, 2002 and 2003) where the boundary between the alpha and beta sectors bisects a highway that passes by the tower in close proximity. As the convoy moves down the highway from left to right in the diagram it has detected the beacon operating off of the alpha sector but is blinded to the beacon operating off of the beta sector (2004). Meanwhile the wireless device is operating off of the beta sector just to the right of the bisection (2005). The wireless device is in high proximity to the tower (making a forward link attack difficult to mount and a reverse link attack futile) and it is already active and operating in DTX mode waiting for a detonation signal to come down on the forward link.

A direct solution to this problem would be to apply heroic receivers that can constantly and simultaneously sample the entire 75 MHz band and can therefore detect energy anywhere at any time (i.e., without regard to any beacon timing). This would as a minimum quadruple the cost of the surgical neutralizing system due to the amount of signal processing resources that would be required to sift the data and double it yet again because another receiver would have to deployed on the forward link to operate in parallel with the receiver operating on the reverse link, rather than time duplexing a single receiver.

The solution to the problem shown in FIG. 20 takes the following into account:

Exposure Time—The amount of time the convoy will be exposed will be equal to the amount of time it takes for the receiver to detect (and thereafter time) the beacon as it crosses from the alpha into the beta sector plus the amount of time it takes to detect the first SACCH that is timed to that newly detected beacon on the beta sector. The receiver of the preferred embodiment will detect and time a new beacon within 100 mS and the maximum SACCH detection time is 120 mS thereafter for a total of 220 mS. At a maximum speed of 100 feet per second this corresponds to approximately 20 feet of exposure.

Common Timing—The problem is often mitigated by the custom of using the same timing for all of the sectors on a tower so there is a strong probability that the receiver will pick up the SACCH signaling of the wireless device even though it cannot detect the beta sector beacon New Beacon Power Spiking—A new beacon will appear with a dramatic power spike as the convoy crosses from the alpha to beta sectors.

Service Provider Subbands.—Service providers typically operate within some fixed sub-band that cannot exceed 25 MHz. This means that it is very unlikely that a service provider will for example have a beacon on one end of the entire band and hopping channels on the band's other end.

DTX to Activity Time—As per above there is a 220 mS window of opportunity for the user to send the signaling. Any time it takes for the network to come out of DTX must be included within this window, High Proximity—The convoy will be in higher proximity to the wireless device than the tower when the wireless device is detected so the power levels output by the surgical neutralizing system will be able to overcome that of the tower.

The surgical neutralizing system operates by first noting the timing of the newly detected beacon and if it matches that of another active beacon, then the presumption is that this wireless device was already picked up as a matter of course and hence no additional action need be taken. If the new beacon timing is unique and the signal power is immediately large, the surgical neutralizing system will enter a panic mode that diverts all available resources to attack the forward channel on 25 MHz surrounding the beacon to give the receiver time to form a hopping histogram (a few seconds) on the reverse link.

If no SACCH is detected within 120 mS it is presumed that there is no active signaling and the panic attack is ended immediately. In the preferred embodiment, this approach reduces the exposure time to no more than $1/10^{th}$ of a second or about 10 feet.

Refinements of the surgical neutralizing system include:

Increasing Power Detection—The surgical neutralizing system can take advantage of the fact that the signal power dissipates as the inverse of the square of the distance from the transmitter. This means that the detected power coming from the wireless device will increase non-linearly as the convoy approaches it. The surgical neutralizing system therefore can use this fact to reduce false alarms by noting whether detected energy is rapidly increasing in power. This can be further refined by using the accelerometer or the GPS receiver to adjusting the thresholds for the effect based on the speed of the convoy. For example a static convoy would increase the detection threshold while a moving convoy might decrease it.

Doppler Detection—The surgical neutralizing system can using Doppler information to detect when it is approaching a wireless device. The purpose is to use this information to minimize false alarms. All beacons provide a tone burst on what is termed the frequency correction channel or FCCH. The purpose is to calibrate the wireless device carrier frequency tuning. By detecting the FCCH the surgical neutralizing system can predict the precise frequency expected by a wireless device operating off of that beacon and hence can detect a frequency shift (Doppler effect) associated with the convoy moving relative to the wireless device. For example at the carrier frequencies commonly expected by this surgical neutralizing system, Doppler shifts of a few hundred Hz can be created depending on the velocity of the convoy relative to the wireless device.

Transmitter Subsystem Design And Operation

Figure 21:
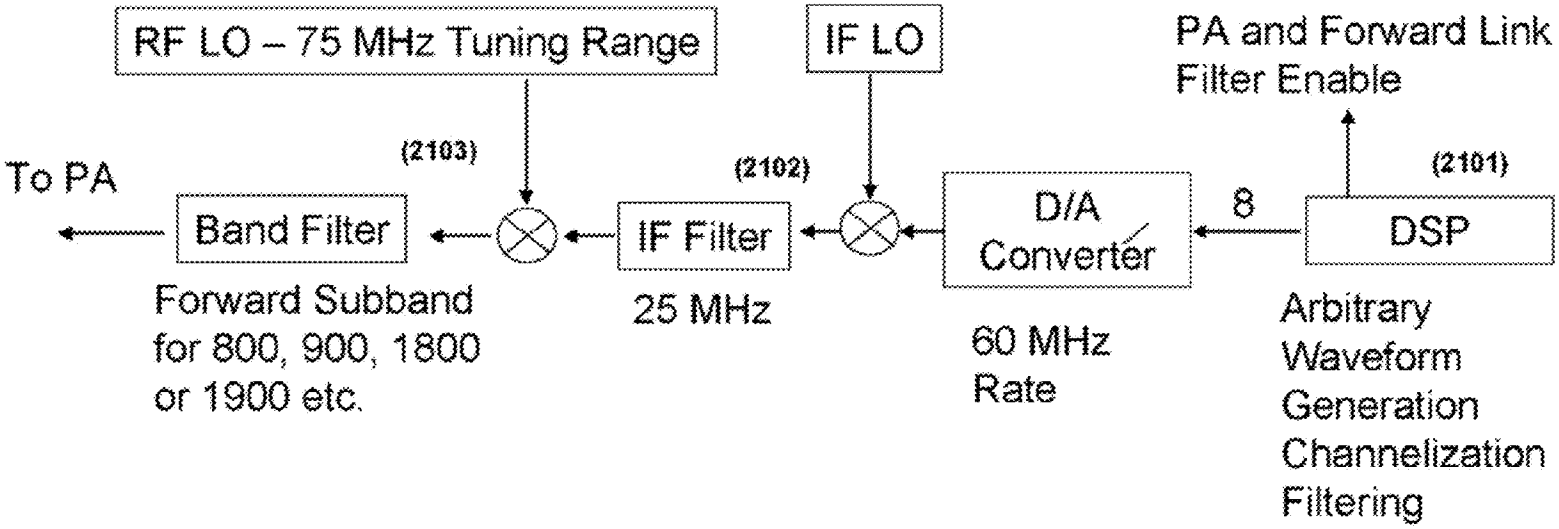
FIG. 21 is a detailed block diagram of a generator.

The combination of the generator and the RF circuitry used to switch and amplify the signal is collectively referred to as the transmitter. The preferred embodiment is shown previously in FIG. 5 and the details of the generation subsystem are shown in FIG. 21. The transmitter consists of a baseband generator (2101), IF (2102) RF (2103) upconverters, a power amplifier and the necessary RF coupling circuitry to combine signals from multiple transmitters for transmission at the antenna as well as to receive signals simultaneously from the same antenna for distribution to the receiver. The transmitter hardware is repeated for every band of operation (e.g., 800, 900, 1800 or 1900 MHz).

The power amplifier receives a signal from the generator that controls whether the power amplifier is on or off. The power amplifier is capable of reaching full power within 1 uS of the application of the control signal and will return to zero power within 1 uS of the end of the control signal. This same signal is used to switch off the forward link receive signal path so as to protect the receiver circuitry. When this switch is in the off position the receiver is essentially blinded to the RF environment. The receiver must thus be able to adequate detection in a timely fashion while being periodically blanked—refer to Combined Subsystem Operation and Scheduling.

The surgical neutralizing system's power amplifier is likely to be the single largest item in the system's power consumption budget. It is crucial to the system's power consumption that it is able to rapidly turn the amplifier on and off. As described previously this feature of the amplifier enables the surgical neutralizing system to realize power savings of a factor of 1000 or more over conventional suppression systems. Because the system generally requires high power over relatively short periods of time, the surgical neutralizing system also employs a discharge circuit (typically consisting of a diode and capacitor) to smooth out the power consumption.

The transmitter also controls the switch for injecting the artificial beacon into the receiver signal path. The transmitter injects the beacon on demand on some channel when requested by the receiver and responds to the request when it can schedule a hole in the generation tasking. Once the receiver detects the beacon (and thereby recovers the timing) it will direct the generator to cease generating the beacon.

The generator consists of a Digital Signal Processor (DSP) (2101) capable of creating 8 independent arbitrary waveforms, each up to 5 MHz wide (e.g. W-CDMA), that are tunable across 25 MHz and implicitly locked to any beacon timing via the previously described artificial beacon loopback method. Timing for each individual beacon is known to within 1 uS as it is seen in the air. Nothing in the surgical neutralizing system precludes adding more waveform generators if they are needed, as the waveforms produced by the additional generators are combined digitally with the waveforms produced by the existing waveforms.

The generator applies the waveform attack strategies described previously under the heading of specific attack techniques. A preferred embodiment of the surgical neutralizing system employs three types of waveforms in arbitrary combinations—a GSM TSC override waveform operating on from 1 to 6 frequency contiguous channels having between a 200 kHz and 1.2 MHz of bandwidth; a tone snippet waveform that lasts from 1 to N GMSK symbols as defined programmatically that allows individually selected GMSK symbols to be attacked; and a medium band white noise signal such as CDMA. When attacking non-hopped signals such as would be seen on the paging channels (proactive idle mode) or SDCCHs (reactive idle mode), a focused single channel GSM TSC attack is used. A multiple channel GSM TSC attack is used when attacking active mode hoppers. If and when the hopping sequence is determined, the attack can switch to tone snippets which can perform either a stealing bit attack or a convolutional encoder attack by targeting specific bits in the GMSK burst. While the surgical neutralizing system can generate wider-band signals (as noted above) and hence suppress wider swaths of bandwidth, this comes at the price of significantly decreased power efficiency, as the suppression may not necessarily be well tailored to the hopping channels—for example spread across parts of spectrum that are not used by the signal under attack. Furthermore, since the energy is now spread across many more channels, the power applied to any given channel is now diluted and hence additional power must be applied to the signal as a whole in order to ensure that a hop on any given channel is suppressed. Therefore the surgical neutralizing system uses the hopping histogram to tailor the number of channels employed by a waveform generator. The tailoring allows the system to more efficiently allocate the number of waveform generators as well as the number of channels that waveforms are generated for.

The TSC and tone snippet attacks are used when the signal timing is known. In the rare case when the signal timing is not known (e.g., there are no signals detected by the receiver), then multiple CDMA noise like signals are used to sweep the entire band simultaneously at low power levels. This finds its primary use in addressing the case where the surgical neutralizing system may be in position such that it is in a fade and cannot detect a weak beacon whereas the wireless device is in a position where it is not in a fade and hence can detect the beacon.

Each signal generator can be independently turned on or off within 1 uS, which allows the signal generators to operate in a highly surgical fashion. Each signal generator can also enable the aforementioned power amplifier control signal. Therefore the control signal is the 'wired-or' of all 8 signals such that if any of the signals is on, the power amplifier remains on.

Multiple threats may require the generator to cover more than 25 MHz at a time—for example two different wireless devices operating on either side of the 75 MHz band. This necessitates that the generator be multiplexed between the two wireless devices. The generator, like the receiver can be tuned between 25 MHz swaths of bands within 100 uS. Therefore it has the agility to attack one signal and return to attack the other. If multiple subscribers are operating on different time slots in the same band then any given waveform generator simply extends the generation to cover those time slots.

Only in rare cases would the generator not be able to provide coverage—for example if the TSCs of the signals under attack on either end of the band overlap. This is expected to be unlikely in general, because the two signals in question would not be operated by the same service provider and would therefore likely not be synchronized. Since the TSC attack only occupies 50 uS out of each 4.6 mS frame (approximately 1%), then the probability of overlap in the active case is 0.1%. Should this case arise, the generator can resort to attacking every other frame while increasing the bandwidth of the attack. These two remedies cancel each other with respect to the random active mode attack, as the net frame corruption rate remains the same. The most notable drawback is the necessary increase in peak power to compensate for the increase in spectral spreading. In the case of the reactive idle mode attack, the likelihood of collision is even smaller, as not only do the TSCs have to line up, but the frames in which they are occurring must also be coincident. Even in this highly unlikely case, the generator can resort again to attacking every other frame such an attack is sufficient to keep the signaling from consummating the call setup.

Combined Subsystem Operation and Scheduling

The foregoing descriptions do not expressly address the need to account for scheduling of the receiver and how this may be affected by ongoing operations of the generator. The following describes how the surgical neutralizing system coordinates all of the individual requirements particularly as it relates to scheduling including how potential conflicts are resolved.

Figure 22:
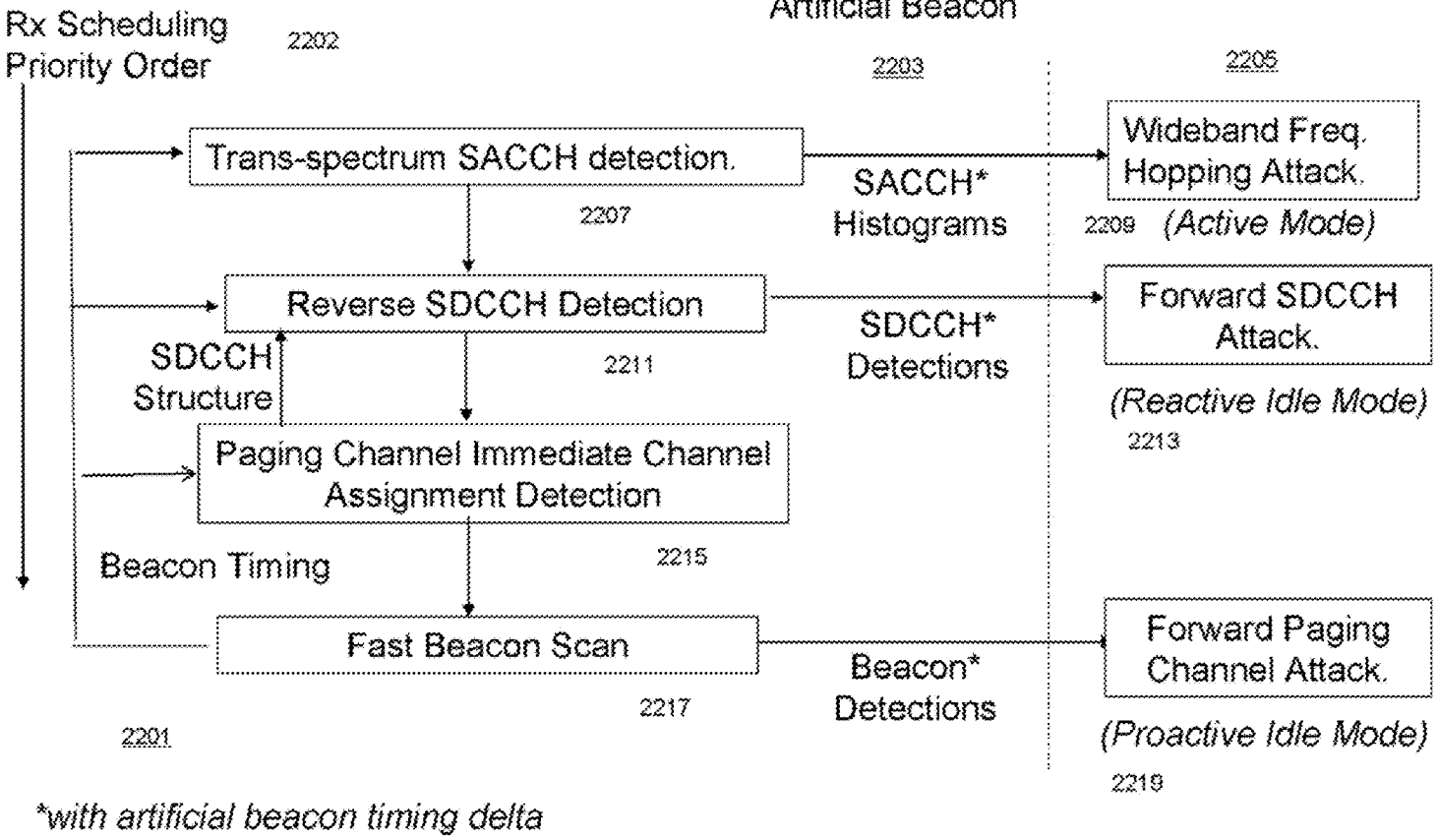
FIG. 22 is a diagram of scheduling in the preferred embodiment of the surgical neutralization system.

FIG. 22 shows the control flow (2201) between the receiver and the generator. The receiver acts as an event pump. The only assumption that the receiver makes concerning the generator is that the generator will be active on some known portion of the signal. In some modes of operation, the receiver will consequently avoid making measurements during that portion of the signal. Otherwise the receiver makes measurements with the understanding that it may be blanked by the generator from time to time while receiving signals on the forward link. The generator on the other hand must regularly schedule holes in the generation whenever it is active for sustained periods of time.

The priority (2202) for receiver resources (2203) is listed below with highest first.

- Trans-spectrum SACCH detection (2207)—Schedules a SACCH detection on the reverse channels every 26 frames for every currently detected beacon across 25 MHz. Round robin scheduling on sets of 25 MHz to cover up to 75 MHz—refined based on any hopping set information.
- Reverse SDCCH detection (2211)—Detect signaling on all reverse SDCCHs where the timing has been established.
- Paging Channel Immediate Channel Assignment Message Detection (2215)—Monitor all paging channels on the forward link of a newly detected beacon until the first immediate channel assignment message is detected.
- Fast Beacon Scan (2217)—operates by default (in the background) when none of the foregoing processes are in progress.

The surgical neutralizing system takes into account the fact that there may be conflicts when one or more beacons are scheduled for SDCCH structure detection (2207) at the same time that reverse SACCH detection (2211) is scheduled on the reverse channel. The surgical neutralizing system solves this problem by giving reverse SACCH detection (2211) precedence over the paging channel immediate channel assignment detection (2215) and instead directs the generator to attack the paging channel(s) (2219)—in essence attacking what it cannot schedule for detection. At worst this potentially delays the detection of a candidate immediate channel assignment message on some beacon under scrutiny while ensuring that the message cannot slip through to the wireless device.

The surgical neutralizing system also addresses the case where SDCCH structure detection is pending across multiple beacons by extending the principle of attacking what cannot be detected and listening in a round-robin fashion on each of the candidate frequency channels as scheduling permits. This same principle extends to the common (and worst case) scenario when one or more newly identified beacons have identical timing such as might be seen on multiple sectors operating on the same tower. In this case, the receiver of the preferred embodiment may not be capable of monitoring all of the paging channels simultaneously if the channel separation of the paging channels is more than 5 MHz. In this case, too the surgical neutralizing system resorts to attacking what it cannot schedule for detection.

Upon detection of a threatening signal, the receiver creates an event message that includes (but is not limited to) the following information and sends it to the generator:

- Type: SDCCH or TCH (i.e., an idle mode call set up or active traffic)
- Governing Beacon—which beacon the threat is operating of.
- Hopping Information (as it becomes known) including:
  - Hopping channel set, hopping sequence number (HSN), mobile allocation index offset (MAIO), current detection histogram.

The receiver will continue to issue these events and update the information listed above as it evolves (typically every second). If the threat subsides the messages simply stop coming and the generator will remove the threat from its attack list.

The generator for its part reacts to the energy detection reports and decides how best to deploy resources to attack the signals reported therein. The reaction is based on whether the unit is operating in convoy or static mode, which in turn is governed by whether the convoy is on the move or has remained stationary for an appreciable period of time as detected either by the GPS receiver or the accelerometer. In static mode, the generator operates in proactive or reactive idle mode and in convoy mode, the generator operates in active mode. Thus, when the receiver is performing transspectrum SACCH detection (2207) in convoy mode, the generator is performing a wideband frequency hopping attack (2209) based on the SACCH histograms. When the receiver is performing reverse SDCCH detection (2211) in static mode, the generator is performing a forward SDCCH attack (2213) based on the detected SDCCH channels and when the receiver The only constraint on the generators is that they must be sensitive to the needs of the receiver to gain regular access to the forward channels in a timely fashion to perform such tasks as new beacon or SDCCH structure detection. Therefore the generators must regularly schedule holes whenever transmitting. The surgical neutralizing system can achieve this because the receiver expressly provides the timing of all detected beacons relative to the artificial timing beacon. The generators can be set up to use the artificial beacon and the timing information to cease jamming at times when the receiver is performing a forward channel scan. For example, the SACCH frames do not contain any signaling information which can be used in the wireless device to cause an explosive device to detonate. The receiver can, however, use the SACCH frames to determine the wireless device's hopping sequence. Consequently, in a preferred embodiment, the generator is set up so that it does not jam the SACCH frames.

It is thus the waveform timing of detected signals as opposed to any receiver design constraints, requirements, or even implementation, that moderates the allocation of resources such as access to the forward channels. This vastly simplifies the interaction between receiver and generator and also affords the generator complete latitude in deciding how best to attack the signal. Any generation in progress takes precedence because the generator must be presumed to be actively neutralizing an immediate threat. For example the generator may elect to defer opening a hole for the receiver to a point in time where the threat is diminished or is perhaps easier to schedule.

An immediate objection to this design choice is that the generator may be able to completely starve the receiver in some modes of operation. For example a "detected" beacon cannot be subsequently "characterized" in a timely fashion because its timing is such that it coincides or otherwise overlaps with the timing of another beacon that is under attack. However in these circumstances the generator falls back on the principle of attacking what cannot be characterized until such time that it can safely schedule access to the forward channel.

Detecting Cellular Telephone Environments when Interoperating with Timed Interferers The enhancements described in the following sections apply the techniques of the parent in environments in which the receiver belonging to the surgical interference system is operating with interferers that have timed holes in their interference signals. The enhancements exploit the holes that are made available for purposes of reactive interfering to receive information about the cellular environment and to stitch together the information which is available during the holes so as to characterize the entire cellular environment in real or near real-time. While this has the distinct disadvantage of taking longer than the direct cancellation method, the techniques guarantee that the during the hole time the receiver will have unhindered access to the spectrum. Consequently, neither heroic calibration nor heroic processing is required. Furthermore a number of short cuts are described which make it possible to rival the cancellation approach as measured by the time it takes to achieve effective force protection once an area with potentially hostile wireless devices is entered. Also described are techniques for automatically discovering the holes in the interferer, making it possible to interoperate with non-collocated interferers that have arbitrarily-timed holes. The detailed applications of the techniques are dependent on the cellular standard of interest and therefore applications for both GSM and CDMA are described.

GSM Beacon Acquisition

If the reason that information about a GSM beacon is being acquired is to subsequently detect and suppress individual GSM wireless devices, the techniques require that the surgical receiver have access to at least the System Information 1 message that identifies the mobile allocation (MA) used by the beacon. The mobile allocation is a list of all the frequency channels (Absolute Radio Frequency Channel Numbers—ARFCNs) on which a GSM wireless device will hop when allocated a traffic channel. This information, when combined with the slot, mobile allocation index offset, MAIO, HSN (acquired by direct detection of reverse channel signaling as described in PCT patent application PCT/US2007/063493) and the frame number SCH, uniquely identifies the hopping sequence of the wireless device with regard to both frequencies and timing.

Figure 23:
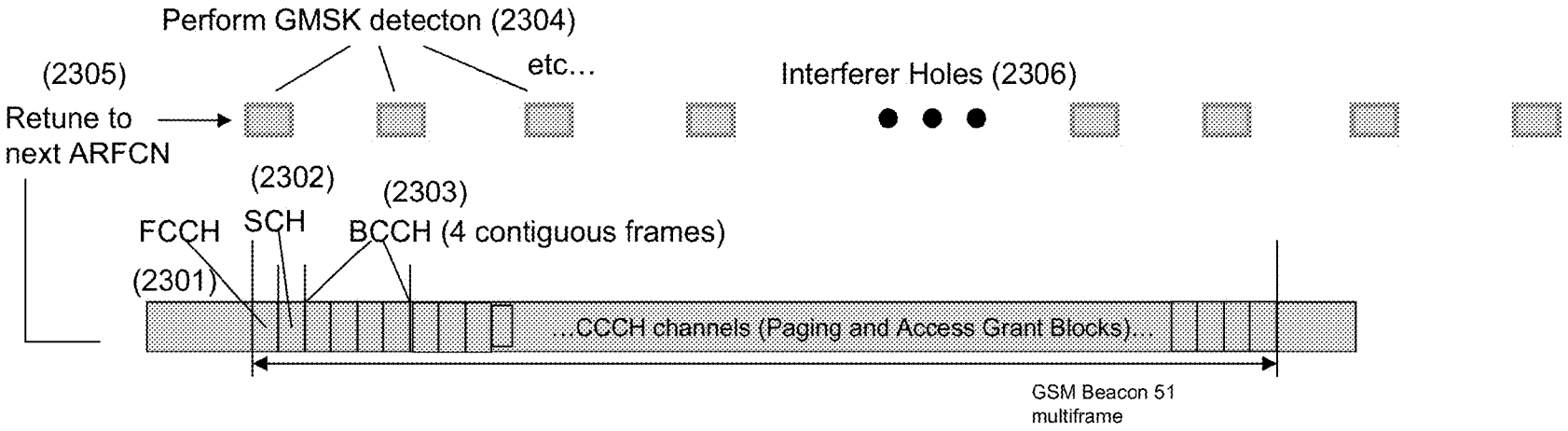
FIG. 23 is a diagram of how holes in an interferer's signal overlap with frames in a GSM beacon multi frame.

FIG. 23 shows the GSM beacon structure. The surgical receiver requires access to the FCCH, the SCH and the BCCH frames. From the FCCH (2301) and SCH (2302) frames, the receiver acquires timing and from the BCCH (2303) frames the receiver acquires the System Information messages.

The first step (2303) of the method is to scan the forward cellular band to search for beacons. The method times the interferer holes (2306) and performs a GMSK modulation identification (2304) as described in PCT patent application PCT/US2007/063493 on one (or more channels as hardware resources permit) within the holes to identify candidate beacons. It exploits the fact that beacons, unlike subscriber traffic, necessarily broadcast GMSK modulation constantly. The technique is therefore not required to align the listening done by the receiver to any timing that is defined in the beacon itself and the receiver can do the listening in any available interferer. The method (2305) retunes to the next GSM channel(s) and waits for the next available hole to repeat the process until the entire band (or a programmed subset thereof) is scanned. While the latency of this process is dependent on the frequency of occurrence of the holes 2306, typical periodicities on the order of 10 s of milliseconds will enable scanning of an entire cellular band within less than a few seconds.

Figure 24:
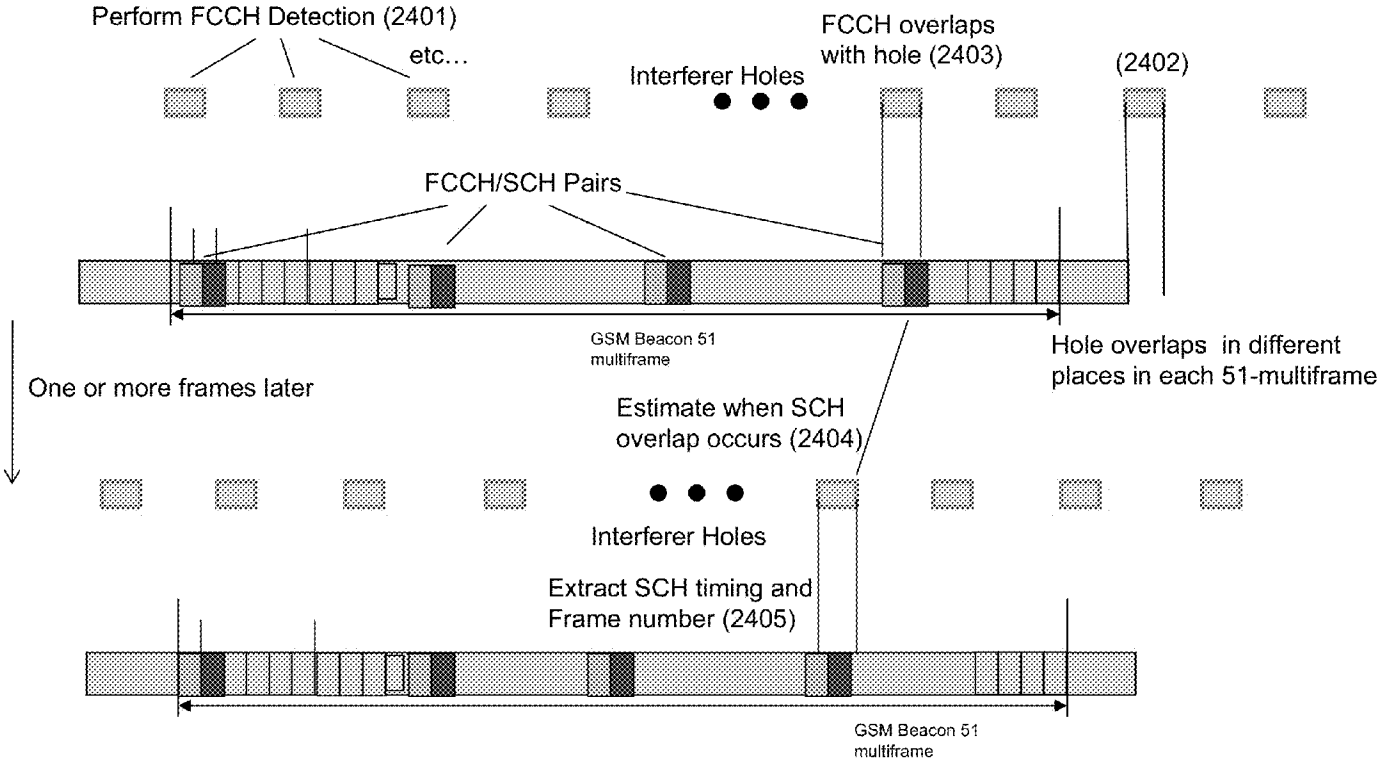
FIG. 24 shows how the holes in an interferer's signal can be used to extract the SCH timing and frame number from a GSM beacon.

Once a set of candidate beacon channels is compiled, the method proceeds to step two as shown in FIG. 24 wherein each candidate channel is scanned for FCCH and SCH frames. The method opportunistically searches each candidate channel for FCCH bursts during all available holes because the beacon timing has yet to be established (2401). As can be deduced from (2402), the timing of the FCCH bursts as established by the 51 multiframe of the beacon does not in general coincide with the timing of a regularly periodic interference hole. This guarantees that an FCCH burst will eventually overlap with an interferer hole 2306 to a degree sufficient to permit detection of the FCCH burst (2403). The rate at which the hole and the burst will overlap is again dictated by the periodicity of the interference holes, but for anticipated interference hole periodicities this process normally acquires the FCCH within a second or two. As part of the FCCH detection, the timing for the SCH burst that follows is estimated (2404) and the method subsequently predicts when the timing of the interferer hole and the SCH will next overlap. Again the acquisition process takes not more than a second for anticipated interferer whole periodicity. Once the SCH burst is acquired (2405), the frame timing and the frame number are known and therefore the beacon frame timing and the overall timing structure (i.e., the 51 multiframe) are known. With this information it is now possible to acquire the beacon system information messages that are essential to detecting phones for purposes of threat detection and/or suppression as well as any subsequent interrogation.

Figure 25:
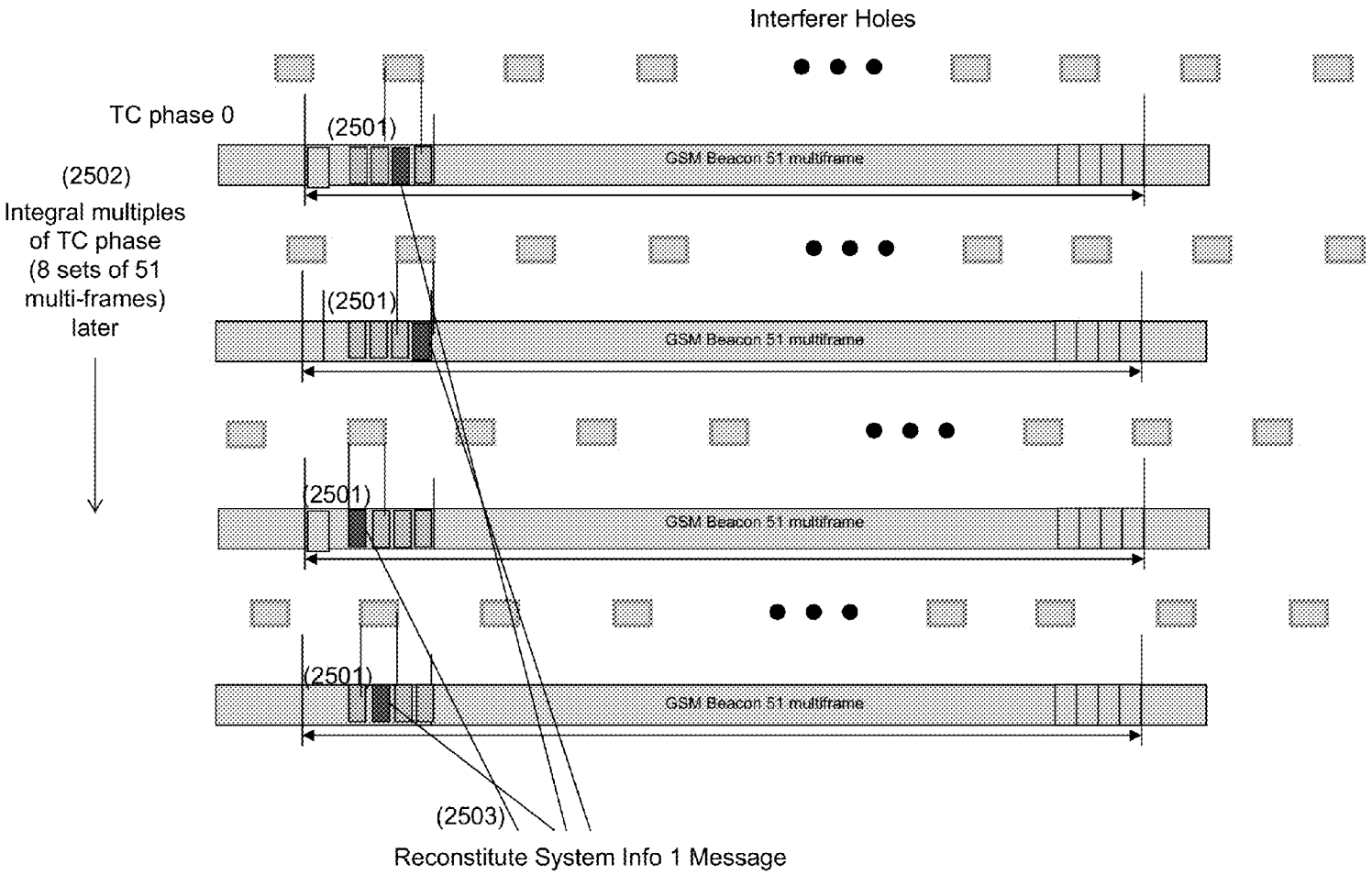
FIG. 25 shows how the holes in an interferer's signal can be used to reconstitute the System Info 1 message from a GSM beacon.

Having acquired the frame timing and structure in step 2, the method proceeds to step 3 as shown in FIG. 25 where it recovers the system information messages carried in the BCCH frames of the 51 multiframe. Here the method exploits the fact that while the messages are distributed across the 4 BCCH frames within the 51 multiframe (2501), the contents of the messages are static. Further still, the messages are explicitly timed to occur in a set pattern within every 8 sets of 51 multiframes, as shown in (2502) and described in ETSI 45.002 Section 6.3.1.3. Because the messages are explicitly timed and have a set pattern, the technique can determine which message a particular collected frame belongs to. This makes it is possible for the method to operate in an opportunistic manner and collect and store, without regard to order, a BCCH frame whenever it aligns with an interferer hole and then stitch together the messages post facto. As shown in (2503), the system information 1 message can be reconstituted by stitching together the 4 BCCH frames that were collected in completely disparate 51 multiframes that were collected when the TC phase is equal to 0. Similarly the system information 2 message is reconstituted by stitching together those frames collected when the TC phase is 1.

The worst case acquisition time is dictated by the time it takes to collect the BCCH frames, which have a far longer period thane the FCCH and SCH. An example using round numbers would be a timing protocol that allows an interferer hole of 1 mS followed by 9 mS of jamming time. The messages of greatest interest are System Information Messages 1 and 3 which only occur every 8 and 4 51-multiframes (2505), respectively (TC=0 and TCs=3 and 6, respectively—see ETSI 45.002 Section 6.3.1.3. It well understood as described previously and from a reading of the standards that the messages will necessarily appear in distinctly different TC phases and 51 multiframes therein making it possible to collect (almost) all of the messages essentially simultaneously. Using the whole size and frequency of the above example, the System Information message 1 would require an acquisition time of approximately 25 seconds after the beacon is detected and the FCCH and SCH channels are acquired. The total acquisition time of an individual beacon $T_a$ is computed below:

$$T_a = T_G + T_{fx} + M_{51} * P_m * T_{tc}$$

where $T_G$=time to perform GMSK detection <1 s $T_{fs}$=time to acquire FCCH and SCH channels <2 s $M_{51}$=GSM 51 multiframe period=0.235 s $P_m$=frame periodicity modulo the gap repeat period=13 (using 10 mS gap repeat period—i.e., every 13 frames aligns with an integral multiple of 10 mS=60 mS)

Ttc=period (in multiframes) of the TC interval between message repeats=8.

The above calculation suggests that it requires on the order of 30 seconds total to acquire the necessary beacon information from scratch such that the hopping sequence of any phone signaling in proximity can be resolved and therefore either characterized as threatening using DTX detection techniques and/or subsequently attacked using surgical techniques. The remaining system information messages of interest generally have a repeat period less than or equal to that of system information 1 so that beacon can be characterized nearly in its entirety in this time period. This includes acquiring the System Information 2 message that contains the neighbor list and is thus important in any subsequent interrogation. However other messages, such as system information 13 (which often broadcasts the hopping sequence number that is critical for dehopping a phone) have a longer periodicity in the GSM signal and may require perhaps a minute or more to acquire based on the beacon configuration. While this lack of timeliness might delay the onset of detecting the hopping sequence of a phone it can be obviated in the receiver with automatic hopping sequence detection as described in PCT/US2007/063493 performed directly on the first encountered phone operating off of the beacon in question. The hopping sequence information eventually gleaned from system information 13 can then be used to either corroborate (or correct if it was erroneously computed) the calculation of the hopping sequence number.

Figure 26:
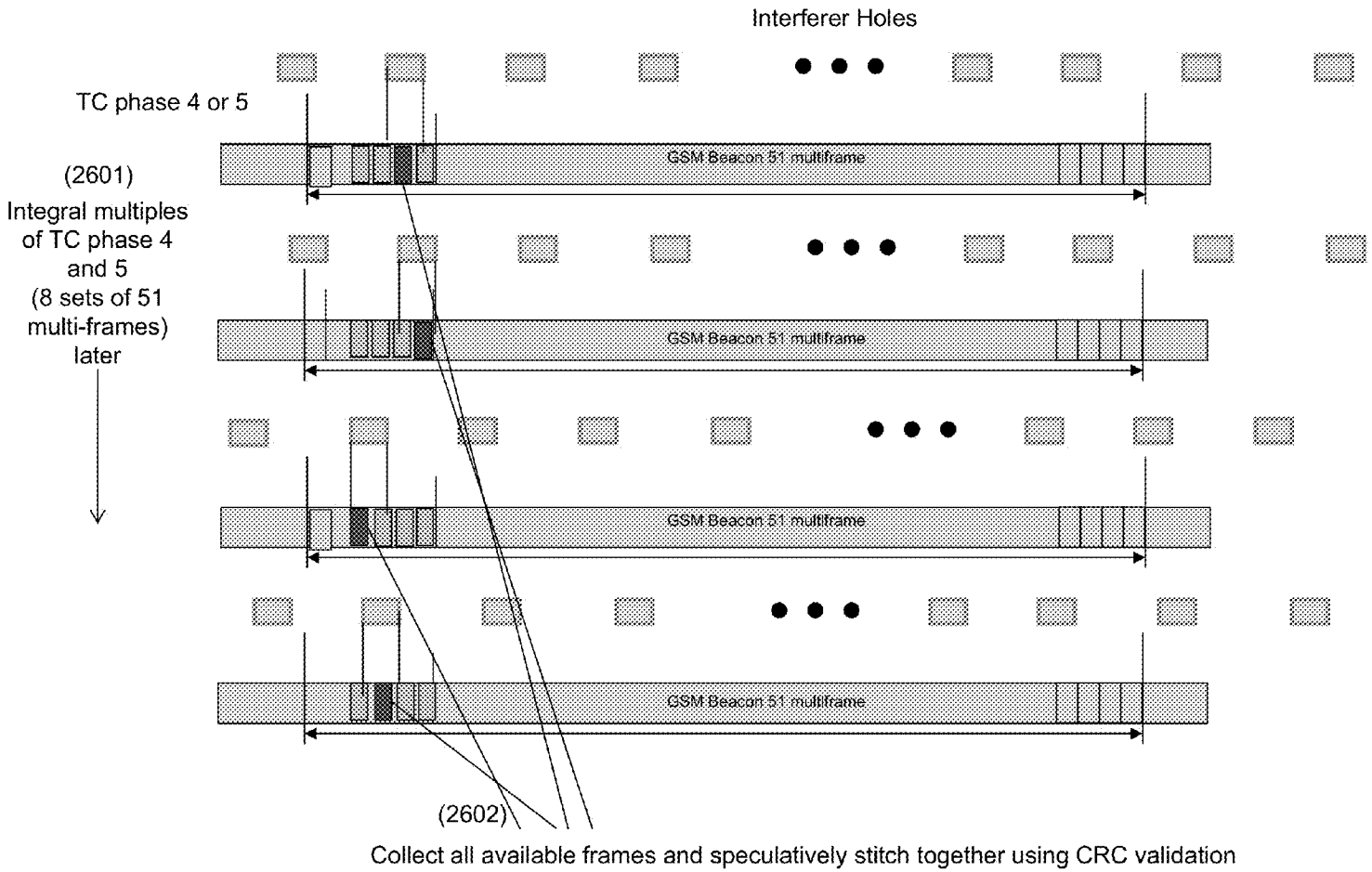
FIG. 26 shows how the holes in an interferer's signal can be used to read TC phase 4 or 5from a GSM beacon.

For purposes of completeness such as when the surgical interferer is used to perform a comprehensive survey of the cellular environment as opposed to immediate force protection, the method takes the further step of collecting all of the available system information messages. In this case messages such as system information 2ter or 2quater are time multiplexed as shown in FIG. 26 (2601) within the 51 multiframe TC structure. It is therefore no longer unambiguous as to when (where) these messages appear. Here the method performs hypothetical trial and error that attempts to stitch together multiple combinations of frames collected on TCs 4 and 5 and uses the CRC (Fire Code) attached to each message to validate any particular hypothesis (2602).

It is noted that nothing in this described method precludes acquiring all beacons in parallel presuming that sufficient receivers are available. From all of the above, it is apparent that an entire cellular band at some given location can be sufficiently characterized in as little as a half a minute.

GSM Semi-Blind Hopping Sequence Acquisition

The purpose of this technique is to drastically reduce the constraints imposed by the use of interferer holes to obtain information about a cellular environment on the length of time between when a beacon is detected and subsequently characterized within the constraints imposed by the limited acquisition windows and the time when threatening phones operating off of that beacon can be detected and/or neutralized. As described in the foregoing, when the surgical receiver uses holes to obtain the information, the time to acquire the system information message 13 used to resolve the hopping sequence of a phone requires on the order of 30 or more seconds when interoperating with the interferer. The alternative method reduces this time to a few seconds. It also has the added benefit of immediately identifying the SDCCH on which call set ups will occur (slot 1 of the beacon) and hence makes it possible to stop all call setup attempts without having to wait for additional beacon information.

Conventional detection of the hopping sequence of a phone requires six pieces of information:

1) the physical frame timing,
2) the frame number (FN),
3) the mobile allocation (MA),
3) the hopping sequence number (HSN),
4) the mobile allocation index offset (MAIO) and
5) the slot The physical frame timing and the FN are, derived from the SCH burst by correlating against the SCH TSC and then demodulating the burst to extract the reduced frame number, respectively. Once the timing has been recovered from the SCH, the slot is derived from direct energy detection on the phone itself by looking for guaranteed SACCH signaling on the uplink channels. The MA is an ordered list of the set of channels on which phones obeying the beacon will hop and is broadcast by the beacon in system information 1. The hopping sequence number can be obtained directly from the system information 13 if (optionally) broadcast by the beacon. If system information 13 is present and specifies the hopping sequence number, then a surgical receiver can immediately solve for the MAIO in on the first frequency hop frame that is detected, as that frame is necessarily unique by the design of the standard and hence the hopping sequence of the first and any subsequent phone is now known. In the absence of system information 13 a receiver can still simultaneously solve for the HSN and the MAIO by observing some number of frames over several seconds as described in PCT/US2007/063493.

However as described previously, since system information messages 1 and 13 (if it exists) can take from 30 to 60 or more seconds to acquire in the presence of a timed interference, there remains a dangerous gap in between when a beacon is detected (a potential threat arises) and when the hopping sequence (most importantly the HSN) is derived (the threat can be dealt with).

An alternative method is to forego the acquisition of the FCCH and BCCH and instead only acquire the SCH and from this derive the remaining hopping sequence information directly. The purpose of the FCCH is to allow wireless devices that do not have highly accurate frequency references to correct their tuning to match that of the beacon. However, since the preferred embodiment of the surgical receiver uses a GPS receiver to provide a highly accurate frequency reference, it becomes possible to search directly for the SCH information without the benefit of frequency correction. Here the method can simply search across the 1 mS interferer hole and correlate against the SCH training sequence directly. Notwithstanding the expected accuracy of the beacon frequency reference, the method also recognizes that it is still possible to somewhat compensate for any tuning error in the beacon by performing what is known in the art as cross-ambiguity function processing. Here the receiver simultaneously solves for the burst timing and frequency error by hypothesizing a range of discrete frequency errors (presumably narrowed by the precise GPS frequency reference), retuning the SCH training sequence for each hypothesized frequency error and then time correlating. This produces a two dimensional correlation function in time and frequency, the peak of which is deemed to the simultaneous solution of best estimate of the both the timing and the frequency error.

Once acquired, the timing of the reverse channel SACCH signaling of any phone operating off of a sector associated with this beacon is now known. By monitoring SACCH frames at times across the potential spectrum in which they will occur, it is possible using simple energy detection (or possibly making hypothetical correlations against the heretofore unknown set of possible TSCs) to identify the slot within the frame on which a phone is active. What remains to be derived is the hopping sequence itself of the first encountered phone. That phone's hopping sequence h is a function of the MA, the HSN and the MAIO for the phone. Since the MA and the HSN are obtained from system information messages 1 and 13 and are therefore unavailable in a timely fashion when the information is obtained by listening during interferer holes, the method resorts to solving for these missing bits of information by directly analyzing the detected hopping sequences.

The method makes the following critical observations:

The HSN and MA size each cannot exceed 64

The span of possible hypothesized MAIOs is equal to the hypothesized MA size.

The MA is necessarily specified in ascending ARFCN order due to restrictions in the System Information 1 message coding as per ETSI 44.018 Sections 9.1.31 and 10.5.2.1b The sequences produced by some combination of HSN, MAIO, MA size are a function of the frame numbering.

Implied in the observations is that the total candidate space for MAIOs, HSNs and MA sizes cannot exceed $64^3/2=128K$. Since the timing has been acquired from the SCH, the frame numbering and timing are known and it is therefore possible to time the occurrence of the SACCH on the reverse link—which is guaranteed regardless of signaling state (e.g., whether the wireless device is in DTX or not). Armed with this information it is possible to determine the HSN, MAIO and MA size without benefit of necessarily acquiring the complete MA directly from system information 1. More specifically the method takes advantage of the fact that the ordering of the MA is necessarily ascending. By comparing whether the ARFCN of a particular SACCH is greater than, less than or equal to the previous ARFCN on which the SACCH was signaling it is possible to converge to a solution for the HSN, MAIO and MA length simultaneously within some logarithmic time frame. For example given the 128K possible space ($2^{17}$) it could take as little as 17 SACCH frames (<2 seconds) to converge to a solution even though the observed set for the entire MA is incomplete. Once the MA size is known the method ceases acquiring data when it has detected that this number of ARFCNs have been identified as belonging to the MA.

The method recognizes that even in the absence of the complete MA, it is still possible, in the interim, to mount a focused attack that has a reasonable chance of success once the HSN is acquired. For example the attacks described in PCT patent application PCT/US2007/063493 require that only half the TCH frames need to be attacked to thwart DTMF signaling reaching the phone.

An important side effect is that once the HSN, MAIO and MA size have been determined it is possible to unambiguously assign the detected channels to the MA (due to frame number disambiguation) and therefore it becomes possible to extrapolate as yet discovered ARFCNs that are part of the MA. For example if it is known that ARFCNs 64 and 67 are entries 12 and 15 in the hopping set, respectively, then it is safe to assume that ARFCNs 65 and 66 are entries 13 and 14 due to the MA ordering constraint imposed by the GSM standard for the contents of the System Info 1 message.

The following example illustrates the technique. The MA consists of ARFCN channels 0 through 9 and wireless device is using HSN 1 MAIO 0 and the data was collected starting on Frame Number 12.

Below is an enumeration of the ARFCNs on next 64 SACCH frames that follow (i.e., every 26 frames thereafter).

5, 6, 8, 3, 7, 9, 8, 7, 3, 2, 4, 9, 0, 3, 1, 5, 5, 9, 2, 7, 1, 4, 1, 3, 4, 7, 1, 4, 2, 2, 2, 5, 6, 0, 5, 5, 8, 5, 6, 2, 9, 7, 2, 5, 5, 1, 5, 2, 3, 5, 8, 5, 8, 6, 6, 8, 3, 7, 0, 8, 7, 3, 2, 4 . . . .

The sequence of ARFCNs is transformed into a sequence of differential notations where U is an increase in channel number (up), D is a decrease (down) and R remains the same. It is therefore possible to create a unique signature without the benefit of complete knowledge of the actual ARFCN assignment within the MA.

UUDUUDDDDU etc. . . . (i.e., 6>5=U, 8>6=U, 3<8=D etc.)

The method matches this sequence against 128K potential sequences at the same frame numbers and then determines which combination of HSN, MAIO and MA size could Produce this signature.

Considering the first 18 SACCH frames above, it can be seen that not only are HSN, MAIO and MA size are determined but a complete MA is also obtained. However extracting another subsequence from above it is clear that had the method started on frame 740 and collected 18 frames as shown below, the sequence would look like this:

2, 2, 2, 5, 6, 0, 5, 5, 8, 5, 6, 2, 9, 7, 2, 5, 5, 1,

All but ARFCNs 3 and 4 are represented in the observed MA in the sequence above but we can extrapolate their membership in the MA because ARFCNs 2 and 5 are present and we know their positions in the MA as well as the size of the MA and hence ARFCNs 3 and 4 are implied.

It should be noted that in the technique, 128K up/down computations, representing the entire candidate HSN, MAIO and MA size space at any given frame number, must be performed and stored between successive occurrences of each SACCH in the beacon (approximately 100 mS) to keep up with the occurrences of the SACCH in real-time, but this is easily within the capabilities of most modern embedded digital signal processors. It is also noted that it is not necessary that each and every frame be collected contiguously. The method simply matches patterns with those that have been previously collected. The same uniqueness continues to apply regardless of which frames are collected, as long as enough frames have been collected to disambiguate any two sets of possibilities.

Nothing described herein precludes both the Direct and Blind acquisition methods from being employed simultaneously. In short the Blind Detection can be used as a stopgap measure while the beacon is acquired via the Direct Method, whereupon the MA becomes definitive or alternately the Direct Method can be stopped if Blind Detection converges sooner to a complete solution.

The method further contemplates acquiring multiple beacons simultaneously as permitted by the resources of the surgical receiver such that the worst case time to acquire the environment would be the aforementioned 30 seconds to acquire the System Information 1 beacon in the case of the Direct Mobile Allocation Acquisition method.

Refinements for Interferer Holes which are Smaller than a Single GSM Burst

The methods described in the foregoing assumed that the minimum interferer hole is as a minimum greater than a single GSM burst of 577 uS. However several refinements are contemplated that achieve the same goals using substantially reduced interferer holes.

Partial Frame Collection and Coding Redundancy Exploitation

Figure 27:
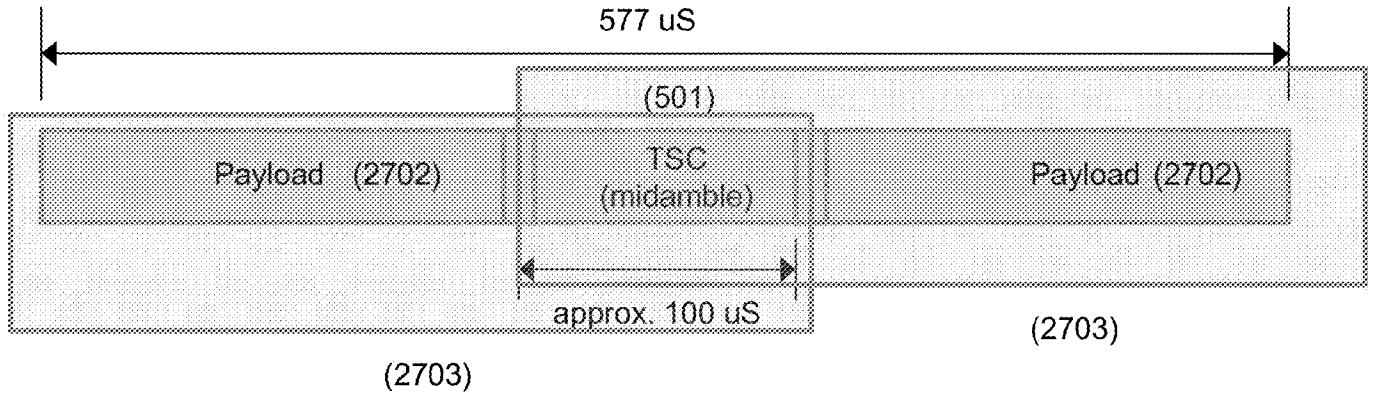
FIG. 27 shows how the TSC may be read using holes that overlap the TSC and the payloads in a GSM traffic burst.

A standard GSM burst is shown in FIG. 27. It consists of a training sequence (TSC—often referred to as a midamble) (2701) and payload symbols on either side (2702). The purpose of the TSC is to enable a receiver, be it a handset or base station, to both time the burst and to equalize it so as to combat the effects of fading associated with both multipath and Doppler effects. Since the signaling messages of interest are static, so are all of the symbol fields within the message static. Therefore it is not necessary that any burst be collected in its entirety but instead only the TSC (necessary for successful demodulation) and the payload on either side need be collected, which reduces the size of the interferer hole by nearly half (2703), albeit at a penalty of increasing the time to acquire the messages,—presuming there is not a commensurate increase in the frequency of occurrence of the interferer holes.

The method also takes advantage of the fact that GSM beacon timing is very accurate and stable. It is therefore possible to acquire the TSC (or perhaps reduced fraction thereof) infrequently and from this acquire all of the other beacon timing using partial deconvolution techniques as described below. This makes it possible in principle to reduce the acquisition hole size to a theoretical minimum of perhaps a fraction of the TSC. The increase in hole frequency which may be required when the hole size is reduced to keep the overall time to acquire the information the same can be somewhat reduced by concentrating only on the germane bit subfields of the messages of interest, as described under the heading of partial deconvolution.

Reduced TSC Collection and Coding Redundancy

Figure 28:
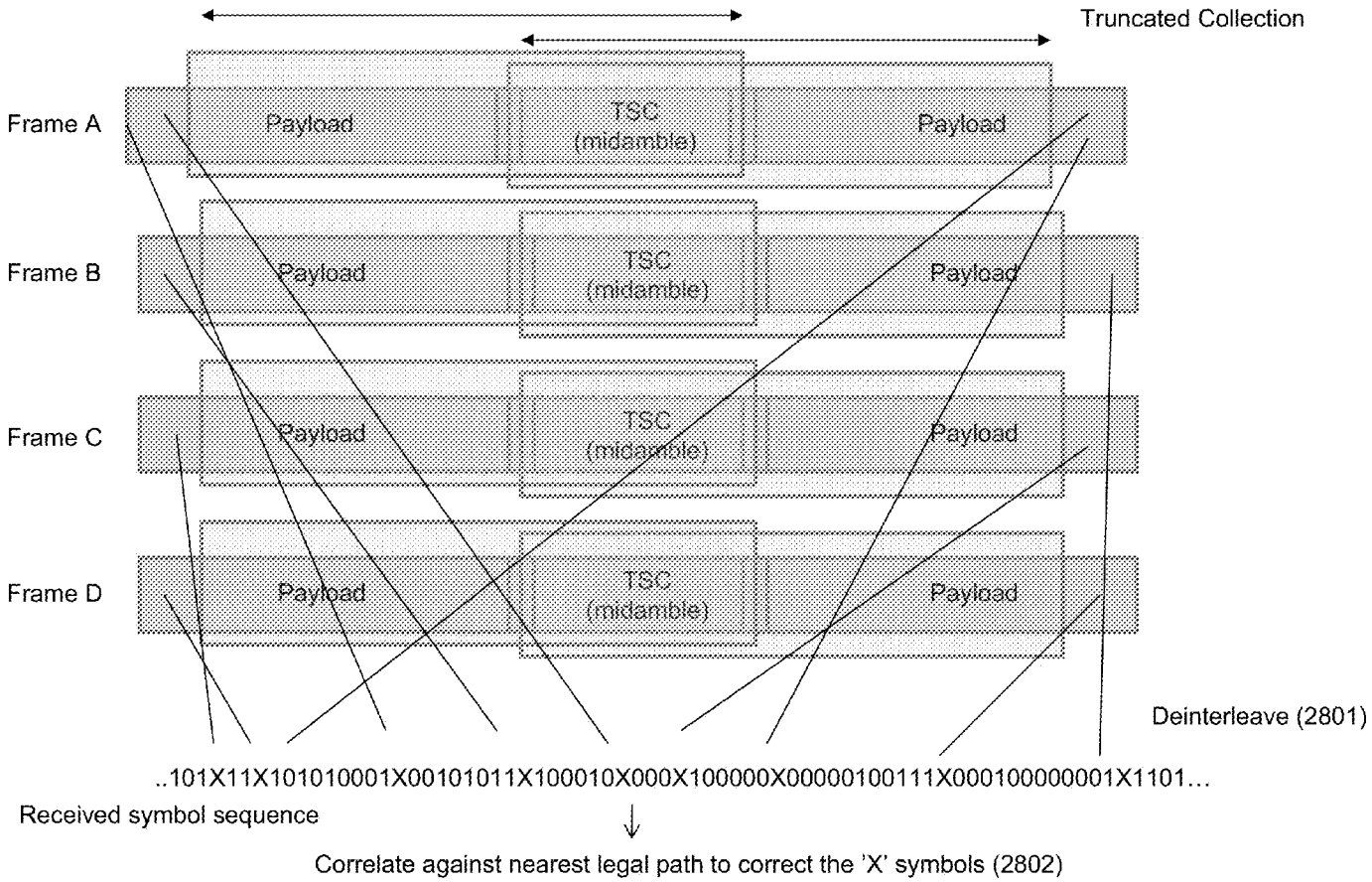
FIG. 28 shows how the TSC may be read even though the holes do not completely overlap the payloads in the GSM traffic burst.

It may be possible to be more aggressive still and further shorten the interferer hole by operating on only a portion of the TSC and cutting off the payload data collection on either end as shown in FIG. 28. The penalty is in performance either in terms of ability to detect beacons messages (e.g. inability to detect low level beacons) or the time to collect due to demodulation errors caused by insufficient TSC collection. In the case of the reduced data collection, the method takes advantage of the coding redundancy built into the modulated data. More specifically GSM waveforms are convolutionally encoded and interleaved across 4 GSM bursts to combat bursty noise and fading. Therefore it is possible to truncate the data collection on either side of the burst (as truncation is indistinguishable from an error burst) and still recover the message by taking advantage of the message coding where the truncated bits end up distributed by the deinterleaving process (2801) and then corrected by the subsequent convolution decoding (2802).

The techniques also take advantage of the fact that in some cases the CRC appended to, each message is in fact a Fire code and therefore can be employed to make hypotheses concerning bit subfields, since the number of bits in the CRC represents a parity check that is greater than the Hamming space of the message.

Meta-stable Collection and Best Hole Fit

It is entirely possible for GSM beacon BCCH frame timing to be perfectly or nearly perfectly coincident with interference holes such that no overlap occurs for a particular BCCH frame within the 51 multiframe within a reasonable amount of time. For example if both the interferer and the beacon are timed by GPS but have some random phase with respect to one another. In the case where the two are timed from different non-coincident sources, they will drift relative to one another and therefore at some times the phases between them will be favorable and at others they will not. To minimize this effect, the method makes use of the aforementioned notion of coding redundancy to perform a look-ahead over several seconds and determine a "best fit" acquisition time that has the maximum overlap (minimum truncation) in the presumption that this will have the best chance of success in reconstituting the message.

Extraction of Static Information Using Partial Soft Deconvolution

When the size of the interferer hole drops below a certain point, it becomes impractical to stitch together static messages and perform validation due to the length of time required (e.g., 10 s of minutes or more) unless there is a commensurate increase in the holes' frequency of occurrence. Further still the techniques described heretofore are not applicable to messages that have dynamic content, as collection takes place over disparate messages which will almost certainly fail any subsequent CRC test. Therefore the method shifts to concentrating on estimating the static, if heretofore unknown, bit fields of relevance within a given message using a best fit partial soft deconvolution technique.

Figure 29:
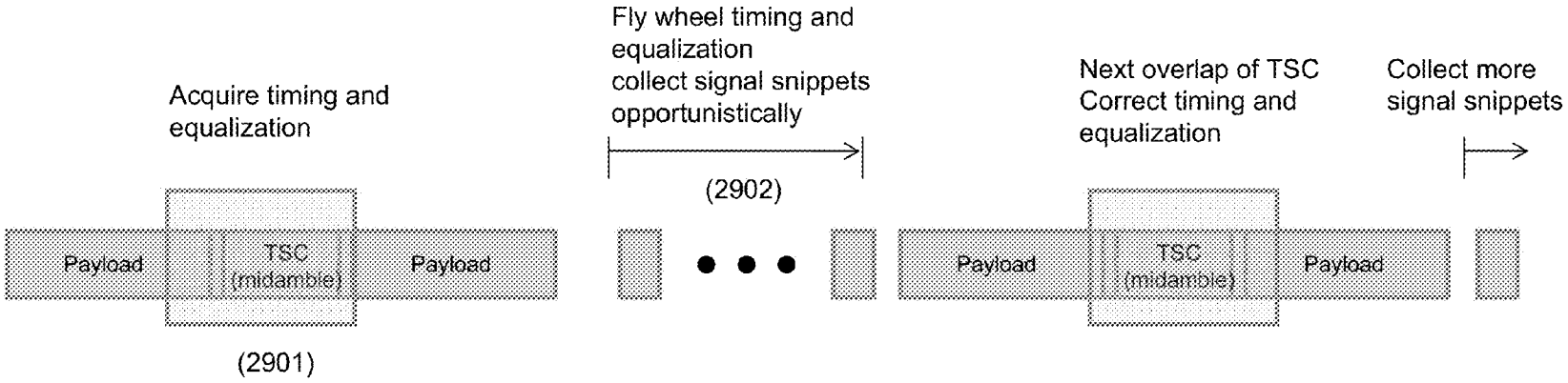
FIG. 29 shows how fly wheel timing and equalization can be used to collect signal snippet of the TSC opportunistically.

The GSM TSC is a fixed midamble sequence that is embedded within every GSM burst. The purpose of the GSM TSC is to enable the receiver to precisely synchronize to and subsequently equalize (essentially somewhat counteract the effects of distortion and fading) the payload information. In order to achieve acceptable voice quality performance despite severe multipath and the attendant fading it causes, the GSM standard requires that each burst be synchronized and equalized. However equalization is not necessary on every burst in order for the surgical interferer to recover the desired information. The techniques takes advantage of the fact that the information of interest is constantly repeated and therefore these localized effects can essentially be averaged-out over time as shown in FIG. 29. The method presumes that the duration of a hole is sufficient to as a minimum acquire the GSM TSC and that holes that overlap the TSCs occur frequently enough (901, 902) that the timing and fading characteristics of the signals in the hole are stable enough to recover the desired information from any given burst in between the holes without the need to explicitly recover the TSC from each—e.g., the method will synchronize/equalize any given TSC and then flywheel using these settings until the next available TSC. This presumption, in turn, permits the lower theoretical hole duration bound for the methods described herein. For purposes of description it is also presumed that the timing/phasing of the holes are sufficiently incommensurate with the signal timing that hole effectively slides over portions of the messages of interest within a reasonable period of time.

Figure 30:
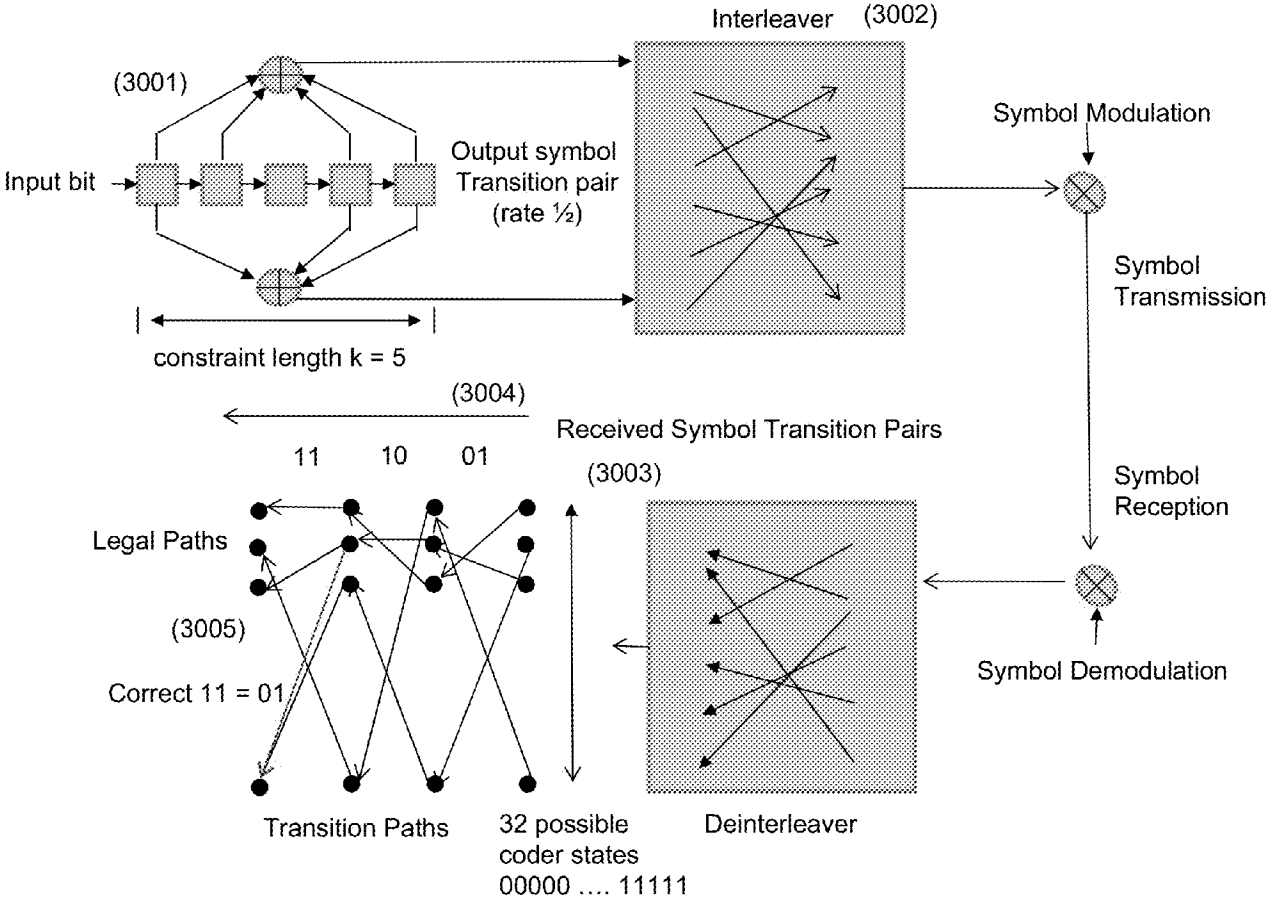
FIG. 30 describes how the most likely decode paths may be determined for bit fields of interest in the GSM traffic signal.

The general principal of extracting static information using interferer holes of the size just described is to collect symbol transitions that are presumed to be from the same static portion of some message and form a histogram for each and use the histogram to determine weights for the symbol transitions and then use the weights to select the most likely decode path associated with the bit fields of interest. The GSM convolution encoder has a rate of ½ such that it emits a pair of symbols for every input bit as described in ETSI 45.003 and represented in FIG. 30 (3001). The symbols in the pair are termed in the following a symbol transition (3004). These symbols of the message are subsequently interleaved (3002). In the receiver the symbols are demodulated and deinterleaved (3003) and are thus again paired. In the receiver, the symbol transition represents the transition of the coder and is used to hypothesize the state of the coder at the time the symbol transition was emitted and from this the bit that was transmitted. Normally a decoding process such as the Viterbi algorithm hypothesizes that the transition represented by the symbol transition is the one that best fits a legal path—i.e., that is legal for the coding process in question and in doing so achieves some measure of error correction for individual symbols that deviate from that path (3005).

Figure 31:
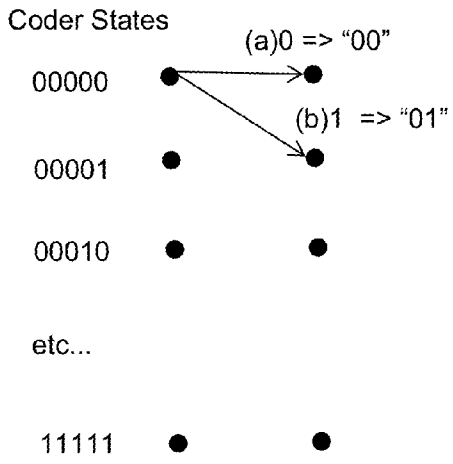
FIG. 31 shows soft decoding based on weights determined using a histogram.

The transition hypothesis as shown in FIG. 31 (901) weights the match of each symbol as either a 1 or a 0 for any given hypothesized coder state. This kind of weighting is referred to in the art as hard decoding This implies that the weighting for any given hypothesized transition will have the values 2, 1 or 0 when both symbols match, only one matches, or both differ respectively with respect to the received symbol pair. However as shown in FIG. 31, the method modifies this to perform what is known in the art as a soft decode process where the symbol transitions are weighted based on the histogram for that symbol transition. For example if a given symbol has 10 samples and 7 out of the 10 are determined to be '0' and the other three then the hypotheses for '0' and '1' are given a normalized weighting of 0.7 and 0.3 respectively (rather than 1.0 or 0.0). For each symbol transition (pair of symbols) the method forms a weighted hypothesis that graduates between the range of 0 and 2 instead of discrete values described for hard decoding. It is well established in the art that soft decoding has performance superior to that of hard decoding. Therefore a key improvement of the method is to recognize that the symbol transitions representing static bit fields can be combined over some number of repeats of the message and then used to create a weighting that is the basis for soft decoding. Another anticipated improvement is to use the overall path error (known in the art as the Hamming distance) (902) between the actual path and that which is the best fit, as a confidence metric in the absence of a definitive CRC.

Modified Partial Deconvolution on Static Subfields of Dynamic Messages

When a surgical interferer is used for survey purposes, it can be used to obtain information from the signal that is not contained in the beacon directly but is instead derived indirectly by monitoring dynamic signaling on related channels. Examples are the paging (PCH), access grant (AGCH) and stand alone dedicated control (SDCCH) channels. Examples of the information that may be obtained from these channels include how stand-alone dedicated control channels (SDCCHs) are allocated and managed or what level of encryption is being employed in the GSM system being surveyed.

Figure 32:
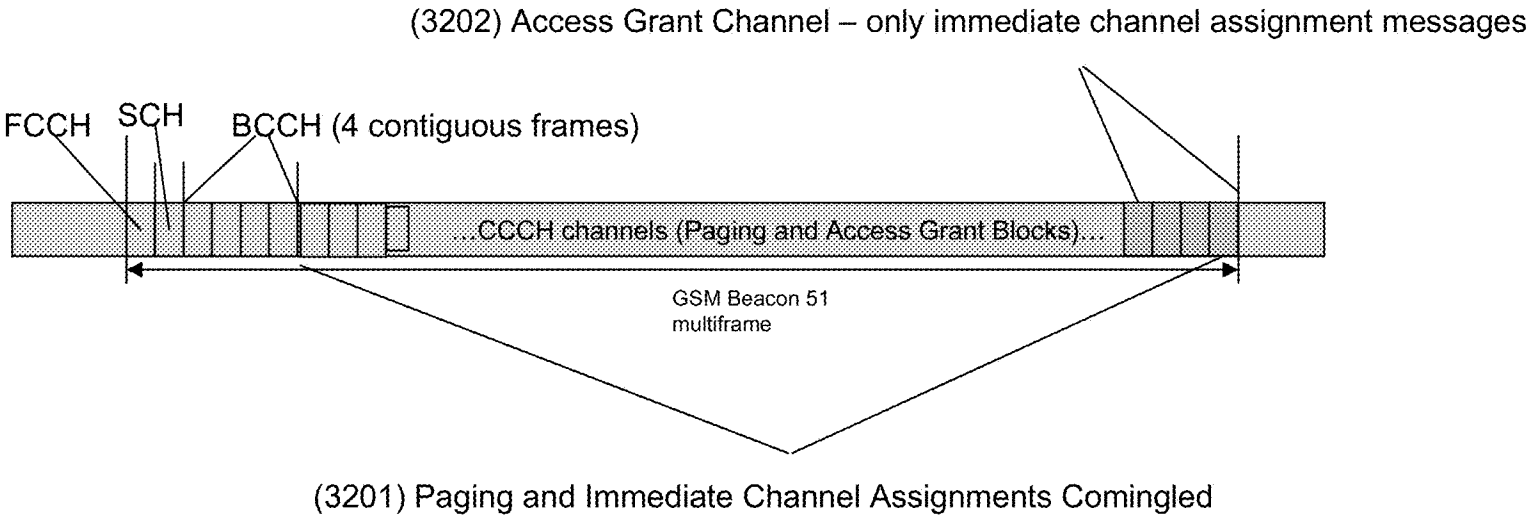
FIG. 32 shows how dynamic control messages may be spread across a GSM multiframe.

Like the BCCH, these messages are spread across four contiguous frames which for descriptive purposes shall be denoted frames A, B, C and D as shown in FIG. 32. However, unlike the static beacon messages transmitted on the BCCH, the messages that are transmitted on the channels enumerated above are dynamic both in their content and timing (as any given message may be interspersed unpredictably with other messages). Therefore as noted previously, the methodology of stitching together disparate noncontiguous frames to form a complete message is not possible. Further still, it is not possible in general to perform a symbol transition weighting as described previously because the messages are not predicable in time. The lack of predictability makes it very likely that snippets of signal from different messages will become comingled and the message will therefore be impossible to decipher. However in special cases where the message is the only one carried on a particular channel, then it becomes possible to extract the information from the static subfields therein on a case by case basis, as described below.

One example is the immediate channel assignment that is transmitted on either the PCH or AGCH channels (3201). Included in this message is information on the nature of the channels used for either registration or call set up (e.g., whether it is an SDCCH channel or a traffic channel (TCH), and if so whether it is hopping etc.). This information is useful for instance, in planning and mounting reactive surgical attacks on call setups to potentially threatening phones. Depending on the configuration of the beacon, the immediate channel assignment can appear uniquely on the AGCH or be comingled with paging or other messages on the PCH. If the configuration is the former then it is possible to obtain partial information from this message as described herein (3202).

The immediate channel assignment message has a variable format that is selected by the service provider. However the techniques take advantage of the fact that the format (e.g., the number of fields, their placement and the effective total message size) is almost always fixed once it has been configured for a particular beacon and hence it is only the bit fields associated with specific channel assignment allocated to the wireless device and the attendant CRC that change from message to message.

Figure 33:
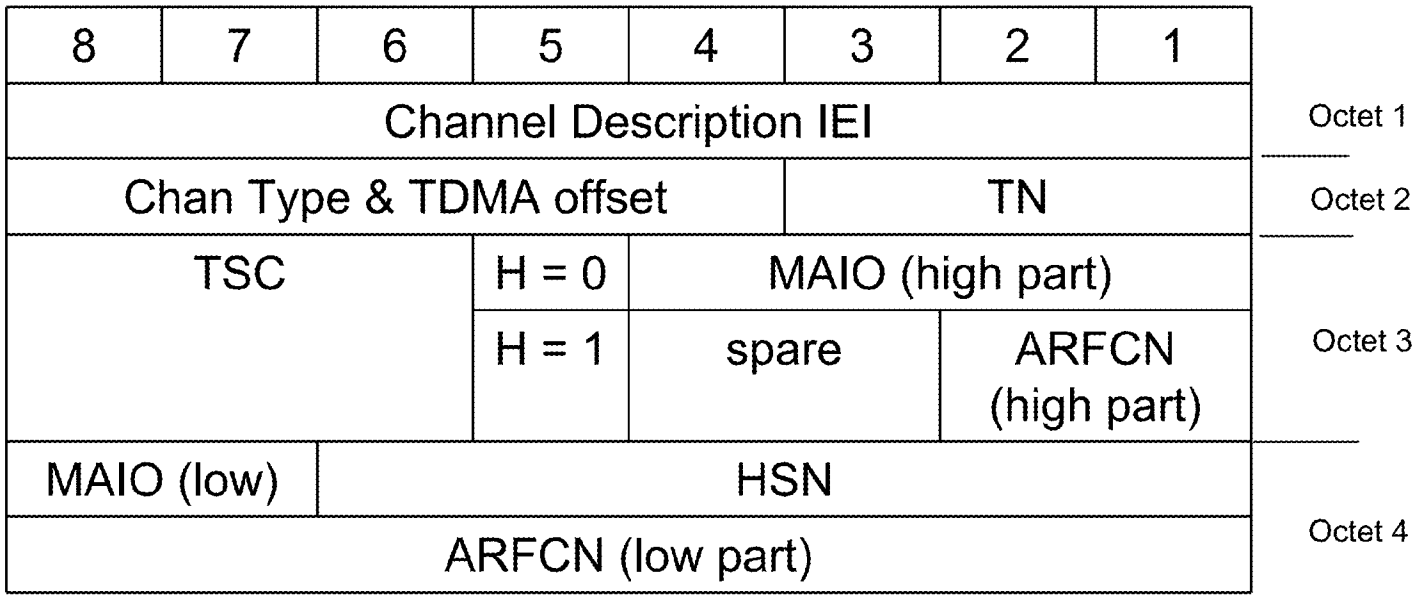
FIG. 33 shows the description of the channel assignment message subfield from the GSM standard.

Referring to the ETSI 44.018 Section 10.5.2.5 description of the channel assignment message subfield (inserted here as FIG. 33 for convenience), the description shows that channel allocation type, the TN (time slot number) and the TSC bits and the hopping sequence bits. The bits are transmitted (i.e., enter the coder) from LSB to MSB. The TN value ranges from 0 to 7 as does the TSC number. The bits that follow the (hopping) bit are the ARFCN channel that is to be used if the channel is not hopping or the mobile allocation index offset (MAIO) setting if hopping is in use. It is presumed for purposes of simplifying this example, that the number of bits preceding this portion of the message is known. In general, if the number of bits is not known the method can hypothesize it and repeat the techniques that follow for each hypothesis. This is practical because the variation in message formats, and therefore the potential set of the number of bits preceding this portion of the message is limited. Further still the techniques determine the format as follows.

In general these bits fields are variable and unpredictable. However in practice, all but the TN field are typically fixed, albeit not necessarily known. The techniques take advantage of the fact that the actual state of the coder as of bit 1 octet 3 is only influenced by the channel type bits (because the bit field is equal to the constraint length of the coder) and therefore it becomes possible to unambiguously hypothesize each channel type and from it the starting point of the coder and thereafter deciding which channel type is in use by associating the coding state with the path having the least error.

Figure 34:
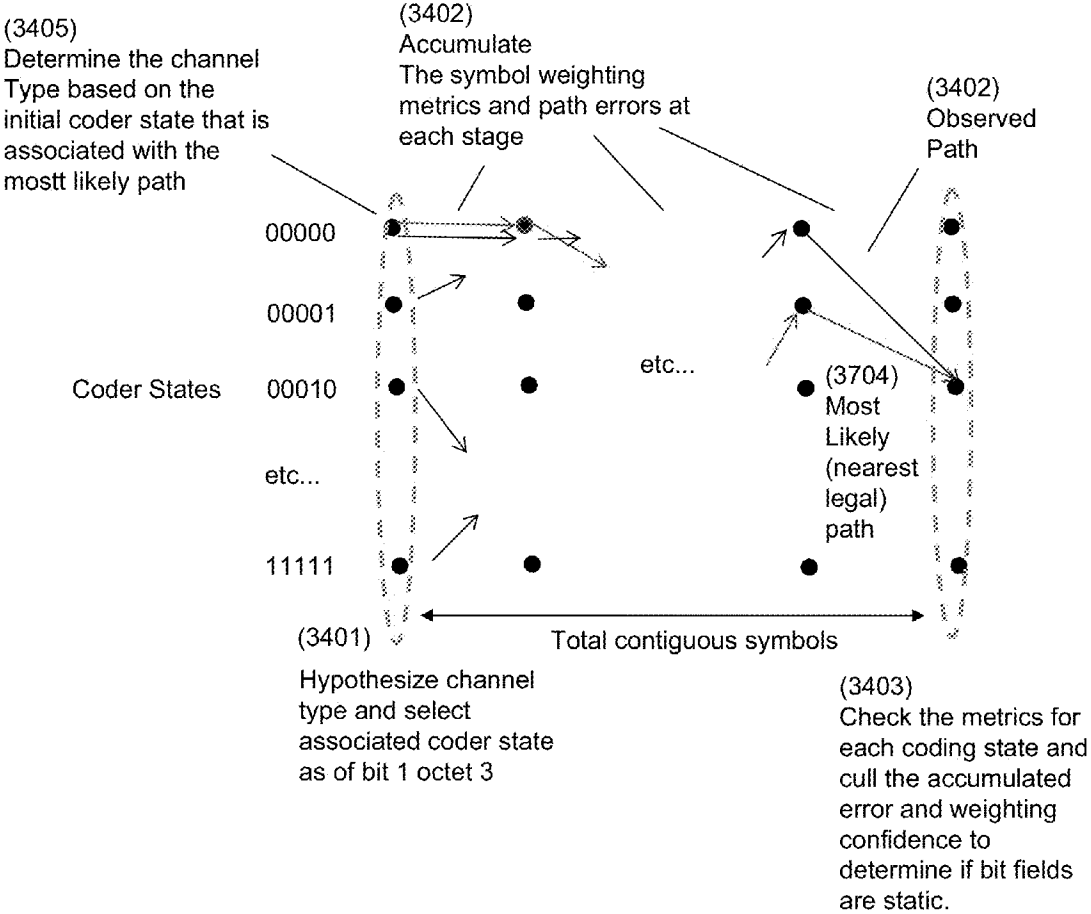
FIG. 34 shows a method for reading the fields of the channel assignment message subfield.

The method proceeds as shown in FIG. 34. First it hypothesizes the coding state as a function of the channel type bits (3401). It then takes accumulates all symbol errors and the weighted symbol transition factors at each stage (3402) based on the weighted symbol transition observations. At the end of the collection of all contiguous symbols representing the bit field of interest, the metrics are analyzed to determine the path error and symbol variability (3403) implied by the weighting (e.g., the closer the weighting factor approaches 1, the less variability). If the accumulated error and symbol variation are under some threshold it is hypothesized that bit fields associated with the symbols are probably static and they are subsequently decoded as the legal path which most likely matches the observed data (3404). The initial coding stage that is part of the most likely path is the most likely estimate of the channel type (3405).

Once the information has been recovered from these bit fields with reasonable certainty it is possible to glean other information by distinguishing which parts of the message associated with particular bit fields have relatively consistent paths and which parts are highly variable. This in turn suggests which other bit fields are fixed and which are variable. One possible refinement is to determine which fields are static and which variable before deciding whether it is feasible to collect other information and thereby not expend collection time or resources on bit fields that will prove to be undecipherable.

With respect to the example at hand, if it has been established that hopping is not in use then it is possible to subsequently determine the AFRCN bit field information. In this case the method would analyze the path variability associated with that bit field in question to determine if the ARFCN is fixed or variable (i.e., whether the base station doles out the same ARFCN or uses a variety ARFCNs). If the Hamming distance variability for the minimum hypothesized path is relatively small then it is likely the case that the ARFCN is fixed and the channel number is decoded from the path information using for example a Viterbi decode. If it is highly variable then it can be surmised that the ARFCN is variable and therefore making it impossible (unfortunately) to predict, in general, what the set is with any degree of certainty.

Nothing in the foregoing proscribes the method from "cheating" by first hypothesizing information gleaned from the other sources such as the BCCH messages to either minimize the required amount of information collected (hence the time to acquire) or the subsequent time to compute. For instance, while not compulsory, it is customary that call setups are not frequency hopped but instead use SDCCH channels in slot 1 on the same ARCN as the beacon. Therefore this technique might collect a small sample first and perform a path match on the expected case so as to confirm this suspicion and then fall back to more collection if the hypothesis is unfounded. Further still it may prove easier to hypothesize the ARFCN field (e.g., presume the same ARFCN as that of the beacon), see that it is not variable, from that deduce that it is not hopped and from this establish the coding state just prior to the TSC to determine which TSC is being used. More broadly this implies that there is little penalty paid for making assumptions that are subsequently found to be incorrect. Here if the Hamming distance variability threshold is not met then the method merely collects more data and broadens the range of hypotheses.

Therefore a certain common configuration could be hard-coded within the algorithm so as to run these specific checks first and then perhaps dynamically modified should the original hypotheses prove incorrect—e.g., after a tower from a particular service provider has been analyzed, hypothesize those same settings first on all subsequent towers operated by that service provider. If it is presumed that most towers operated by the same service provider are configured identically (excepting of course the specific channel allocation information) then it can be expected that there will be a marked reduction in the average time it will take to resolve the desired ancillary information. Even in the case of the occasional aberrant configuration, little penalty is paid over performing a worst case blind search over all hypotheses for all sectors on all towers.

Modified Partial Deconvolution Applied to Dynamic. Messages Having Predictable Content In cases where a message is unique to a channel and has dynamic yet predictable fields, the techniques may be modified as described below.

Figure 35:
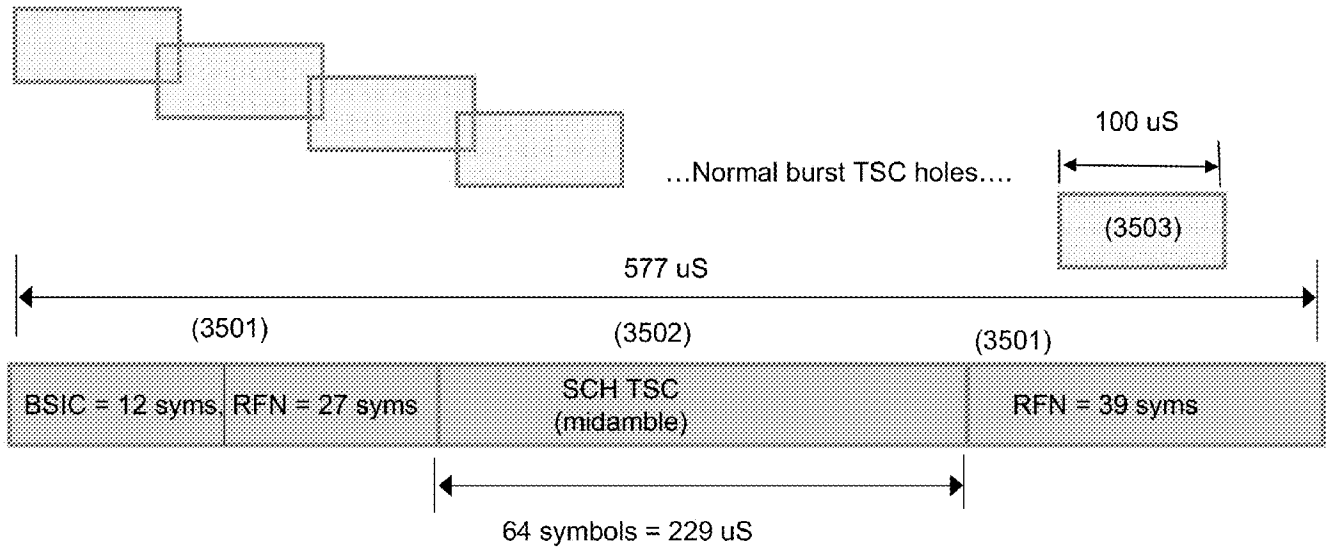
FIG. 35 shows details of a synchronization burst according to the GSM standard.

One example of such modification is the synchronization burst described in ETSI 45.002 Section 5.2.5 and shown in FIG. 35. The synchronization burst is the lone message carried on the synchronization channel (SCH). Its sole purpose is to establish all timing (both physical and frame) between the beacon and a wireless device and it is impossible for the wireless device to proceed without the regularly synchronizing to the SCH.

It can be seen in (3501) that the burst carries a subfield designated as the reduced frame number (RFN). This bit subfield increments rigidly with each burst occurrence and is therefore perfectly predictable. Unlike the previously described messages that are distributed across 4 frames, the synchronization burst carries a message hearing only the color code identifiers (static) and the RFN (dynamic) in a single frame as described in ETSI 44.018 Section 9.1.30a. Further still the message is not interleaved as is the case for previously described messages and differs from a normal GSM burst in that the TSC is extended from 26 to 64 symbols (3502).

Figure 36:
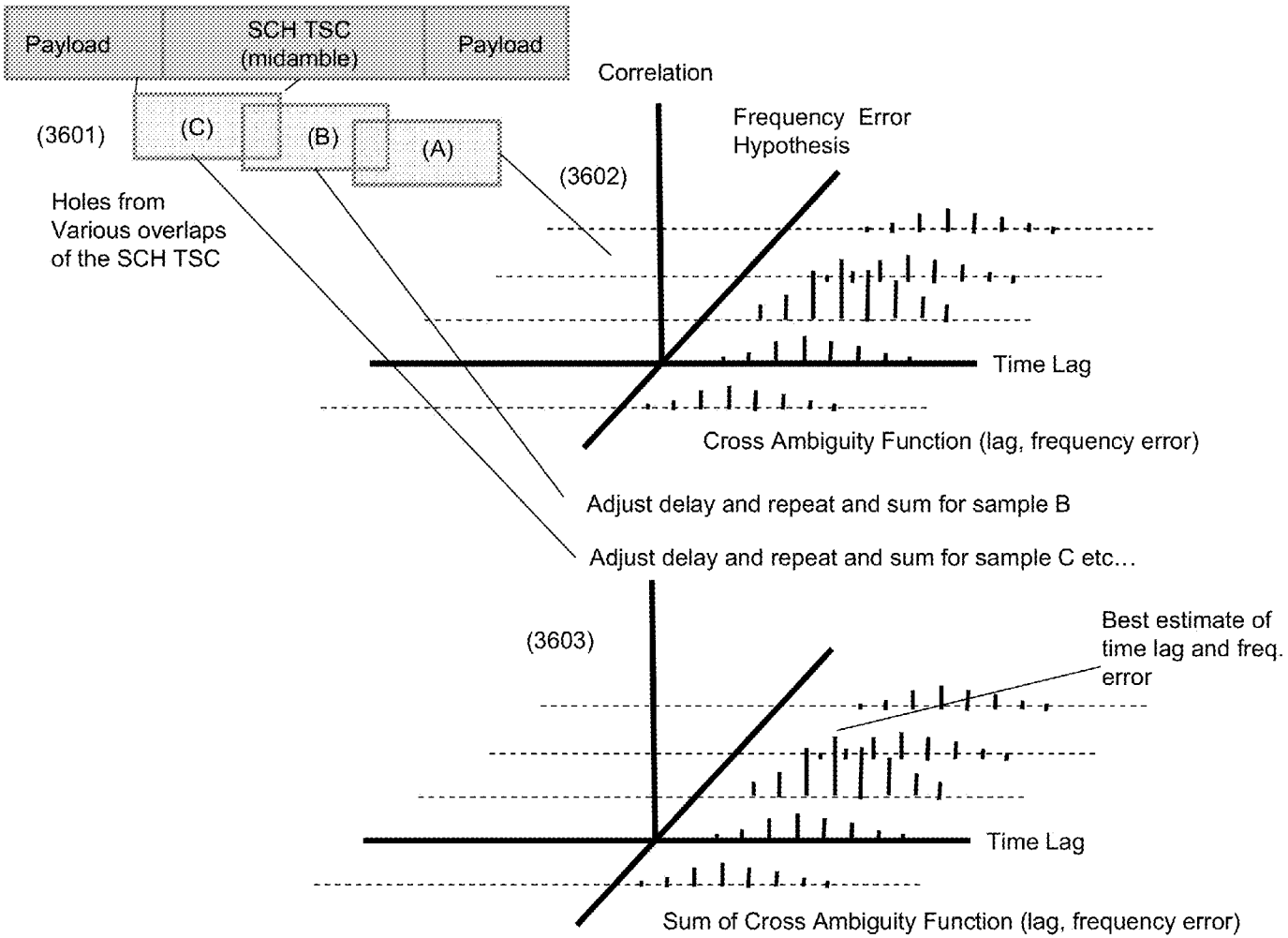
FIG. 36 shows how a synchronization burst can be read from a frame even though the interferer hole is shorter than the SCH TSC.

The description that follows presumes that the techniques no longer require that the minimum duration of an interferer hole is the duration of a TSC in a single normal GSM burst (3503). The techniques proceed by performing a raw correlation against the SCH TSC on the data from every collected hole as illustrated in FIG. 36. Since the hole size is less than that of the SCH TSC, it is not possible to collect a single contiguous SCH TSC in its entirety. Instead the techniques resort to piecewise estimates of the physical timing. Specifically the techniques collect all of the signal snippets from the every available hole and store them for subsequent processing. The collection period and the amount of data collected will vary based upon the hole size and periodicity as it relates to the periodicity of the SCH timing (3601). The technique then performs cross ambiguity function processing on each snippet against the entire SCH TSC to form a two dimensional function of the time lag correlation of the snippet against the SCH TSC as a function of hypothesized frequency error (3602). The method then delays and sums the cross ambiguity functions based on the known periodicity of the synchronization burst. For example as is shown in the cross ambiguity functions taken from snippet B are time delayed by the predicted phase of the SCH TSC and summed with A. The process can be repeated by accumulating properly delayed cross ambiguity functions derived from additional snippets until a singular peak representing the best estimate of the time delay and frequency correction moves above some comparative threshold (3603).

Figure 37:
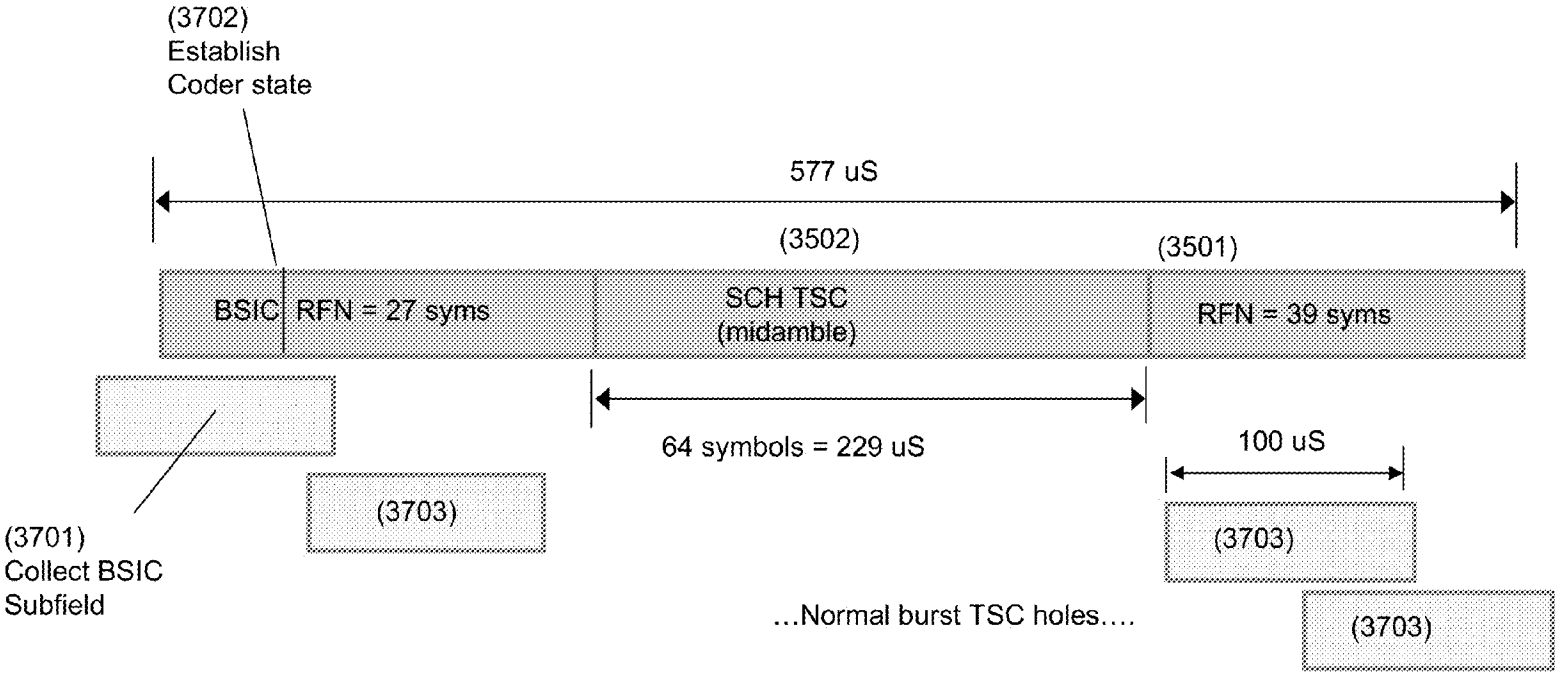
FIG. 37 shows how the BSIC subfield can be used to establish coder state when reading the SCH TSC.

Once the physical SCH timing and frequency correction have been established, the technique concentrates on extracting the frame timing. It now collects only signal snippets from the locations in the bursts where the BSIC field of the SCH is believed located. Then the technique uses the soft partial deconvolution processing described previously to establish the static BSIC identifiers as shown in FIG. 37 (3701). From this it can be established what the state of the convolutional encoder must be prior to encoding the RFN subfield (3702), regardless of which SCH frames snippets are collected. Because the RFN subfield straddles the SCH TSC, it is not feasible to collect the RFN in its entirety and therefore the method must resort to using the soft partial deconvolution techniques described previously with some modification. The method collects (in no particular order) any set of partially overlapped segments of the RFN subfield (3703) and then performs an analysis by synthesis by hypothesizing the frame timing and coding the subfield symbols and performing a pattern match—with the understanding that the hypothesized symbol coding is adjusted for when the snippet was acquired. The pattern matching could require significant computation due to potential search space size. However several shortcuts can be employed to reduce the search space to manageable levels. For example the frame numbering increments approximately 216 times per second. This suggests that the FN bits (not to be confused with the RFN bits) above the 8 LSBs remain stable over this period which provides sufficient time to collect enough samples to create the necessary weighting function for those symbols that represent the FNs above the LSBs of the message. The challenge then becomes estimating the true frame number from samples that contain the symbols that represent the lower order bits which are constantly changing over the weighting collection period. However since the message codes the RFN rather than the FN, it is only required that symbols representing effectively the lowest 4 bits be hypothesized. Here each of the possible 16 states (lower 4 bits) for some collection time period during which a sample was collected are hypothesized and then the method finds the samples from all of the interferer holes that overlap this field during the collection time period and synthesize the symbol pattern for what would be the incremented time given the hypothesis. The method then selects the originally hypothesized time (4 bits) that produces the closest symbol pattern match over the collection period.

The important feature of this technique is that it remains possible to significantly lessen the hole size without a commensurate reduction in the hole periodicity and still acquire the SCH timing in reasonable period of time (a few seconds) and from this employ the previously described methods of semi-blind dehopping (a few seconds more) to provide timely reaction to a newly discovered beacon. Therefore it has the potential to greatly reduce the threatening device exposure time (from when a beacon is discovered to when devices operating off of that beacon can be discovered) from perhaps many minutes to a several seconds.

Deducing MAIO and Time Slot Subsets

Figure 38:
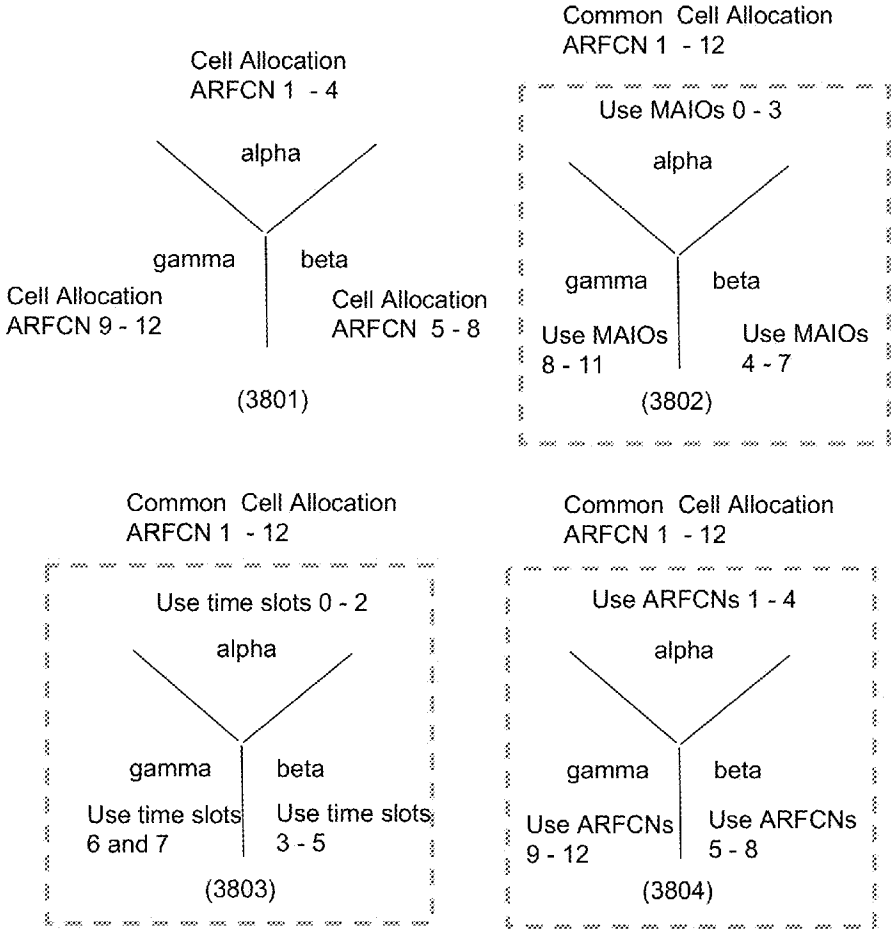
FIG. 38 shows how MAIOs may be allocated among sectors of a GSM beacon.

Other useful information not available directly from the beacon or related information includes the subset of MAIOs that has been allocated to a beacon for some sector of the base station as shown in FIG. 38. A typical GSM network configuration might allocate a unique non-overlapping MA set to each sector within some defined color code reuse radius with the range of MAIOs necessarily equal to the MA set size (3801). Yet another typical configuration might be to make the MA common to multiple sectors and then allocate a subset of MAIOs to each (3802). Less typical, but still entirely possible, sectors that are co-timed from a common source could be subdivided along time slots wherein one sector takes a subset of the available slots and another sector a different subset (3803). The latter two examples are made possible by timing the sectors from the same source, which is not uncommon for sectors operating off of the same base station. Unfortunately the beacon information from any given sector is necessarily ambiguous in this regard and therefore other means must be used to determine if MAIO or slot subsets are in use and if so which are allocated to a particular sector.

The method proceeds by presuming that interference is limited to the downlink channels, with the uplink channels largely unmolested as the interferers are primarily concerned with stopping signaling from reaching the phone on the downlink to effect detonation and therefore suppression of the uplink is considered to be a waste of energy and further still may affect phone service far beyond that necessary to provide localized protection.

Having recovered the timing and the MA using the previously described techniques, the method then scans the uplink channels as described in PCT/US2007/063493 looking for call setups and then subsequent uplink traffic. The method makes note that call setup is unique for each sector. Very typically it takes place on the same ARFCN as the associated beacon. However if it this is not the case, obtaining the call setup information from the immediate channel assignment messages as previously described allows the method to determine where to look for call setups for any given sector. The method then pairs call setup activity with newly discovered phones hopping on the uplink MA and presumes that this signaling is associated with the call setup and can then associated it with a particular sector (beacon operating thereupon). The technique can therefore immediately spot which MAIOs and slots are in use on any given sector. It is however conceded that if the MA set is large it would require extended periods of time dwelling on a particular sector to determine whether the sector uses the entire MAIO set or some subset and in general it is impossible to say without analyzing the data post facto in conjunction with other sectors that are using the same MA. The same is true in general for slot allocations as well.

Handling Partial Cell Allocations and Dynamic HSNs

In some sector configurations it is possible for the base station to expressly specify the hopping channel information (including the MA) directly in the channel assignment message instead of referring to system information 1. This makes it possible to for some number of collocated sectors or perhaps adjacent cells to use a common CA but dole out a unique subset thereof such that it prevents mutual interference as shown in (3804). Further still each subset can be assigned an arbitrary HSN. The method proceeds by using the previously described methods for determining hopping sequence but making note that if the hopping sequence is unable to converge to a stable solution then it will fall back to semi-blind detection and attempt to fit subsets. It is important to note that collection methodology does not change. More specifically the method collects information from all of the channels in the CA (or MA subset thereof) and then attempts to fit the information to possible hopping sequences rather than hypothesizing a sequence and collecting it as such, determining if there is a successful match and if not collect more and try another hypothesis. From a collection point of view this implies that the method can check the hypothesized sequences in parallel rather than serially.

CDMA

Figure 39:
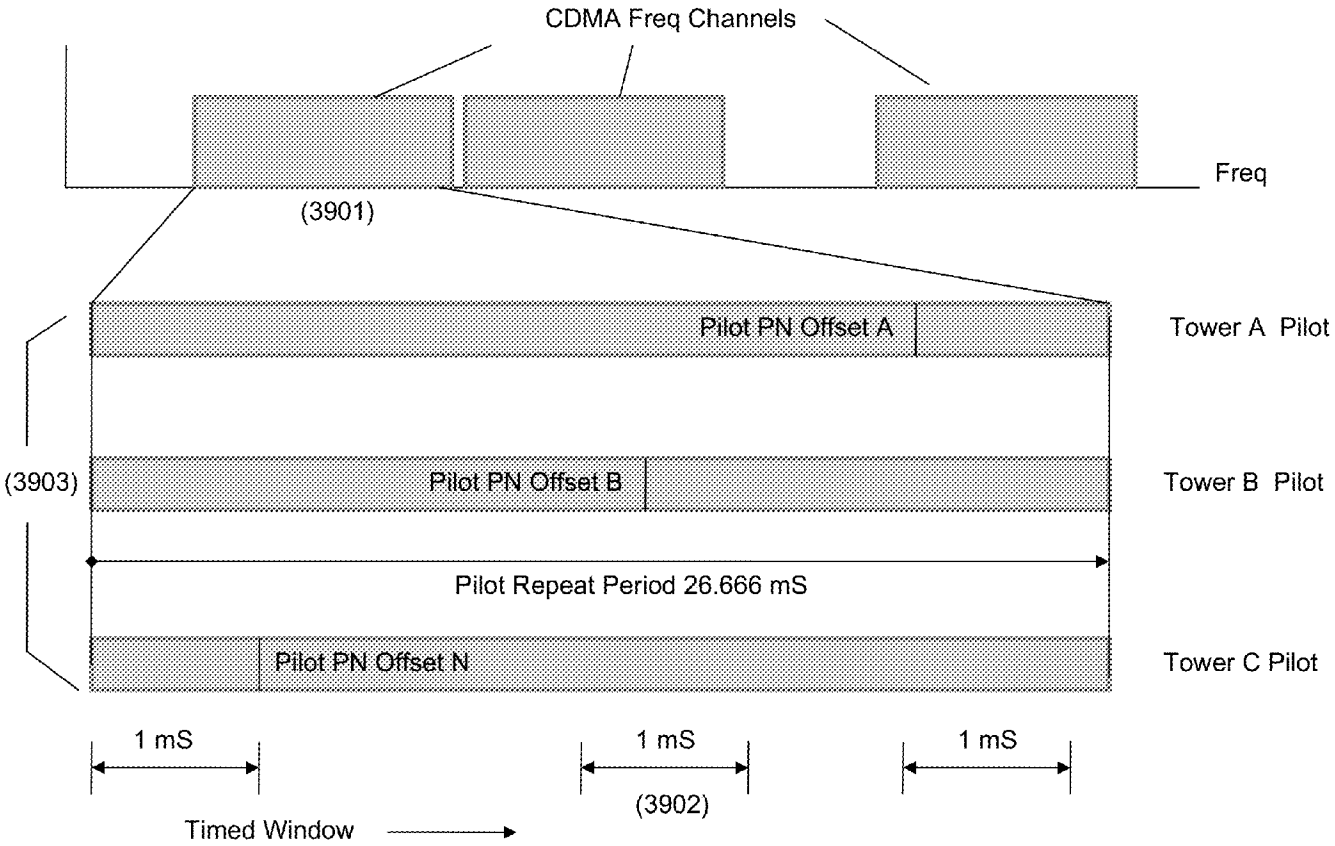
FIG. 39 shows pilots in a CDMA frequency channel.

How the techniques are applied to acquiring a COMA cellular environment by listening in interferer holes is fundamentally determined by the fact that all COMA pilots are locked to GPS. Therefore a surgical receiver that includes an augmentative GPS receiver with timing outputs can unambiguously time any COMA signal and thereby unambiguously identify of any number of pilots lurking within a CDMA frequency channel regardless of when the interferer holes are available. FIG. 39 shows an example. In this case any timed window (interferer holey (3902) which is referenced to GPS makes it possible to compute the phase of any of the 512 possible pilots whose phase corresponds to the time of occurrence of the interferer hole by using direct correlation techniques to determine which pilot PN offsets are in use. This implies that the look-through window inherently required by CDMA to perform an attack can be made to conveniently coincide with any arbitrary interferer hole timing (3903). Once armed with this information, it becomes possible to attack the pilot(s) operating in any of a number of frequency channels as described in PCT patent application PCT/US2007/030159. That description follows.

Figure 44A:
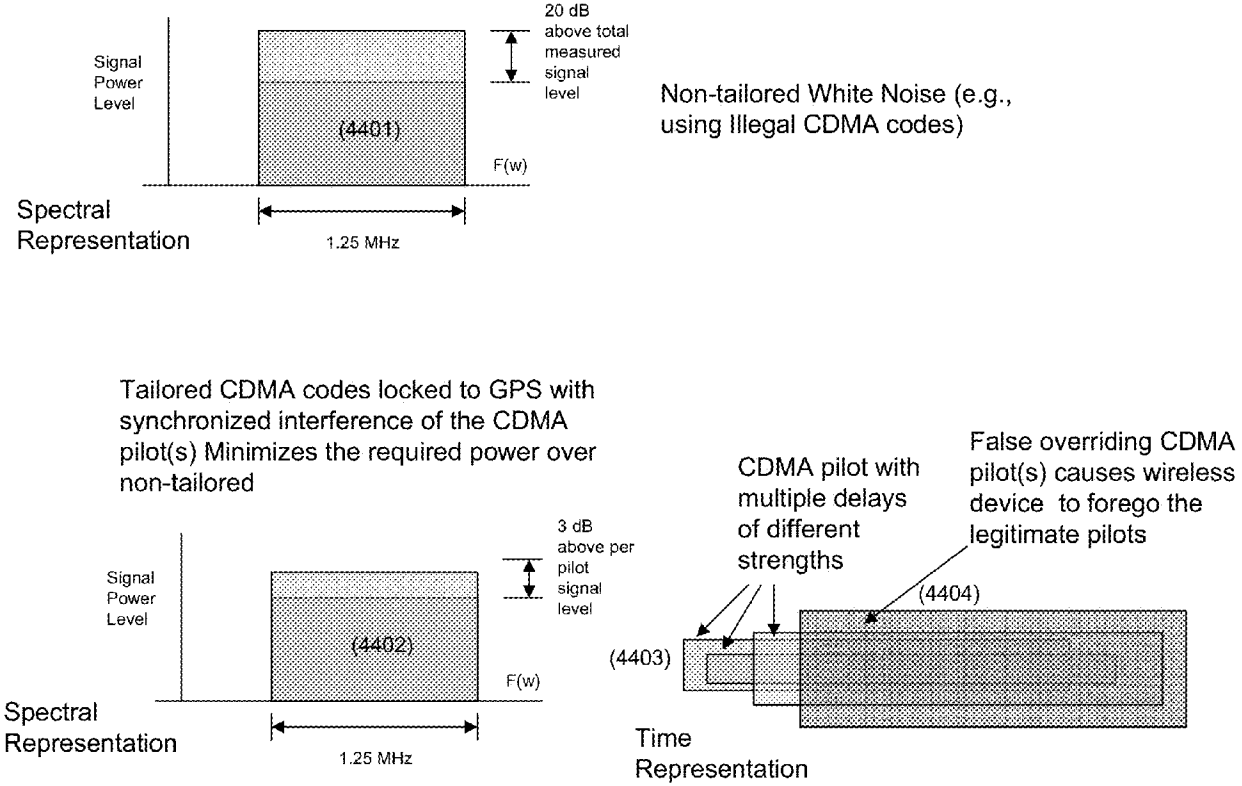
FIG. 44*a* shows how a baiting beacon may bait a CDMA wireless device that is operating on a specific channel.

CDMA signals are inherently resistant to jamming. FIG. 44*a* shows several different examples of the types of interfering signals that may be used by the interrogation system to suppress CDMA beacons. Because the interrogation system is precisely synchronized to the relevant CDMA beacon it is possible to perform a direct attack on the relevant beacon's pilot signal by proffering an interfering pilot signal with false delays that are either slightly advanced or slightly retarded with respect to the relevant beacon's pilot signal but still close enough to the timing of the relevant beacon's pilot signal for the wireless device to lock onto the false pilot signal rather than onto the relevant beacon's pilot signal (4402, 4403, 4404). Because the timing from the pilot signal is used by the wireless device to interpret the remaining portions of the signal from the relevant beacon, a wireless device that is locked onto the false pilot signal cannot interpret any of the signal from the relevant beacon. The interfering pilot signal thus forces the wireless device to lose contact with its network, and that in turn forces the wireless device to reregister with the baiting beacon. This has the distinct advantage that the interfering pilots need only be slightly larger in signal strength than the legitimate pilots as received by the wireless device (4402, 4403, 4404) instead of the previously mentioned 100 fold increase in signal level required by a non synchronized white noise attack (4401).

Figure 44B:
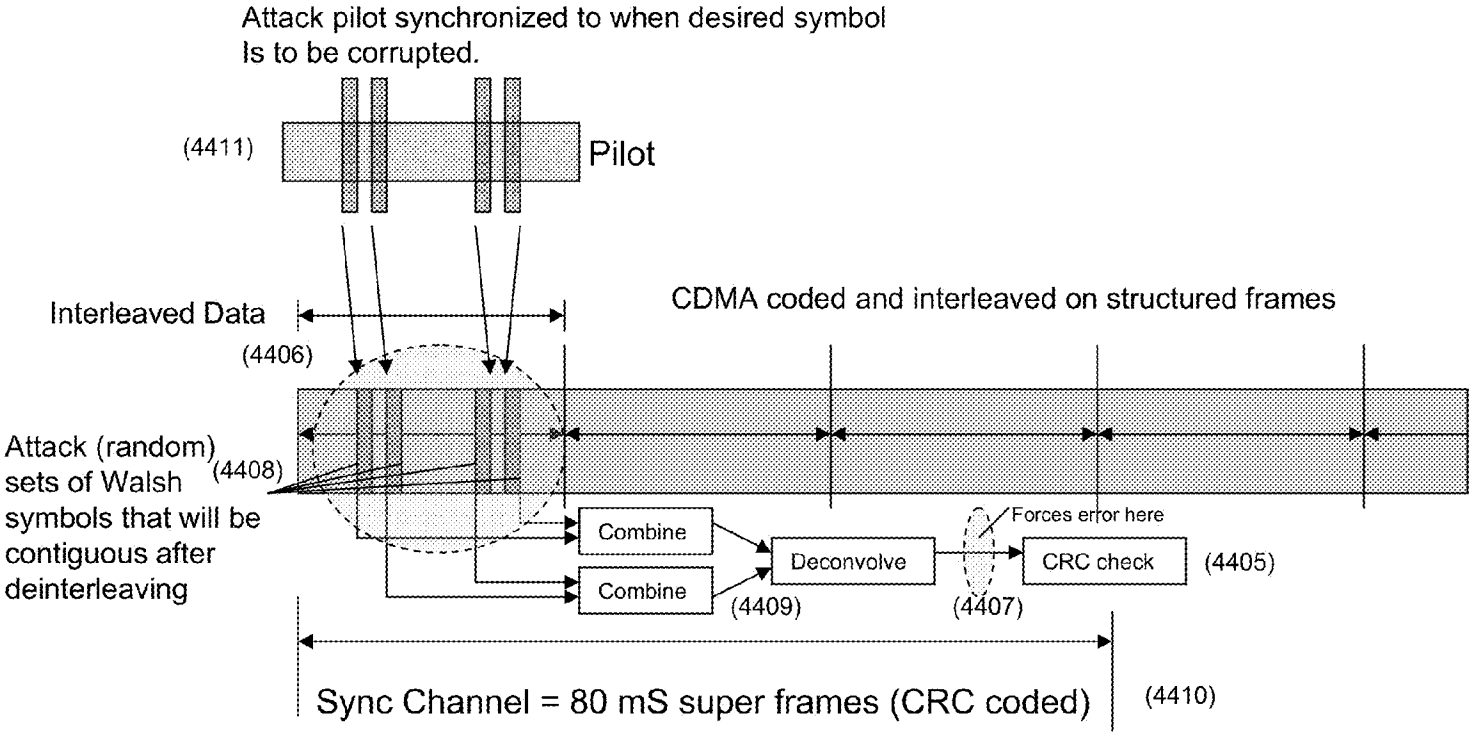
FIG. 44*b* shows how a CDMA Walsh symbol may be corrupted.

Another possible attack, expressed in FIG. 44*b*, is to recognize that all CDMA channels (such as the sync channel) use cyclic redundancy checks (CRCs) and convolutional encoding (4405) to deal with errors in the data represented by the signal. A CRC indicates whether data in a portion of the signal termed a CRC checking span is valid. Associated with the convolution encoding process is data interleaving. Cellular interference tends to occur in bursts instead of being uniformly spread over time. The purpose of data interleaving is to shuffle the data symbols prior to transmission so that when they are subsequently deinterleaved at the receiver, any bursts of errors introduced in the transmission channel will tend to be distributed over time instead of occurring in contiguous bursts. The intent of interleaving is to improve the performance of the deconvolution process (an example of which is the Viterbi algorithm) (4406) that is well understood in the art to perform best when errors are more or less uniformly distributed over time instead of occurring in sets of contiguous symbols. However, the deconvolution process diminishes rather than improves the demodulation performance when errors occur in contiguous bursts in the pre-deconvolved data, as it makes it more likely that the trellis path decoding will forsake the expected traceback path, in favor of a competing traceback path and thus cause the receiver to completely corrupt the decoded signal (4407).

Contiguous bursts of errors in the deconvolved data can be produced by attacking the pre-deinterleaved symbol sequence at seemingly disparate but in fact deliberate places that are matched to the interleaving process (4408). The attack introduces errors into the post-interleaved symbol sequence at the locations that are related by the interleaving process such that when they are subsequently deinterleaved by the receiver, the errors occur in contiguous bursts (4409). Selection of particular interleaved candidate symbol sets is not generally important and therefore this technique lends itself to randomization of the attack within any given frame, which further disguises the attacking signal. Moreover, not every frame of the beacon's signal need be attacked. Instead merely successfully attacking a single frame within the total CRC checking span (4410) is generally sufficient to force the intended CRC error. Because this is the case, frames can be randomly selected for attack. In the former instance, this leads to a further reduction of on-time and therefore required power and in the latter instance, further reduces the conspicuousness of the attack.

Symbols in the sync code channel can be directly attacked by generating interfering symbols that are coded to that channel. Another possibility is to attack the symbols indirectly by corrupting portions of the pilot signal (4411) upon which the sync code channel is synchronized for the duration of the symbol that is being attacked. As a result of the attack on the sync code channel, the synchronization required to correctly read the symbol is disturbed and the wireless device reads the symbol incorrectly. Either form of attack causes enough post deconvolution bit, errors that the CRC for the checking span to which the packet belongs to indicate that the packet is bad and thereby cause the wireless device to drop or otherwise ignore the packet and any message to which the packet belongs. Again, only a relatively small number of interleaved symbols on a reduced subset of frames need be attacked, and the power requirements for the interrogation system are correspondingly small.

In the case where there is not an augmentative GPS receiver the method can still time the pilots but cannot absolutely disambiguate them for survey purposes unless it can acquire the synchronization message—which is not possible presuming a modest hole size (e.g., <1 mS) and hole timing locked to GPS as the synchronization message spans 80 mS and the hole timing is coincident with GPS timing (i.e., lands on the same part of the message each time). It can however still use this information for attack purposes since it is not necessary to know the absolute phase of the pilot but instead only the relative phase. Therefore if the surgical interferer is locked to the same timing source as the surgical receiver, then all the surgical interferer need to do to attack a pilot that is of the same phase as that received by the surgical receiver is generate the attacking signal.

Incommensurate Timing

In cases where the interferer hole timing is incommensurate with GPS or locked to GPS but hole periodicity is such that it eventually sweeps across the entire span of messages, then it is possible to use the previously described methods employed for GSM with some modifications. Like GSM the system messages are (mostly) static. Also like GSM the message on the synchronization channel has a field that expresses the system timing and therefore techniques similar to that used for recovering the GSM SCH RFN number would be applicable here as well.

However, unlike GSM, the system information messages on the beacon are not expressly time phased. Instead the only requirement is that they appear with a certain frequency. This makes combining snippets of messages more challenging. For example it is not possible to expressly combine the messages snippets based solely on when they were collected. Instead the method resorts to the technique described in the discussion of GSM for collecting messages that are shared on the same TC phase (e.g., System information 2ter and 2quarter can share TC 4 or 5). Namely the surgical interferer performs hypothetical stitching until some sequence or collected snippets generates a valid CRC. An important distinction in favor of CDMA is that the pilot accompanies each and every symbol and therefore it is possible to demodulate snippets of the CDMA waveform in situ instead of having to wait for some synchronization sequence that may occur at an inconvenient time. This suggests that the minimum theoretical hole size for CDMA can be as short as a single symbol (i.e., 64 chips or 52 uS).

CDMA requires that the system information messages repeat every 1.28 seconds. Using a 1 mS hole and a 9 mS periodicity (instead of 10 mS used in foregoing descriptions) as an example, the method notes that it will take approximately 13 seconds to collect all of the data spanning 1.28 seconds. Further, it is a standard COMA convention is that all of the frequency channels have the same configuration. Therefore it is only necessary to pick one of the CDMA frequency channels for analysis, extract the frequency channel list message, and forego analysis of the other channels listed therein.

Pilot Measurement and Automatic Adaptation

Figure 40:
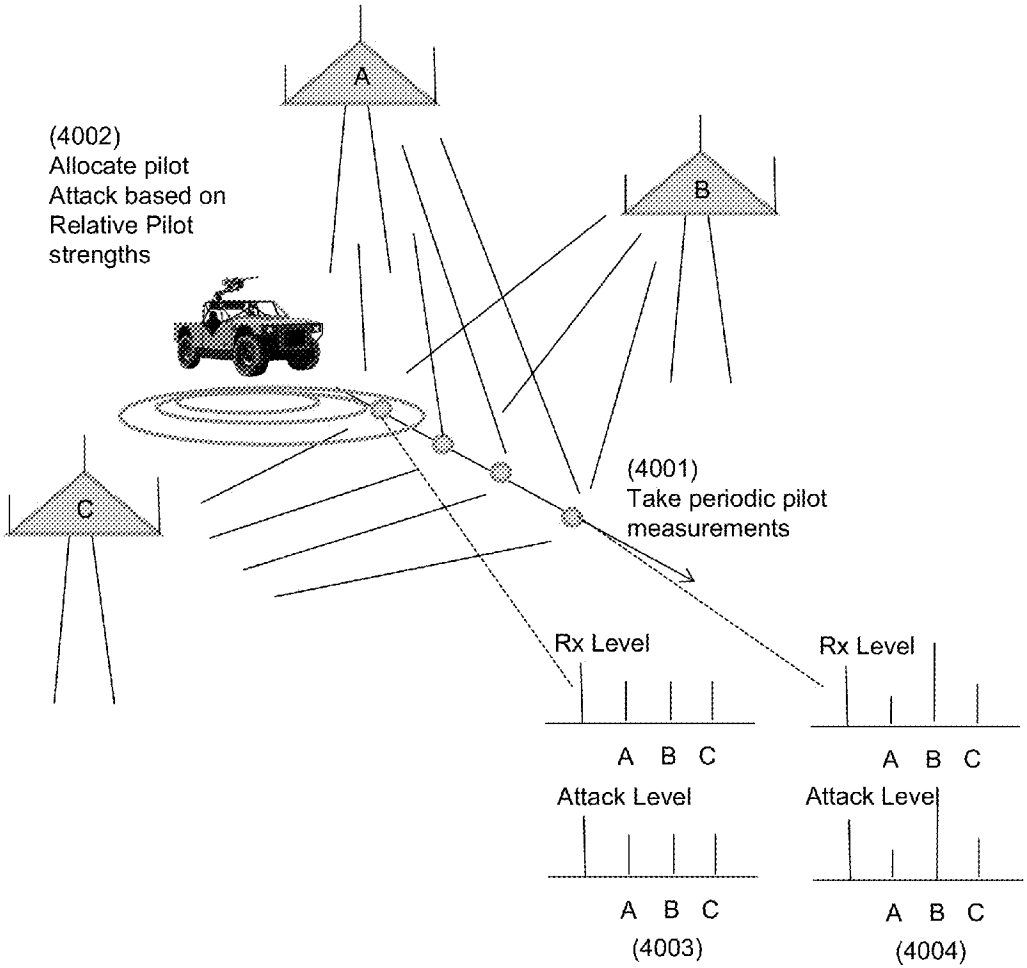
FIG. 40 shows how attacks on CDMA pilots may be allocated according to the relative strength of the pilots.

Once a pilot is acquired, it is not necessary to repeat the pilot acquisition when used with an augmentative GPS timing receiver. However it is necessary to regularly listen for pilots when the surgical interferer is used in systems that are mobile or if the interferer holes are not timed from a GPS receiver. Further still, the technique must not only detect a pilot, but also measure the relative strength of each pilot so as to optimize any subsequent pilot attack as described in PCT/US2007/030159 and shown in FIG. 40. Specifically, several pilots can be detected simultaneously, with the strength of each ostensibly related to the relative distance from their respective towers (4001). Since it is impossible to predict with certainty on which pilot a phone may be operating due to vagaries such as fading, not only the strongest but also any other pilots of significance must be attacked (4002). Therefore the hole collection process must not only detect the strongest pilot but all of the viable pilots and their relative signal strength so that a commensurate attack can be mounted. For example (4003) if the surgical receiver is operating equidistant from two (or more) towers the pilot strengths would be nominally equal and therefore the available attack power would have to be diluted to attack all of them. However when operating significantly closer to one particular tower (4004), most of the energy is concentrated on defeating the associated pilot and less to those towers further away.

UMTS

UMTS is based on wideband (W)-CDMA and therefore has a structure similar to CDMA in that in UMTS, the timing and phasing of the waveform is entirely based on some reference pilot and therefore many of techniques previously described for CDMA are applicable. For example UMTS carries BCH and SCH channels that are similar in function to the CDMA overhead and synchronization channels. The techniques as applied to UMTS consequently have many similarities to the techniques as applied to CDMA.

Details Concerning Interferer Holes

Pseudo-Random Interferer Hole Timing

Nothing in the techniques precludes the interferer from timing the hole pseudo-randomly, presuming that all interferers have the same timing source (e.g., GPS) and agree on the timing pattern for the holes and the agreed-on pattern is made known to the surgical receiver. An important feature of the method is that it is insensitive to the timing pattern for the holes as long as the pattern provides holes that in aggregate, eventually visit all of the places necessary to recover the required information. For example, in no place do the techniques require that information be collected in a particular order. Instead the techniques are opportunistic and will collect data when available and then correct for the time it was acquired when combining the snippets.

Sources of Interferer Hole Timing

The foregoing discussion has generally assumed that the source of the interferer hole timing is the interferer: the surgical receiver analyzes the current cellular environment to determine the size of any interferer holes and their times of occurrence and listens to the current cellular environment accordingly. Even in the case of pseudo-random timing of the holes, it is the interferer that determines the timing and communicates it to the surgical receiver.

It is, however, clear from the foregoing discussions of the techniques for analyzing what the receiver hears in the holes that it would often be advantageous if the surgical receiver could determine the size and/or timing of the holes, and there is in fact no reason why this is not possible. If the surgical receiver can communicate with the interferers, it can control the size of the interferer holes and the times of their occurrences, either by providing the interferers with a schedule or, if the surgical receiver is co-located with an interferer, directly controlling when the interferer generates its interference signal. Indeed, the preferred embodiment of FIG. 5 is well-adapted for control of generation of the interference signal by the surgical receiver. A particular case of when it is advantageous for the surgical receiver to directly control generation of signals by the interferer is the case described below, in which an interferer controlled by the surgical receiver is generating a baiting beacon in the presence of a reactive interferer that is not under control of the surgical receiver.

Micro Automatic Gain Control

Figure 41:
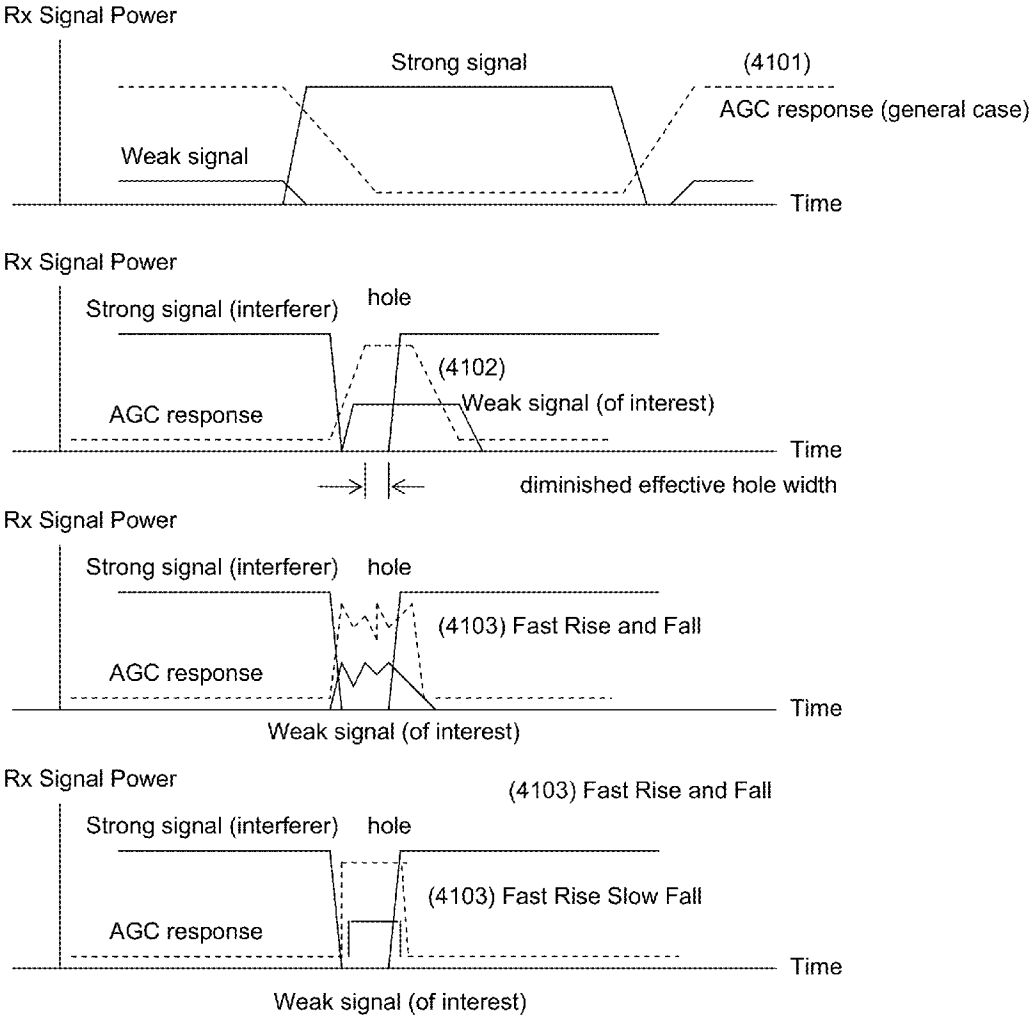
FIG. 41 shows the effects of variations in the way the receiver's automatic gain control is managed on receiving a weak signal in an interferer hole.

All well designed receivers employ an automatic gain control (AGC) feature that adjusts the received signal to optimum levels for subsequent processing. However in the presence of a high powered interferer, the AGC will necessarily react by attenuating the input signal level in response to the power of the interferer's signal. This response to the interferer's signal also reduces the apparent level of the signal which the receiver desires to listen to during the hole. When the hole occurs, it will take some time for the receiver to readjust (by relaxing the attenuation) as shown in FIG. 41. In a receiver design that is generalized to handle a broad class of signals, the AGC will often be adjusted for some reasonable compromise and will have symmetric rise and fall times (4101). In some sophisticated receivers there may even be several setting selections such as fast medium or slow reaction times. However the problem at hand is not just reacting to the signal of interest but also working around the large interference. As the hole duration diminishes, the AGC may not have an adequate response time and thus the signal that is of interest to the receiver is either greatly weakened or even imperceptible because it is drowned out by the lingering effects of the large interferer on the automatic gain control (4102). Adjusting the AGC response time to be very rapid would appear to be a solution; however, if the AGC response time is too rapid, the receiver will attempt to track short-term signaling variations, resulting in unwelcome distortion of the signal as received by the receiver (4103). An example would be pulsed signals where it is better to have longer term averaging than to react to each and every pulse. Another solution might be to forego AGC altogether and rely on the pure dynamic range of the receiver. However this is not feasible in general using existing technology, given that the interferer can be as much as 150 dB greater than the signal of interest and that processing bandwidths of nearly 100 MHz may be required.

To combat this, the surgical receiver employs an asymmetric AGC with very rapid rise time and very long decay time (e.g., 10 uS rise and 1 second fall). The AGC is reset precisely coincident with the start of the hole (4104). The purpose of the rapid rise time is to maximize the amount of signal collected in the hole or equivalently, to minimize the size of the hole. The net effect is that the AGC then reacts only to the signal of interest and holds this setting for the duration of the hole in order in order to collect the signal of interest at some optimal level.

Such an AGC mechanism can also be used to deal in general with the problem of collection of discontinuous (e.g. pulsed or bursting) signals. Here in addition to timing any interferer holes, the AGC is precisely reset and held at the beginning of individual GSM bursts as the bursts have been timed from the beacons using the previously described techniques. For example, the AGC techniques just described make it possible to collect signals from different GSM subscribers that are signaling in different slots at different levels as the AGC can be timed to adjust to each subscriber's signal. This critical refinement of the surgical receiver makes it possible to prevent phones that are signaling in a proximity to the surgical receiver which gives the phones' signals a strength similar to that of an interferer from masking phones that are further out. The signals produced by these phones would be treated by the surgical receiver in the same fashion as the signals produced by any other interferer.

Automatic Detection of Interferer Holes

Interferers are necessarily high powered and will therefore overwhelm any background signaling. Therefore it is possible to use this to advantage by using the unmistakable gaps in the energy spectrum which are produced by the occurrence of interferer holes to automatically measure both the hole duration and periodicity. This makes it possible to dispense with preprogramming the surgical receiver with the timing for the holes but instead allow it to be more flexible so as to interoperate with any interferer it may encounter. A logical extension is to have the receiver characterize the interferer in general so that the holes the receiver listens in might take better advantage of the interferer's properties.

There are two broad classes of interferers: active and reactive. Active interferers constantly emit energy in some programmed portions of the spectrum and reactive interferers conserve energy by generating interference only when signaling of interest is detected.

Within the class of active interferers there are two broad classes: noise and swept. Noise interferers put up indiscriminate signaling that is simultaneously spread across the entire portion of some part of the spectrum. Swept interferers sweep what is essentially a tone across the same portion of the spectrum. In either case it is only necessary to have the receiver camp on any part of the spectrum of interest and then simply time the holes.

Figure 42:
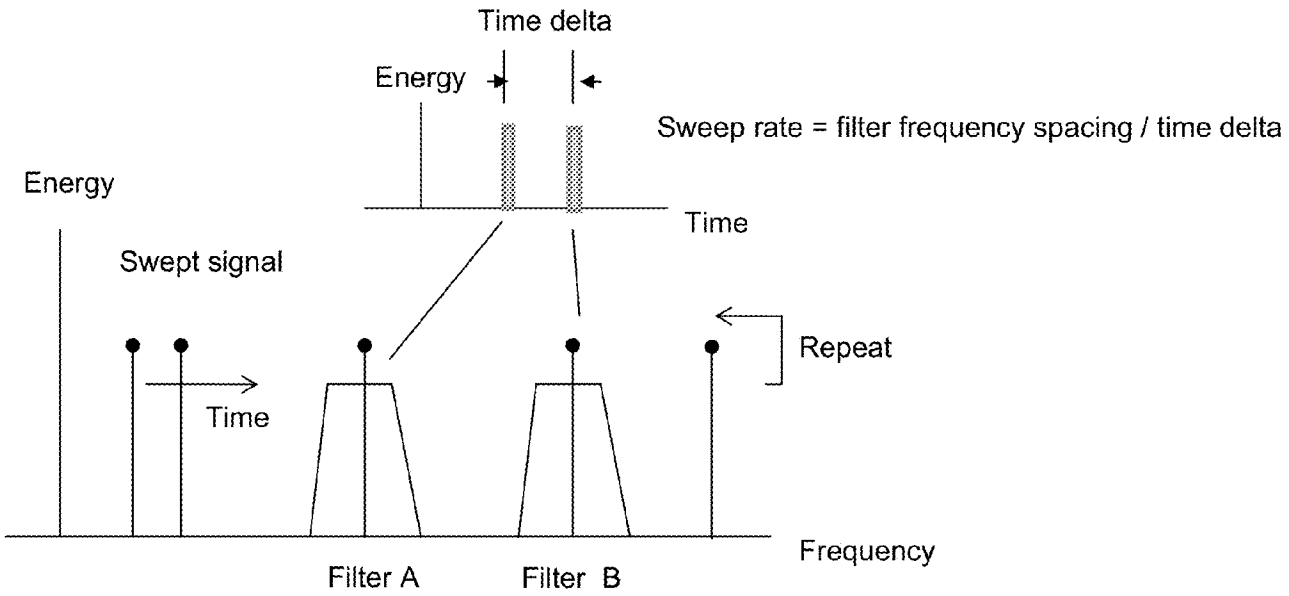
FIG. 42 shows how the receiver may determine the sweep and phase of a swept interferer.

However in the latter case, the receiver takes the additional step of characterizing the sweep and phase. Here the receiver sweeps an energy filter across the entire band dwelling for some period of time in each portion of the band. By comparing the energy timing in each dwell, the receiver can determine not only the hole timing, but also the sweeping pattern itself, including any portions of the spectrum it does not cover. For example, by comparing the relative timing of the energy outputs of two different filters, the surgical receiver can determine how fast the sweeping occurs, as shown in FIG. 42.

It further may be possible for the receiver to work around the sweeping in either time or spectrum and gain access to portions of the spectrum outside of the established holes and thereby further decrease the amount of time required to acquire the desired portion of the cellular environment.

Reactive interferers obviously limit the use of techniques described above. However, a surgical interferer can acquire information about a reactive interferer simply by emitting signals in the portions of the spectrum for which the behavior of the reactive interferer is of interest and seeing how the reactive interferer reacts to the signals, in effect provoking the reactive interferer to see what it does. In the simplest case a tone would suffice to determine the reactive interferer's hole timing. If both the surgical interferer and the reactive interferer are timed off of GPS this provocation would only be required once; however the provocation may be repeated to detect reactive interferers that are not collocated and/or are timed from a different source.

The provocation can be made more sophisticated by bursting the tone, adjusting its level and moving it around in frequency to probe the reaction and tuning times as well as the ability of the interferer to moderate the interfering power to be commensurate with the signal strength. The method also anticipates extending the provocative probing to include cellular signals. For example, reactive interferers might expressly look only for cellular signaling so as to not produce false alarms and therefore expend energy on nonthreatening "nuisance" signals.

Further still, multiple signals can be generated to determine the limits of the interferer, which can in turn be used to dilute the interference so that subsequent interrogation can be performed. For example it may be the case that the interferer can only deploy so many signals in so many places and therefore the method creates a distraction and then puts up a baiting beacon in some uncovered portion of the spectrum.

Provoking a reactive interferer has the potential to limit the reactive interferer's effectiveness. Therefore the surgical interferer will periodically generate a provocative signal to detect the presence of new reactive interferers. However the surgical interferer can be selective in this process. For example the surgical interferer can generate a GMSK modulated signal on one of the GSM channels selected from a known mobile allocation derived from analyzing a local beacon as described previously. In this case any interference is not diluted because it is using a frequency channel that would be attacked in any case if it was detected as a threat.

Mixed Operation

An important extension to the method is to use a provoking signal to determine if there is indeed any interferer present and if not resort to operating without holes to speed up the acquisition process.

Nothing proposed herein precludes a surgical receiver from taking signal measurements even when the interferer is on in the chance that a signal of interest is above the interfering level.

Interrogation Interoperability with Reactive Interferers

Figure 43:
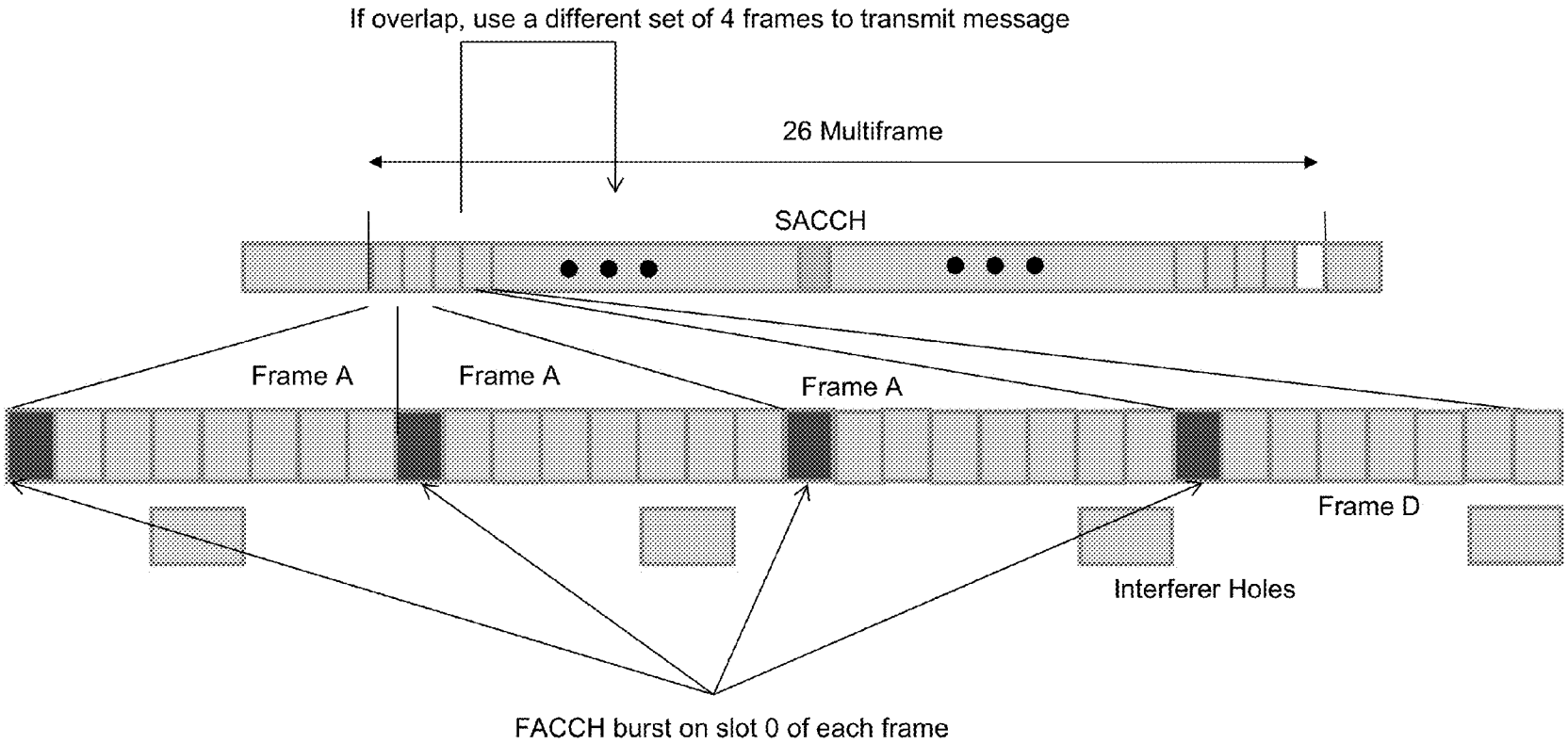
FIG. 43 shows how a baiting beacon may interact with a phone without broadcasting during interferer holes by using the FACCH burst.

As described previously, an important application of the method is to enable the interrogation of threatening devices in the presence of interferers. Parts of the interrogation may involve baiting beacons. Unfortunately the standards require that a beacon be uninterrupted and in so complying, the baiting beacons used for interrogation will themselves be attacked by a reactive interferer should they be active during interferer holes. However, the standards and the design of cellular equipment are such that it is reasonably forgiving with respect to fading and noise. For example the beacon information repeats regularly and therefore for holes of reasonable size it is expected that the phone will still be enticed by a baiting beacon even though the baiting beacon's signals have the interferer holes which the surgical receiver requires to acquire the cellular embodiment. Hence the problem is solved by merely suppressing the baiting beacon during the holes and depending on the message redundancy to eventually get the attention of the phone. The problem then shills to the registration/call setup, where the signaling is not likely to survive an expected vigorous attack from the reactive interferer. Therefore the baiting beacon's signaling must be designed to tiptoe around the holes. Here the method forgoes the traditional use of the SDCCH channels because they are highly structured and therefore there is little latitude in adjusting their timing. Instead, as shown in FIG. 43, the baiting beacon interrogates a phone by directing it to a TCH and then uses the fast associated channel (FACCH) associated with the TCH to perform the messaging exchange with the phone. The critical improvement is that the FACCH is relatively unstructured. The baiting beacon simply anticipates the holes and then schedules a FACCH burst so that it does not coincide with the holes and thus set off an attack by a reactive interferer.

For other standards such as CDMA or UMTS the approach is fundamentally different. Here the message signaling is spread over 10 s of milliseconds and it is therefore not possible in general for the baiting beacon to tiptoe around reasonable hole sizes and periodicities (e.g., 1 hole every 10 mS). Instead the baiting beacon simply refrains from transmitting in the holes (so as not to arouse the reactive interferer) and then relies on the coding redundancy provided by the signal to enable the handset in the receiver to continue to recover the messages from the baiting beacon. This of course presumes that the size of the holes is small compared with the period between the holes.

Preferred Embodiment

A transceiver that may be used to implement the surgical interferer is the ComHouse Wireless Network Subscriber Test (NST), which may be purchased from ComHouse Wireless LP, 221 Chelmsford St., Chelmsford, Mass. 01824. The unit is a software defined radio capable of testing both wireless devices and base stations using the GSM and CDMA standards. NST can interrogate wireless devices by acting as a baiting beacon, can scan cellular environments so as to identify and analyze beacons, and can generate multiple simultaneous signals which can be used as interference signals. The interference signals may be customized to surgically attack or manipulate cellular signals with sub-microsecond precision. The unit can also make and receive outgoing and incoming phone calls. Another version of the NST consists of separate software modules which implement its receiving and signal generation functions and which may be incorporated into other software radio systems.

Conclusion

The foregoing Detailed Description has disclosed to those skilled in the relevant technologies how to carry out and use the inventive techniques disclosed herein and has further disclosed the best modes presently known to the inventor of implementing the inventive techniques. As will be immediately apparent to those skilled in the relevant technologies, the inventive techniques have general applicability to standardized signaling environments and are not limited either to cellular telephone signaling environments, to time division multiplexed signaling environments, to code division multiplexed signaling environments, or to the GSM and CDMA standards for which examples are given in the Detailed Description. As is clear from the discussion of the application of the techniques to GSM and CDMA herein, the manner in which a given inventive technique is applied will, however, depend upon the particular character of the signaling environment to which they are applied. As is also clear from the discussion in the Detailed Description, specific applications of the techniques will also depend upon the nature of the interferers which are being applied to the signaling environment, on the size and timing of the available interferer holes, and upon the relationship between the interferers and the receiver which is attempting to recover information about the signaling environment. For all of the foregoing reasons, the Detailed Description is to be regarded as being in all respects exemplary and not restrictive, and the breadth of the invention disclosed here in is to be determined not from the Detailed Description, but rather from the claims as interpreted with the full breadth permitted by the patent laws.

The invention claimed is:

1. A method of obtaining information about a repeated structure in a signal which is generated according to the Global System for Mobile Communications (GSM) standard and which represents a sequence of symbols, the repeated structure having a first timing in the signal and the method being performed in apparatus including a receiver and a signal analyzer and comprising the steps performed in the apparatus of:

receiving the signal for a set of discrete periods in the receiver, the periods in the set having a second timing such that over a plurality of repetitions of the repeated structure in the signal, the entire repeated structure is received in the receiver, wherein, the set of discrete periods is made up of periods during which the signal is not being interfered with by an interferer;

converting the signal as received in each of the discrete periods in the set into symbols; and analyzing the symbols in the analyzer to obtain the information about the repeated structure.

2. The method set forth in claim 1 further comprising the step performed in the receiver of:

determining the set of discrete periods from the interferer's behavior.

3. The method set forth in claim 1 wherein:

the apparatus is operating in cooperation with the interferer.

4. The method set forth in claim 3 wherein the method further comprises the step of:

providing the obtained information about the repeated structure to the interferer.

5. The method set forth in claim 3 wherein the method further comprises the step of:

obtaining a specification of the set of discrete periods from the cooperating interferer.

6. The method set forth in claim 3 wherein:

the receiver determines the set of discrete periods during which the cooperating interferer does not interfere with the signal.

7. The method set forth in claim 6 wherein:

the receiver determines the set of discrete periods according to the kind of information to be obtained and/or the speed with which the information is to be obtained.

8. The method set forth in claim 1 wherein:

in the analyzing, the symbols from a plurality of the discrete periods are combined using a statistical method.

9. A method of obtaining information about a repeated structure in a signal which is generated according to a standard and which represents a sequence of symbols, the repeated structure having a first timing in the signal and the method being performed in apparatus including a receiver and a signal analyzer and comprising the steps performed in the apparatus of:

receiving the signal for a set of discrete periods in the receiver, the periods in the set having a second timing such that over a plurality of repetitions of the repeated structure in the signal, the entire repeated structure is received in the receiver;

converting the signal as received in each of the discrete periods in the set into symbols; and analyzing the symbols in the analyzer to obtain the information about the repeated structure, wherein:

the repeated structure is a frame which includes another repeated structure which contains timing information about the frame; and the method includes the steps performed in the analyzer of:

obtaining the timing information from the second repeated structure in the set of digital representations; and using the timing information to determine a location of a further repeated structure in the frame.

10. The method set forth in claim 9 wherein the method includes the steps performed in the analyzer of:

using the determined location to locate a representation of the further structure in the set of digital representations; and obtaining further information about the frame from the located representation.

11. A method of obtaining information about a repeated structure in a signal which is generated according to a standard and which represents a sequence of symbols, the repeated structure having a first timing in the signal and the method being performed in apparatus including a receiver and a signal analyzer and comprising the steps performed in the apparatus of:

receiving the signal for a set of discrete periods in the receiver, the periods in the set having a second timing such that over a plurality of repetitions of the repeated structure in the signal, the entire repeated structure is received in the receiver;

converting the signal as received in each of the discrete periods in the set into symbols; and analyzing the symbols in the analyzer to obtain the information about the repeated structure, wherein:

the repeated structure is a frame which has a substructure; and a discrete period in the set thereof is too short to receive a portion of the signal that contains an entire substructure.

12. The method set forth in claim 11 wherein:

in the step of analyzing, a plurality of the discrete periods that contain portions of the substructure are combined using a statistical method.

13. The method set forth in claim 12 wherein:

in the step of analyzing, the symbols are further combined using soft decoding techniques which employ results of the statistical method.

14. The method set forth in claim 11 wherein the substructure includes an error detection code; and the method further includes the step of:

using the substructure's error detection code to determine whether a result of the combination is correct.

15. The method set forth in claim 14 wherein:

the error detection code includes error correction information; and the method further includes the step of:

using the error correction information to reduce the number of possible combinations of the symbols.

* * * * *